US008330562B2

(12) United States Patent
Kawai et al.

(10) Patent No.: US 8,330,562 B2
(45) Date of Patent: Dec. 11, 2012

(54) VARIABLE RESONATOR, TUNABLE FILTER, AND ELECTRIC CIRCUIT DEVICE

(75) Inventors: Kunihiro Kawai, Kanagawa (JP); Hiroshi Okazaki, Kanagawa (JP); Shoichi Narahashi, Kanagawa (JP)

(73) Assignee: NTT DoCoMo, Inc., Tokyo (JP)

( * ) Notice: Subject to any disclaimer, the term of this patent is extended or adjusted under 35 U.S.C. 154(b) by 0 days.

(21) Appl. No.: 13/343,464

(22) Filed: Jan. 4, 2012

(65) Prior Publication Data

US 2012/0098616 A1 Apr. 26, 2012

Related U.S. Application Data

(62) Division of application No. 12/035,035, filed on Feb. 21, 2008, now Pat. No. 8,106,727.

(30) Foreign Application Priority Data

Feb. 22, 2007 (JP) ..... 2007-042753

(51) Int. Cl.
*H01P 1/203* (2006.01)
*H01P 7/08* (2006.01)

(52) U.S. Cl. ..... 333/205; 333/235

(58) Field of Classification Search ..... 333/202, 333/204, 205, 219, 235
See application file for complete search history.

(56) References Cited

U.S. PATENT DOCUMENTS

| | | | | |
|---|---|---|---|---|
| 4,749,963 | A | 6/1988 | Makimoto et al. | |
| 5,162,759 | A | 11/1992 | Yajima | |
| 5,479,142 | A | 12/1995 | Takahashi et al. | |
| 5,659,274 | A * | 8/1997 | Takahashi et al. | 333/204 |
| 2003/0025563 | A1 | 2/2003 | Christensen | |
| 2003/0062963 | A1 | 4/2003 | Aikawa et al. | |
| 2004/0095209 | A1 | 5/2004 | Mori | |
| 2005/0162241 | A1 | 7/2005 | Asamura | |
| 2005/0190018 | A1 | 9/2005 | Kawai et al. | |
| 2006/0087388 | A1 | 4/2006 | Kawai et al. | |
| 2008/0192331 | A1 * | 8/2008 | Wang et al. | 359/315 |

FOREIGN PATENT DOCUMENTS

| | | |
|---|---|---|
| JP | 2001-230602 | 8/2001 |
| JP | 2004-7352 | 1/2004 |
| JP | 2005-217852 | 8/2005 |

OTHER PUBLICATIONS

Kunihiro Kawai, et al. "Tunable Resonator Employing Comb-Shaped Transmission Line and Switches" NTT DoCoMo, Inc., Wireless Laboratories, pp. 193-196, Oct. 2005.

(Continued)

*Primary Examiner* — Benny Lee
*Assistant Examiner* — Gerald Stevens
(74) *Attorney, Agent, or Firm* — Oblon, Spivak, McClelland, Maier & Neustadt, L.L.P.

(57) ABSTRACT

A variable resonator that comprises a loop line (902) to which two or more switches (903) are connected and N variable reactance means (102) (N≧3), in which switches (903) are severally connected to different positions on the loop line (902), the other ends of the switches are severally connected to a ground conductor, and the switches are capable of switching electrical connection/non-connection between the ground conductor and the loop line (902), the variable reactance blocks (102) are severally settable to the same reactance value, and the variable reactance blocks (102) are electrically connected to the loop line (902) as branching circuits along the circumference direction of the loop line (902) at equal electrical length intervals.

13 Claims, 43 Drawing Sheets

OTHER PUBLICATIONS

Kunihiro Kawai, et al. "Tunable Band-pass Filter Employing Comb-shaped Transmission Line Resonator" C-2-37, NTT DoCoMo, Inc., Wireless Laboratories, p. 58 and 3 pages of English Translations, Sep. 21, 2006.
Kunihiro Kawai, et al. "Center-frequency and Bandwidth Tunable Band-pass Filter Employing Comb-shaped Transmission Line Resonator" C-2-35, NTT DoCoMo, Inc., Wireless Laboratories, p. 66 and 3 pages of English Translations, Mar. 25, 2006.
Kunihiro Kawai, et al. "Comb-shaped Transmission Line Tunable Resonator Employing MEMS RF Switches" C-2-77, NTT DoCoMo, Inc., Research Laboratories, pp. 96 and 3 pages of English Translations, Sep. 22, 2006.
Dimitrios Peroulis, et al. "Tunable Lumped Components with Applications to Reconfigurable MEMS Filters" 2001 IEEE MTT-S Digests, TU4C-6, pp. 341-344.
Hong-Teuk Kim, et al. "Low-Loss and Compact V-Band MEMS-Based Analog Tunable Bandpass Filters" IEEE Microwave and Wireless Components Letters, vol. 12, No. 11, Nov. 2002, pp. 432-434.
E. Fourn, et al. "Bandwidth and Central Frequency Control on Tunable Bandpass Filter by Using MEMS Cantilevers" 2003 IEEE MTT-S Digest, IFTU-21, pp. 523-526.
Arnaud Pothier, et al. "Low-Loss 2-Bit Tunable Bandpass Filters Using MEMS DC Contact Switches", IEEE Transactions on Microwave Theory and Techniques, vol. 53, No. 1, Jan. 2005, pp. 354-360.
Bruce E. Carey-Smith, et al. "Wide Tuning-Range Planar Filters Using Lumped-Distributed Coupled Resonators", IEEE Transactions on Microwave Theory and Techniques, vol. 53, No. 2, Feb. 2005, pp. 777-785.
Kamran Entesari, et al. "A Differential 4-bit 6.5-10-GHz RF MEMS Tunable Filter" IEEE Transactions on Microwave Theory and Techniques, vol. 53, No. 3, Mar. 2005, pp. 1103-1110.
Kamran Entesari, et al. "A 12-18-GHz Three-Pole RF MEMS Tunable Filter" IEEE Transactions on Microwave Theory and Techniques, vol. 53, No. 8, Aug. 2005, pp. 2566-2571.
Lung-Hwa Hsieh, et al. Slow-Wave Bandpass Filters Using Ring or Stepped-Impedance Hairpin Resonators, IEEE Transactions on Microwave Theory and Techniques, vol. 50, No. 7, Jul. 2002, pp. 1795-1800.
Arun Chandra Kundu. et al. "Attenuation Pole Frequency Control of a Dual-Mode Circular Microstrip Ring Resonator BPF" 29$^{th}$ European Microwave Conference, 1999, pp. 329-332.
Kunihiro Kawai, et al. "Center Frequency and Bandwidth Tunable Filter Employing Tunable Comb-Shaped Transmission Line Resonators and J-inverters" Proceedings of the 36$^{th}$ European Microwave Conference. Sep. 2006, pp. 649-652.
Lei Zhu, et al. "A Joint Field/Circuit Design Model of Microstrip Ring Dual-Mode Filter: Theory and Experiments" 1997 Asia Pacific Microwave Conference, 4p18-7, pp. 865-868.
S. H. Al-Charchafchi, et al. "Varactor tuned microstrip ring resonators" IEE Proceedings, vol. 136, Pt. H, No. 2, Apr. 1989, pp. 165-168.
T. Martin, et al. Electronically Tunable and Switchable Filters Using Microstrip Ring Resonator Circuits 1988 IEEE MTT-S Digest, OF-2-22, pp. 803-806.
P. Gardner, et al. "Microwave Voltage tuned Microstrip Ring Resonator Oscillator" Electronics Letters, vol. 30, No. 21, Oct. 13, 1994, p. 1770-1771.
Michiaki Matsuo, et al. "Dual-Mode Stepped-Impedance Ring Resonator for Bandpass Filter Applications" IEEE Transactions on Microwave Theory and Techniques, vol. 49, No. 7, Jul. 2001, pp. 1235-1240.
Hitoshi Ishida, et al. "A design of Tunable UWB Filters" FA4-5, IEEE 2004, pp. 424-428.
Julio A. Navarro, et al., "Varactor-Tunable Uniplanar Ring Resonators", IEEE Transactions on Microwave Theory and Techniques, vol. 41, No. 5, XP 000396777, ISSN: 0018-9480, May 1, 1993, pp. 760-766.
Kunihiro Kawai, et al., "Ring Resonators for Bandwidth and Center Frequency Tunable Filter" Proceeding of the 37$^{th}$ European Microwave Conference, XP31191793, ISBN: 978-2-87487-001-9, Oct. 1, 2007, pp. 298-301.

* cited by examiner

VARIABLE RESONATOR, TUNABLE FILTER, AND ELECTRIC CIRCUIT DEVICE

CROSS-REFERENCE TO RELATED APPLICATIONS

This application is a divisional application of U.S. application Ser. No. 12/035,035, filed Feb. 21, 2008, now allowed, the entire contents of which is incorporated herein by reference. U.S. application Ser. No. 12/035,035 claims the benefit of priority under 35 U.S.C. §119 from Japanese Application No. 2007-042753 filed Feb. 22, 2007.

BACKGROUND OF THE INVENTION

1. Field of the Invention

The present invention relates to a variable resonator, a tunable filter, and an electric circuit device using the same.

2. Description of the Related Art

In the field of high frequency radio communication, necessary signals and unnecessary signals are separated by taking out a signal of particular frequency from a large number of signals. A circuit serving the function is called a filter, and is mounted on many radio communication devices.

In a general filter, center frequency, bandwidth or the like representing the characteristics of the filter are invariant. To make radio communication devices using such a filter applicable for various frequencies, a method is easily considered in which a plurality of filters having different combinations of center frequencies and bandwidths are prepared and the filters are switched by a switch or the like corresponding to frequency application. In this method, filters are necessary by the number of desired combinations of center frequencies and bandwidths, and thus a circuit size increases. For this reason, the device increases in size. Further, it is impossible to operate the filter on frequency characteristics other than previously designed frequency characteristics that each filter has.

Patent literature 1 given below discloses a filter to solve the problem which has resonators using piezoelectric bodies. A bias voltage is applied to the piezoelectric bodies from outside to change the frequency characteristics (resonance frequency) of the piezoelectric bodies, and then the bandwidth of the filter is changed.

Patent literature 1: Japanese Patent Application Laid-Open No. 2004-007352

Non-Patent literature 1 given below discloses a resonator which has two microstrip line 802 arranged in a ring shape by allowing their end portions to face each other and whose facing end portions are connected by PIN diodes 10*a* (refer to FIG. 48). The center frequency of a filter is variable by using the resonator. Non-Patent literature 1: T. Scott Martin, Fuchen Wang and Kai Chang, "ELECTRONICALLY TUNABLE AND SWITCHABLE FILTERS USING MICROSTRIP RING RESONATOR CIRCUITS", IEEE MTT-S Digest, 1988, pp. 803-806.

Although the tunable filter disclosed in the Patent literature 1 has a bandwidth as a ladder type filter, the changing width of the center frequency is as small as about 1% to 2% due to the limitation of the characteristics of the piezoelectric bodies. For this reason, variation of bandwidth is also about the same level, and a significant change of bandwidth is not possible.

By using the filter disclosed in the Non-Patent literature 1, the center frequency is variable but the bandwidth cannot be made significantly variable.

SUMMARY OF THE INVENTION

In view of such circumstances, it is an object of the present invention to provide a variable resonator, a tunable filter and an electric circuit device, which are capable of freely changing a resonance frequency (center frequency in the case of filter) independently of the change of bandwidth while capable of significantly changing bandwidth.

The variable resonator of the present invention comprises: a line body where one or a plurality of lines are constituted in a loop shape; a ground conductor; at least two switches; and at least three variable reactance blocks each capable of changing a reactance value, wherein the switches have one ends electrically connected to different positions on the line body and the other ends electrically connected to the ground conductor, and are capable of switching electrical connection/non-connection between the ground conductor and the line body, and each of the variable reactance blocks are electrically connected to the line body at predetermined intervals based on an electrical length at a resonance frequency. Hereinafter, the variable resonator is called a variable resonator X.

The variable resonator X may adopt the constitution that the line body is a single loop line and the variable reactance blocks are electrically connected to the loop line as branching circuits along the circumference direction of the loop line at predetermined intervals based on the electrical length at the resonance frequency whose one wavelength or integral multiple thereof corresponds to the circumference of the loop line. Hereinafter, the variable resonator is called a variable resonator A.

The variable resonator A may adopt the constitution that the variable reactance blocks are severally settable to the same reactance value and are connected to the loop line at the equal electrical length intervals.

The variable resonator A may adopt the constitution that the total number of the variable reactance blocks is M where M is an even number of 4 or larger, the variable reactance blocks are severally settable to the same reactance value; M/2−1 variable reactance blocks are connected clockwise to a part of the loop line between a position K1 arbitrarily set on the loop line and a position K2 half the electrical length of one circumference of the loop line except the position K1 and the position K2 so as to divide the part at the equal electrical length intervals; M/2−1 variable reactance blocks are connected counter-clockwise to a remaining part of the loop line between the position K1 and the position K2 except the position K1 and the position K2 so as to divide the remaining part at the equal electrical length intervals; and two variable reactance blocks are connected to the position K2 of the loop line.

The variable resonator A may adopt the constitution that the total number of the variable reactance blocks is M−1 where M is an even number of 4 or larger; M−2 variable reactance blocks out of M−1 variable reactance blocks (hereinafter, referred to as first variable reactance blocks) are severally settable to the same reactance value and remaining one variable reactance block (hereinafter, referred to as a second variable reactance block) is settable to half the value of the reactance value of each first variable reactance block; M/2−1 first variable reactance blocks are connected clockwise to a part of the loop line between a position K1 arbitrarily set on the loop line and a position K2 half the electrical length of one circumference of the loop line except the position K1 and the position K2 so as to divide the part at the equal electrical length intervals; M/2−1 first variable reactance blocks are connected counter-clockwise to a remaining part of the loop line so as to divide the remaining part at the equal electrical length intervals; and the second variable reactance block is connected to the position K2 of the loop line.

The variable resonator X may adopt the constitution that the line body is constituted of at least three lines; the switches have one ends electrically connected to any one of the lines at different positions and the other ends electrically connected to the ground conductor, and are capable of switching electrical connection/non-connection between the ground conductor and the line; each line has a predetermined electrical length at the resonance frequency whose one wavelength or integral multiple thereof corresponds to the sum of the line lengths of the lines; and at least one variable reactance block is electrically connected in series between adjacent lines. Hereinafter, the variable resonator is called a variable resonator B.

The variable resonator B may adopt the constitution that the total number the lines is N and the total number of the variable reactance blocks is N where N is an integer of three or larger; the variable reactance blocks are severally settable to the same reactance value; each line has an equal electrical length; and one variable reactance block is connected between adjacent lines.

The variable resonator B may adopt the constitution that the total number of the lines is M−1 and the total number of the variable reactance blocks is M where M is an even number of four or larger; the variable reactance blocks are severally settable to the same reactance value; one variable reactance block is connected between an i-th line and an (i+1)-th line where i is an integer satisfying $1 \leqq i < M/2$; two variable reactance blocks in series connection are connected between an (M/2)-th line and an (M/2+1)-th line; one variable reactance block is connected between an i-th line and an (i+1)-th line where i is an integer satisfying $M/2+1 \leqq i < M-1$; one variable reactance block is connected between an (M−1)-th line and the 1st line; an electrical length from a position K arbitrarily set on the 1st line to an end portion of the 1st line which is closer to the 2nd line and each electrical length of the i-th line where i is an integer satisfying $1 \leqq i \leqq M/2$ are equal; and an electrical length from the position K to an end portion of the 1st line which is closer to the (M−1)-th line and each electrical length of the i-th line where i is an integer satisfying $M/2+1 \leqq i \leqq M-1$ are equal.

The variable resonator B may adopt the constitution that the total number of the lines is M−1 and the total number of the variable reactance blocks is M−1 where M is an even number of 4 or larger; M−2 variable reactance blocks out of M−1 variable reactance blocks (hereinafter, referred to as first variable reactance blocks) are severally settable to the same reactance value and remaining one variable reactance block (hereinafter, referred to as a second variable reactance block) is settable to a value twice the reactance value of each of the first variable reactance blocks; one first variable reactance block is connected between an i-th line and an (i+1)-th line where i is an integer satisfying $1 \leqq i < M/2$; the second variable reactance block is connected between an (M/2)-th line and an (M/2+1)-th line; one first variable reactance block is connected between an i-th line and an (i+1)-th line where i is an integer satisfying $M/2+1 \leqq i < M-1$; one first variable reactance block is connected between an (M−1)-th line and the 1st line; an electrical length from a position K arbitrarily set on the 1st line to an end portion of the 1st line which is closer to the 2nd line and each electrical length of the i-th line where i is an integer satisfying $1 \leqq i \leqq M/2$ are equal; and an electrical length from the position K to an end portion of the 1st line which is closer to the (M−1)-th line and each electrical length of the i-th line where i is an integer satisfying $M/2+1 \leqq i \leqq M-1$ are equal.

In each constitution described above, a bandwidth straddling a resonance frequency can be changed significantly by changing a switch to be turned to a conduction state (ON state), and furthermore, the resonance frequency changes independently of the bandwidth by changing the reactance values of the variable reactance blocks.

In the above-described variable resonators (X, A, B), the line body is connected electrically to the ground conductor by any one of the switches.

The tunable filter of the present invention comprises: at least one variable resonator X and a transmission line, wherein the variable resonator is connected electrically to the transmission line.

The passband width of a signal can be changed significantly by using the above-described variable resonator X, and furthermore, the resonance frequency changes independently of the bandwidth by changing the reactance values of the variable reactance blocks.

The tunable filter may adopt the constitution that at least 2 variable resonators are provided, wherein each of the variable resonators is connected to the transmission line as a branching circuit via a switch (hereinafter, referred to as a second switch) at the same coupled portion; and the transmission line is capable of being connected electrically to all or a part of the variable resonators by the selected second switch(es).

The electric circuit device of the present invention comprises: at least one variable resonator X and a transmission line T having a bent portion, wherein the bent portion of the transmission line T is connected electrically to the variable resonator X.

The electric circuit device may adopt the constitution that a part of the variable resonator on an area where the bent portion of the transmission line T and the variable resonator are electrically connected and in the vicinity of the area is not parallel with the transmission line T.

EFFECTS OF THE INVENTION

According to the present invention, the resonance frequency (center frequency in the case of a filter) can be freely changed independently of the bandwidth by changing the reactance values of variable reactance blocks, and the bandwidth can be freely changed while the resonance frequency (center frequency in the case of the filter) is sustained at a constant value by selecting a switch to be turned to the ON state (electrically connected state) from a plurality of switches.

Further, in the variable resonator of the present invention, loss of signal at the resonance frequency is dominated by the parasitic resistances of the conductor line which mainly constitutes a variable resonator and the variable reactance blocks, influence of insertion loss by switches or the like is small. For this reason, the loss of a signal in the passband can be suppressed even if the tunable filter is constituted of using switches or the like having large loss for the variable resonator.

Further, in the electric circuit device of the present invention, a bandwidth straddling the resonance frequency can be significantly changed, and additionally, an insertion loss caused by coupling with the variable resonator can be suppressed by using the variable resonator of the present invention.

DETAILED DESCRIPTION

Figure 1:
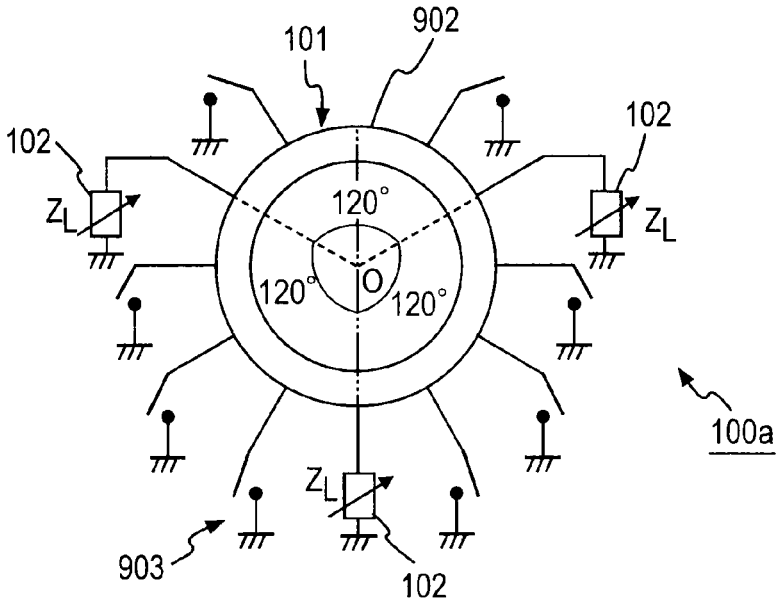
FIG. 1 is a plan view of a variable resonator 100*a* to which the variable reactance blocks 102 are branching-connected.

FIG. 1 shows the variable resonator 100*a* being one embodiment of the present invention in the case where the resonator is constituted as a microstrip line structure. The variable resonator 100*a* comprises a loop line body 101 being a closed circuit and N variable reactance blocks 102 (N is an integer satisfying N≧3). FIG. 1 exemplifies the variable resonator 100*a* in the case of N=3. As the loop line body 101, a variable resonator 900 disclosed in Japanese Patent Application No. 2006-244707 (flied and undisclosed) may be employed. So, the outline of the variable resonator 900 will be described first, and description will be made next for the variable reactance blocks 102.

[Loop Line Body]

Figure 47A:
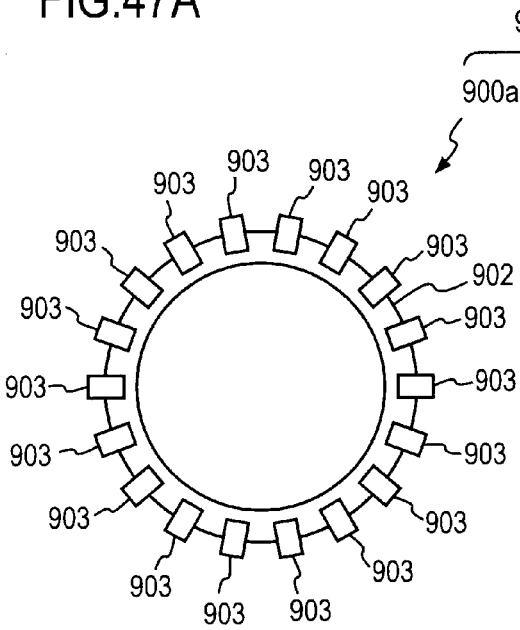
FIG. 47A is a plan view of a variable resonator 900*a;*
Figure 47B:
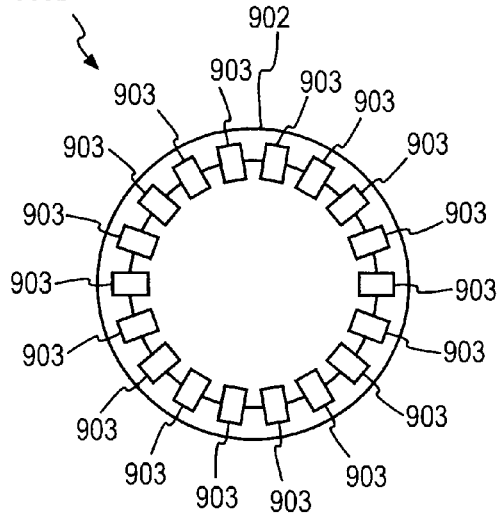
FIG. 47B is a plan view of a variable resonator 900*b;*

As two specific modes of the variable resonator 900, a variable resonator 900*a* and a variable resonator 900*b* are exemplified respectively in FIG. 47A and FIG. 47B. Hereinafter, when both the variable resonator 900*a* and the variable resonator 900*b* are acceptable, reference numeral 900 is allocated and it is called the variable resonator 900. Herein, description will be made for the variable resonator 900 that is constituted as the microstrip line structure.

Figure 47C:
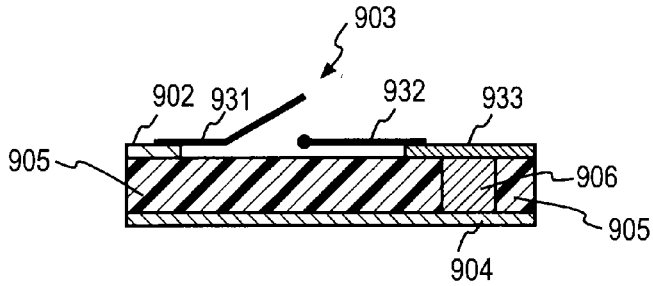
FIG. 47C is a cross-sectional view of a switch portion of the variable resonator 900*a*.

The variable resonator 900 is made up of a conductor line 902 (hereinafter, also simply called a "line" or a "loop line") and two or more of switches 903. The line 902 is formed on one surface of a dielectric substrate 905 by a conductor such as metal. In the dielectric substrate 905, a ground conductor 904 is formed by a conductor such as metal and is formed on a surface (referred to as a rear surface) on the opposite side of the surface on which the line 902 is provided. In each switch 903, as shown in FIG. 47C, one end 931 of the switch 903 is electrically connected to the line 902, the other end 932 of the switch 903 is electrically connected to the ground conductor 904 on the rear surface of the dielectric substrate 905 via a conductor 933 and a via hole 906. Since the shape of the conductor 933 or the like is not limited at all, illustration of the conductor 933 is omitted in FIG. 47A and FIG. 47B. Arrangement of switches 903 is not limited to be at equal intervals, but may be designed arbitrarily in order to obtain a desired bandwidth. Further, not limited to switches 903, switches in this specification are not limited to a contact-type switch, but may be a so-called switching element having a switching function of circuit without providing a contact in a circuit network, which uses diodes, transistors or the like, for example. A switching diode or the like is cited as a specific example.

The line 902 is a loop line which has a length of a phase change of 2π (360 degrees) at a desired resonance frequency, that is, a length of one wavelength or integral multiple thereof at the resonance frequency. In the variable resonator 900 shown in FIG. 47A and FIG. 47B, the line is exemplified as a loop line of a round shape. The "loop" here means a so-called simple closed curve. In short, the line 902 is a line whose starting point and ending point match and does not cross itself halfway.

Herein, the "length" means the circumference of the loop line, and is a length from a certain position on the line to this position after making a full circle.

Herein, the "desired resonance frequency" is one element of performance generally required in a resonator, and is an arbitrary design matter. Although the variable resonator 900 may be used in an alternating-current circuit and a subject resonance frequency is not particularly limited, it is useful when the resonance frequency is set to a high frequency of 100 kHz or higher, for example.

In the present invention, it is desirable that the line 902 is a line having uniform characteristic impedance. Herein, "having uniform characteristic impedance" means that when the loop line 902 is cut with respect to a circumference direction so as to be fragmented into segments, these segments have severally the same characteristic impedance. Making the characteristic impedance precisely become completely the same value is not an essential technical matter, and manufacturing the line 902 so as to set the characteristic impedance to substantially the same value is enough from a practical viewpoint. Assuming that a direction orthogonal to the circumference direction of the line 902 is referred to as the width of the line 902, in the case where the relative permittivity of the dielectric substrate 905 is uniform, the line 902 formed to have substantially the same width at any point has a uniform characteristic impedance.

A difference between the variable resonator 900*a* and the variable resonator 900*b* is whether the other end 932 of the switch 903 is provided inside the line 902 or provided outside thereof. The other end 932 of the switch 903 is provided outside the line 902 in the variable resonator 900*a*, and the other end 932 of the switch 903 provided inside the line 902 in the variable resonator 900*b*.

Hereinafter, description will be made on the assumption that the loop line body 101 is the variable resonator 900. Further, to prevent drawings from becoming complicated, illustration of the switches 903 may be omitted in showing the circular line body 101.

[Variable Reactance Block]

Assuming that an impedance Z is expressed in Z=R+jX (j is an imaginary unit), the variable reactance block 102 is a means capable of changing X with R=0 regarding an impedance $Z_L$ of the variable reactance block ideally. Although R≠0 holds practically, it does not affect the basic principle of the present invention. As a specific example of the variable reactance block 102, a circuit element such as a variable capacitor, a variable inductor and a transmission line, a circuit where a plurality of same type items out of them are combined, a circuit where a plurality of different type items out of them are combined and the like are cited.

It is necessary that N variable reactance blocks 102 severally be capable of taking the same or substantially the same reactance value. Herein, the reason why "substantially the same" reactance value should be enough, in other words, setting N variable reactance blocks 102 to completely the same reactance value is not strictly requested as a design condition is as follows. The fact that the reactance values of N variable reactance blocks 102 are not completely the same causes a small deviation of the resonance frequency (in short, a desired resonance frequency cannot be sustained). However, the fact causes no problem practically since the deviation of the resonance frequency is absorbed into bandwidth. In the following, as a technical matter including this meaning, it is assumed that N variable reactance blocks 102 are capable of taking the same reactance values.

The above-described conditions commonly apply to various variable reactance blocks 102 that will be described later. For this condition, although it is desirable that N variable reactance blocks 102 are all the same type, they may not necessarily be variable reactance blocks of the same type as long as it is possible to achieve the condition that the same reactance value is taken as described above. Herein, description will be made by allocating the same reference numeral 102 to the variable reactance blocks on the assumption that this content is included.

[Variable Resonator]

N variable reactance blocks 102 are connected electrically to the line 902 as branching circuits at equal intervals based on the electrical length at a resonance frequency whose one wavelength or integral multiple thereof corresponds to the circumference of the line 902 regarding the circumference direction of the line 902. In actual designing, the resonance frequency whose one wavelength or integral multiple thereof corresponds to the circumference of the line 902 should be the resonance frequency of the variable resonator 900 to which no variable reactance block 102 is connected, for example. In the case where the relative permittivity of the dielectric substrate 905 is uniform, the equal electrical length intervals match equal intervals based on the physical length. In such a case and when the line 902 is a circular shape, N variable reactance blocks 102 are connected to the line 902 at intervals where each central angle formed by the center O of the line 902 and each connection point of adjacent arbitrary variable reactance blocks 102 becomes an angle obtained by dividing 360 degrees by N (refer to FIG. 1). In the example shown in FIG. 1, end portions of variable reactance blocks 102 on the opposite side of the end portions which are connected to the line 902 are grounded by electrical connection to the ground conductor 904. However, as described later, since the variable reactance block 102 may be constituted of using a transmission line, for example, grounding the end portions of the variable reactance blocks 102 on the opposite side of the end portions which are connected to the line 902 is not essential.

Note that the connection points of the switches 903 to the line 902 are set such that desired bandwidths can be obtained. Therefore, connecting the switch 903 to a position where the variable reactance block 102 is connected is allowed.

Figure 2:
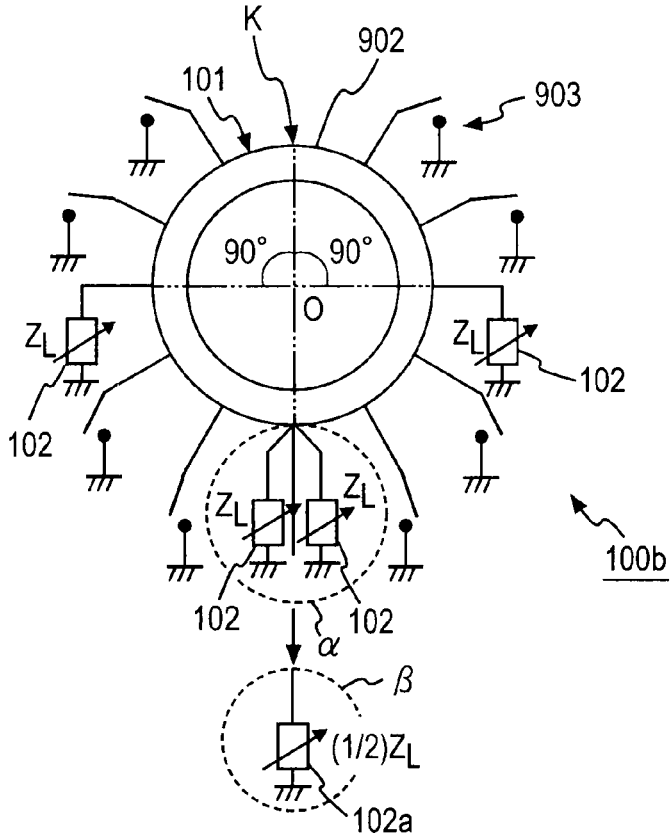
FIG. 2 is a plan view of a variable resonator 100*b* to which the variable reactance blocks 102 are branching-connected.

FIG. 2 shows a variable resonator 100*b* being one embodiment of the present invention constituted as a microstrip line structure, which is different from the variable resonator 100*a*. The variable resonator 100*b* has different connection points of the variable reactance blocks 102 to the line 902 from those of the variable resonator 100*a*.

In the variable resonator 100*b*, M variable reactance blocks 102 (M is an even number of 4 or larger) are electrically connected to the line 902 as branching circuits. In more details, at the resonance frequency whose one wavelength or integral multiple thereof corresponds to the circumference of the line 902, M/2−1 variable reactance blocks 102 are connected clockwise along the circumference direction at the intervals of equal electrical lengths from a certain position K1 arbitrarily set on the line 902 to a position K2 half the electrical length of the full loop of the line 902. It is to be noted that the equal electrical length intervals here mean equal electrical length intervals on the condition that the variable reactance blocks 102 are not provided on the position K1 and the position K2. Similarly, M/2−1 variable reactance blocks 102 out of the remaining variable reactance blocks 102 are connected counter-clockwise along the circumference direction at the interval of equal electrical length from the position K1 to the position K2. It is to be noted that the equal electrical length intervals here also mean equal electrical length intervals on the condition that the variable reactance blocks 102 are not provided on the position K1 and the position K2 as described above. Then, the remaining two variable reactance blocks 102 are connected to the position K2. Herein, it is assumed that "clockwise" and "counter-clockwise" refer to circling directions when seen from the front of page surface of the drawings (the same applies below). Similar to the variable resonator 100*a*, in actual design, the resonance frequency whose one wavelength or integral multiple thereof corresponds to the circumference of the line 902 should be the resonance frequency of the variable resonator 900 to which novariable reactance block 102 is connected, for example.

In the case where the relative permittivity of the dielectric substrate 905 is uniform, the equal electrical length intervals match the equal intervals based on the physical length. In such a case, from the certain position K arbitrarily set on the line 902 (corresponding to position K1) to a position half the circumference L of the line 902 along the circumference direction of the line 902 (corresponding to position K2), M/2 variable reactance blocks 102 are connected at positions remote from the position K by the distance of (L/M)×m (m is an integer satisfying $1 \leqq m \leqq M/2$) clockwise along the line 902. Similarly, from the position K to the position half the circumference L of the line 902 along the circumference direction of the line 902 (corresponding to position K2), the remaining M/2 variable reactance blocks 102 are connected at positions remote from the position K by the distance of (L/M)×m (m is an integer satisfying $1 \leqq m \leqq M/2$) counter-clockwise along the line 902. In short, the variable reactance block 102 is not connected to the position K, but two variable reactance blocks 102 are connected to the position remote from the position K by the distance of (L/M)×M/2 clockwise or counter-clockwise along the line 902.

Particularly in the case where the line 902 is a circular shape, M variable reactance blocks 102 are connected to positions remote by m times an angle obtained by dividing 360 degrees by M from the certain position K arbitrarily set on the line 902 clockwise along the route of the line 902 and to positions remote from the position K by m times the angle obtained by dividing 360 degrees by M counter-clockwise along the route of the line 902, seen from the center O of the line 902 (refer to FIG. 2). At this point, a position remote from the position K by M/2 times the angle obtained by dividing 360 degrees by M clockwise along the route of the line 902 matches a position remote by M/2 times the angle obtained by dividing 360 degrees by M counter-clockwise along the route of the line 902, and two variable reactance blocks 102 are connected at the position (regarding the case of M=4, refer to the dotted-line framed portion a of FIG. 2). In the example shown in FIG. 2, end portions of variable reactance blocks 102 on the opposite side of the end portions that are connected to the line 902 are grounded by electrical connection to the ground conductor 904. However, similar to the case of the variable resonator 100*a*, since the variable reactance block 102 may be constituted of using a transmission line, for example, grounding the end portions of the variable reactance blocks 102 on the opposite side of the end portions that are connected to the line 902 is not essential. Further, connecting the switch 903 to a position where the variable reactance block 102 is connected is allowed.

It is necessary that all of the M variable reactance blocks 102 are capable of taking the same or substantially the same reactance value. The meaning of "substantially the same" is as described above. However, the circuit configuration at the position where the two variable reactance blocks 102 are connected (corresponding to the above-described the position K2), that is, the portion shown by the dotted-line framed portion a of FIG. 2, may be changed to the circuit configuration that the two variable reactance blocks 102 electrically connected to the position are replaced with a single variable reactance block 102*a* (for example, refer to dotted-line framed portion β of FIG. 2). At this point, since the reactance value of the variable reactance block 102*a* corresponds to the combined reactance of the two variable reactance blocks 102, it must be noted that the reactance value of the variable reactance block 102*a* is set to a value half the reactance value of each of the variable reactance blocks 102 electrically connected to positions other than the position K2. In this case, the total number of the variable reactance blocks 102 becomes M−1 naturally.

In the description below and each drawings, for the convenience of description and illustration, description and illustration will be made based on the case where the electrical length is not influenced on the line 902, that is, the case where the equal electrical length intervals match the equal intervals based on the physical length. Not only technical characteristics understood from the drawings, technical characteristics made clear from the following description not only applies to the case where the equal electrical length intervals match the equal intervals based on the physical length, but also applies to the case where the variable reactance blocks 102 are at the above-described connection points based on the electrical length.

Regarding the above-described variable resonator 100*a* and variable resonator 100*b*, description will be made for a mechanism for changing bandwidth and a mechanism for changing resonance frequency by referring to FIG. 3 to FIG. 6. Since frequency characteristics of the variable resonator 100*a* and the variable resonator 100*b* are shown as circuit simulation results in FIG. 5 to FIG. 6, each drawing shows the variable resonator 100*a* or the variable resonator 100*b*, which is connected as a branching circuit to a signal input/output line 7 being a transmission line shown by Port 1-Port 2. A line connecting the input/output line 7 with the variable resonator 100*a* or the variable resonator 100*b* expresses that the input/output line 7 and the line 902 are electrically connected in a circuit to be simulated.

First, the mechanism for changing bandwidth will be described.

Although the details are written in Japanese Patent Application No. 2006-244707, in the loop line body 101, that is, the variable resonator 900, the positions of transmission zeros that occur around a resonance frequency whose one wavelength or integral multiple thereof corresponds to the circumference of the line 902 can be moved by selecting a single switch 903 to be turned to a conduction state (hereinafter, also referred to an ON state). Herein, the transmission zero is a frequency where the transmission coefficient of the circuit where the input/output line 7 is connected to the loop line body 101 (Transmission Coefficient: unit is decibel [dB]) becomes minimum, that is, an insertion loss becomes maximum. Since a bandwidth is decided by the positions of the transmission zeros, the bandwidth of the loop line body 101 can be significantly changed in response to the selection of the switch 903 to be turned to the conduction state.

Further, by employing the loop line 902, the loop line body 101 has characteristics that the signal at the resonance frequency whose one wavelength or integral multiple thereof corresponds to the circumference of the circular line 902 is not influenced by the parasitic resistance and the parasitic reactance of the switches 903. For this reason, in the case where a bandpass filter is formed by using the variable resonator 900 provided with the switches 903 having parasitic resistance, for example, the insertion loss of the bandpass filter is not influenced by the resistance of the switch 903 at a resonance frequency being a passband, so that the insertion loss can be made smaller.

Next, description will be made for the mechanism for changing the resonance frequency. In more details, description will be made for a mechanism for changing the resonance frequency to a frequency other than a resonance frequency set by the circumference L of the variable resonator 900 that constitutes the loop line body 101.

Figure 48:
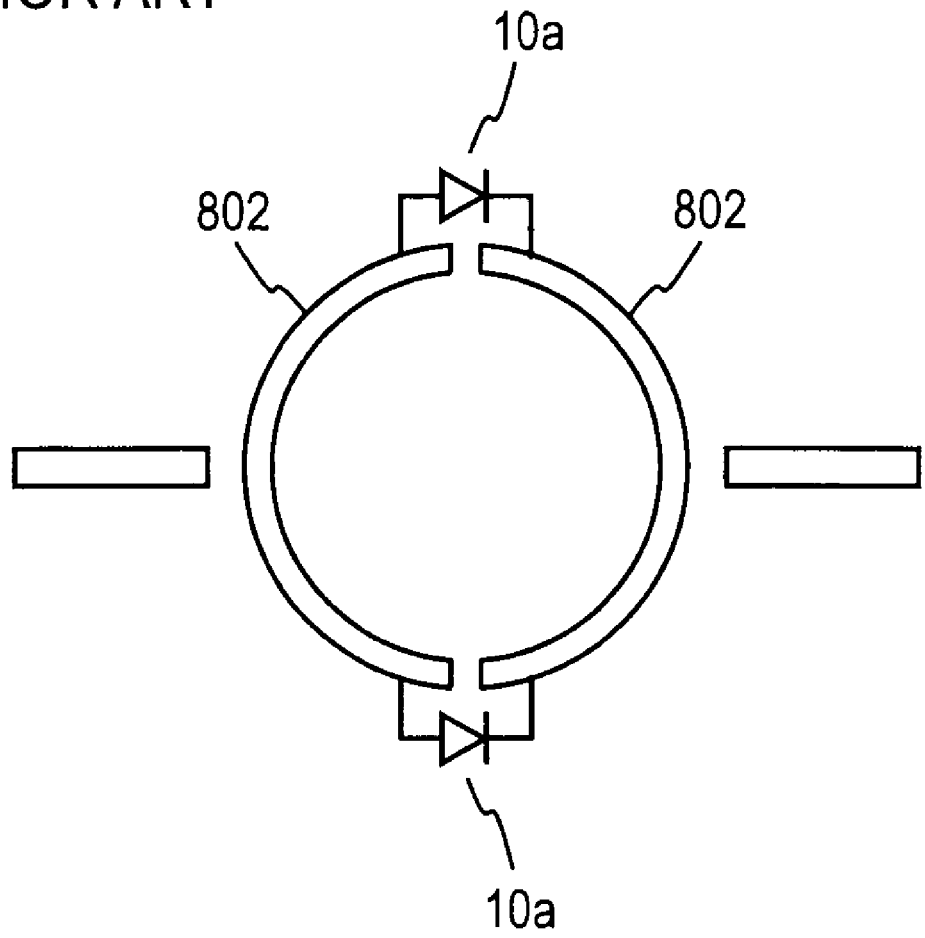
FIG.48 PRIOR ART
FIG. 48 is a view for explaining a conventional example.

According to the above-described Non-Patent literature 1, by making a resonator having the constitution that a circular line 802 is cut at two positions symmetrical with respect to the center of the line and variable capacitors 10 being as the variable reactance blocks are inserted each in cut area (refer to FIG. 48), the resonance frequency of the resonator can be changed in response to the capacitance of each variable capacitor 10. Therefore, by applying the technology to the variable resonator 900 capable of significantly changing bandwidth, it seems to be possible to realize a variable resonator capable of freely changing resonant frequency independently of the change of bandwidth while capable of significantly changing bandwidth. However, even if the technology is applied to the variable resonator 900 capable of significantly changing bandwidth, it is impossible to realize the variable resonator capable of freely changing resonant frequency independently of the change of bandwidth while capable of significantly changing bandwidth. This will be described by using a variable resonator 850 where the technology is applied to the variable resonator 900 capable of significantly changing bandwidth (refer to FIG. 3). The circuit shown in FIG. 3 is the variable resonator 850 that is connected as a branching circuit to the input/output line 7 being the transmission line shown by Port 1-Port 2.

Figure 3:
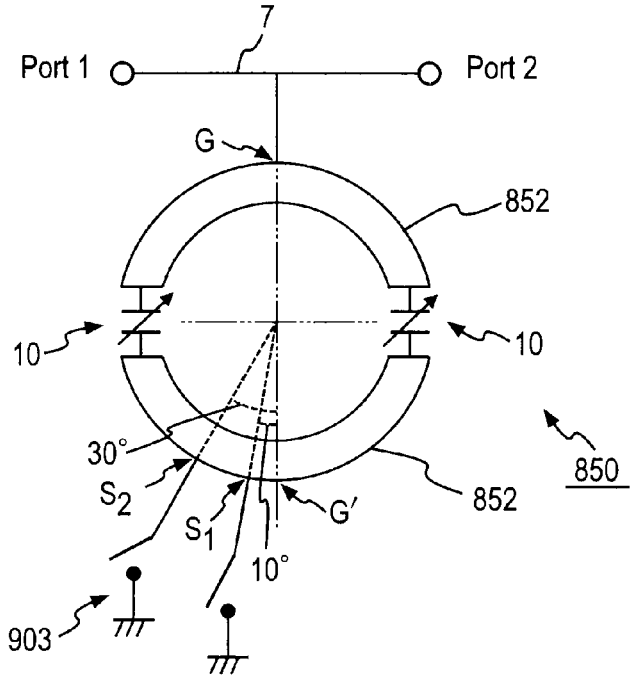
FIG.3 PRIOR ART
FIG. 3 is a variable resonator when the number of the variable reactance blocks 102 is set to 2 (conventional example)
Figure 4:
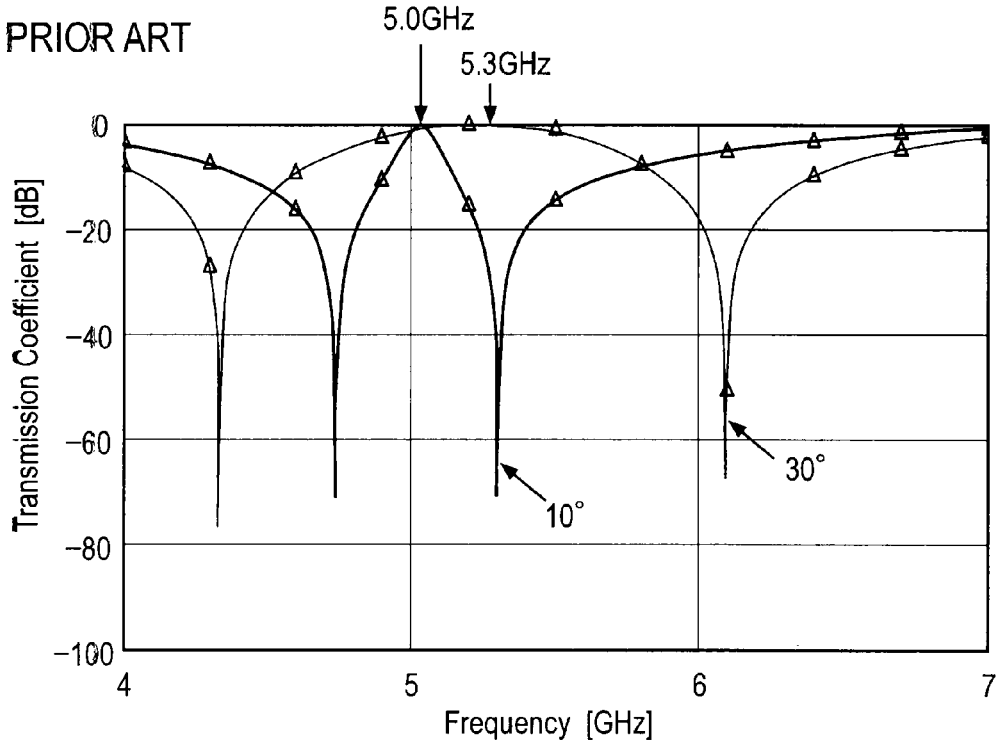
FIG.4 PRIOR ART
FIG. 4 is a graph showing the frequency characteristics of the variable resonator (conventional example) shown in FIG. 3.

FIG. 4 shows the frequency characteristics of a signal transmitting from Port 1 to Port 2 regarding the variable resonator 850 shown in FIG. 3 in the case where the total line length L of two lines 852 arranged in a circular shape is set to one wavelength at 5 GHz and both capacitances of the two variable capacitors 10 inserted in two connection positions of the lines 852 in series are set to 1 pF. Resistances of conductors constituting the lines 852, conductors forming via holes 906, and a ground conductor 904 are set to 0. Further, the port impedance of the input/output line 7 is set to 50Ω. Note that the switches 903 are omitted for convenience, and selecting of the switch 903 to be conducted is simulated by changing the position of the via hole 906 for grounding instead.

A thick line indicated by the sign of 10 degrees in FIG. 4 shows frequency characteristics in the case where a position $S_1$ at 10 degrees of center angle measured clockwise from a position G' symmetrical with respect to the center O of the two lines 852 arranged in a circular shape to a connection position G where the variable resonator 850 is connected to the input/output line 7 (the position $S_1$: a position of 17/36 of the circumference of the lines 852 counter-clockwise from the connection position G) is grounded via the via hole 906 as shown in FIG. 3. Similarly, a narrow line indicated by the sign of 30 degrees in FIG. 4 shows frequency characteristics in the case where a position $S_2$ at 30 degrees of center angle measured clockwise from the position G' (the position $S_2$: a position of 5/12 of the circumference of the lines 852 counter-clockwise from the connection position G) is grounded via the via hole 906 as shown in FIG. 3.

When the position of the switch 903 in the conduction state is changed from 10 degrees to 30 degrees in order to change only the bandwidth without changing the resonance frequency in a state where the switch 903 in the conduction state is placed at the 10-degree position to obtain a center frequency 5.0 GHz and a certain bandwidth with every capacitance of the inserted two variable capacitors 10 set to a certain value (1 pF in this example), FIG. 4 shows that the resonance frequency changes to 5.3 GHz on a higher frequency side simultaneously with a significant change of the bandwidth. In other words, it is impossible for the constitution of the variable resonator 850 to independently control the resonance frequency and the bandwidth respectively by the variable capacitors 10 and the switches 903. The same applies to the case where one ends of the variable capacitors 10 are connected to the circular line which is formed by the two lines 852 integrally and the other ends of the variable capacitors 10 are grounded.

The inventors got a conception from the foregoing that three or more variable reactance blocks 102 were required in order to realize a variable resonator capable of freely changing resonant frequency independently of the change of bandwidth while capable of significantly changing bandwidth. Then, description will be made for the fact that three or more variable reactance blocks 102 are required by showing the frequency characteristics of the circuit simulations of the variable resonator 100*a* and the variable resonator 100*b* in the case where various numbers of the variable reactance blocks 102 are electrically connected to the line 902.

FIG. 5A to FIG. 5F show the circuit constitutions and the frequency characteristics of the circuit constitution when 36 pieces (FIG. 5A), 10 pieces (FIG. 5B), 4 pieces (FIG. 5C), 3 pieces (FIG. 5D), 2 pieces (FIG. 5E) and 1 piece (FIG. 5F) of variable capacitors are used as the variable reactance blocks 102 in the constitution of the variable resonator 100*a*.

The arrangement and capacitance C of the variable capacitors in circuit simulations are as shown in FIG. 5A to FIG. 5F. The switches 903 were omitted for convenience and selecting of the switch 903 to be conducted was simulated by changing the position of the via hole 906 for grounding instead. The position of the via hole 906 was a position at x degree of center angle measured clockwise from the position G' symmetrical with respect to the center O of the line 902 to the connection position G where the variable resonator 100*a* was connected to the input/output line 7 similarly to the case shown in FIG. 3. The circumference of the loop line 902 was set to one wavelength at 5 GHz. To simulate the frequency characteristics of the variable resonator, the variable resonator was connected to the input/output line 7 as a branching circuit, and port impedance, the characteristic impedance of the input/output line 7, and the characteristic impedance of the loop line 902 were all set to 50 Ω.

Each frequency characteristics shown by the circuit simulations is the transmission coefficient of a signal when the signal inputted from Port 1 is transmitted to Port 2, and it is expressed in a dB unit. Here, the resonance frequency is defined as a frequency when the impedance of the variable resonator takes infinity, and it is a frequency when the insertion loss takes a minimum in the frequency characteristics shown in FIG. 5A to FIG. 5F. There are some cases where a plurality of frequencies at which the insertion loss takes a minimum appears in the frequency characteristics shown in FIG. 5A to FIG. 5F, and the resonance frequency at these cases is defined as follows.

"When the capacitance of each variable capacitor 10 is 0 pF, in other words, when the variable capacitors 10 are not connected, the length of the loop line 902 is set such that the frequency at which insertion loss takes a minimum becomes 5.0 GHz. When the capacitance of each variable capacitor 10 is continuously changed from 0 pF, the frequency at which the insertion loss takes a minimum continuously changes from 5 GHz to a lower frequency side in response to the change of the capacitance. A frequency at which the continuously changed insertion loss takes a minimum is the resonance frequency discussed here".

Figure 5A:
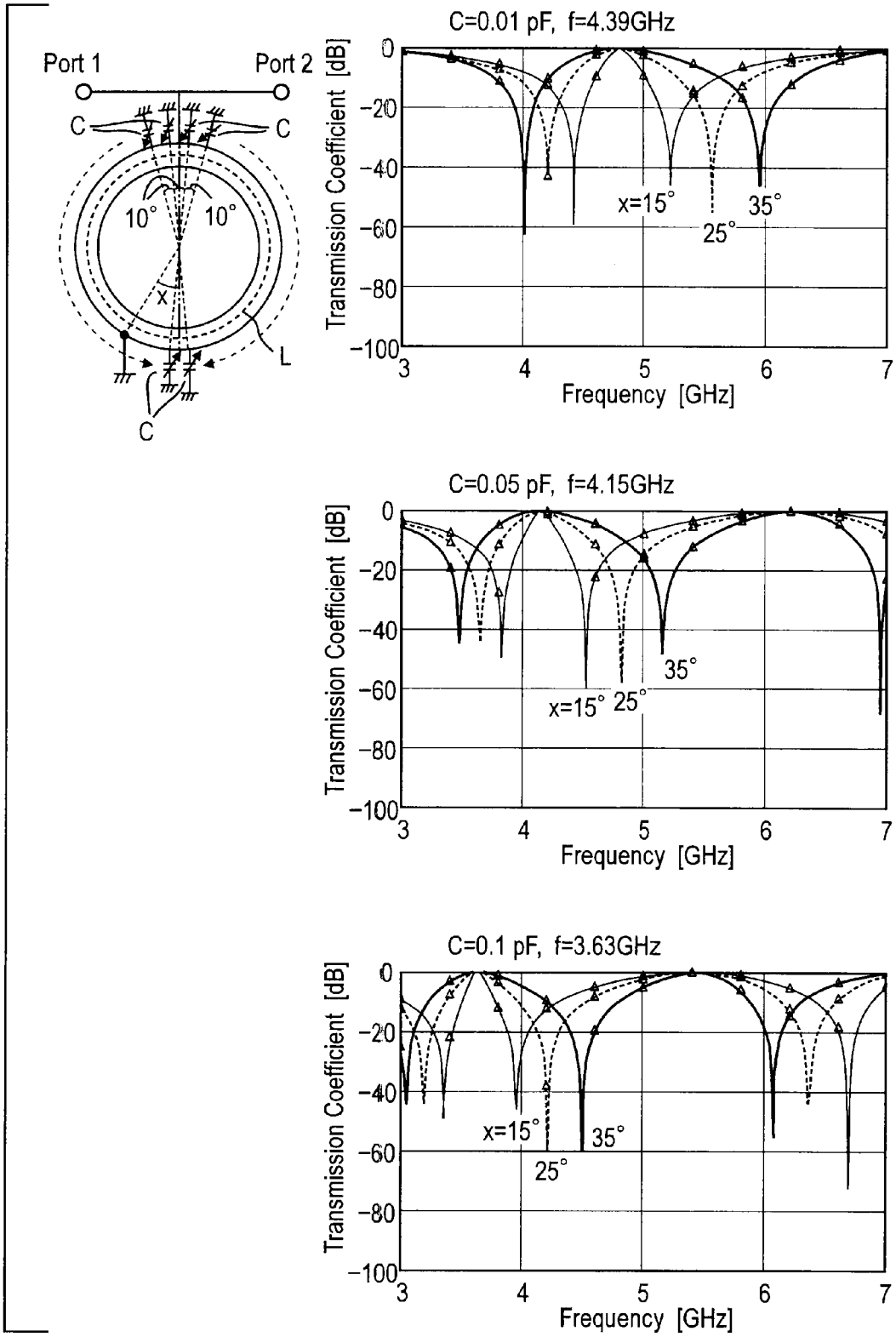
FIG. 5A is a plan view of the variable resonator 100*a* when the number of the variable reactance blocks 102 being variable capacitors is set to 36 and a set of graphs showing the frequency characteristics of the variable resonator 100*a* when every capacitance of the variable capacitors is changed.
Figure 5B:
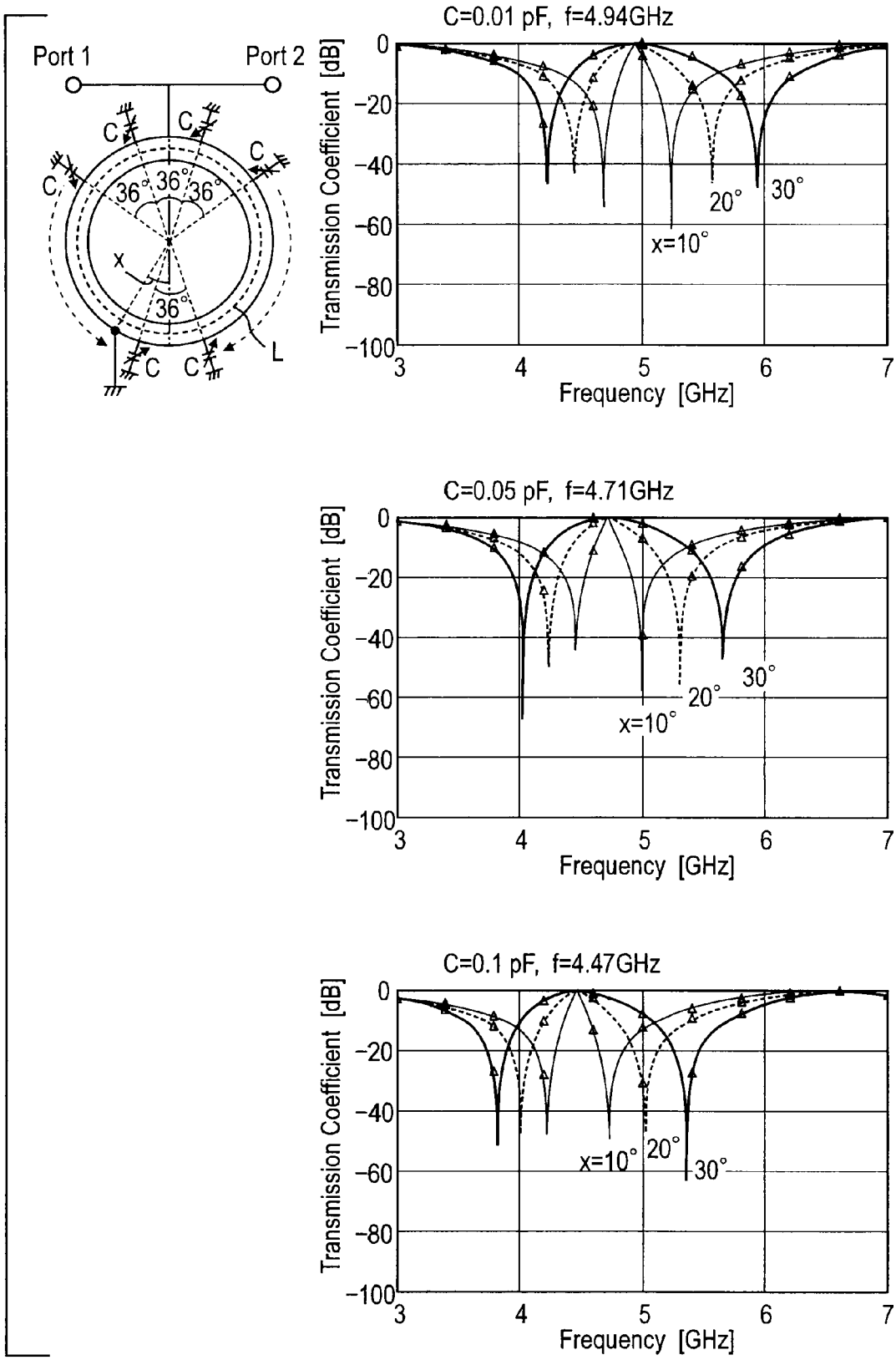
FIG. 5B is a plan view of the variable resonator 100*a* when the number of the variable reactance blocks 102 being variable capacitors is set to 10 and a set of graphs showing the frequency characteristics of the variable resonator 100*a* when every capacitance of the variable capacitors is changed.
Figure 5C:
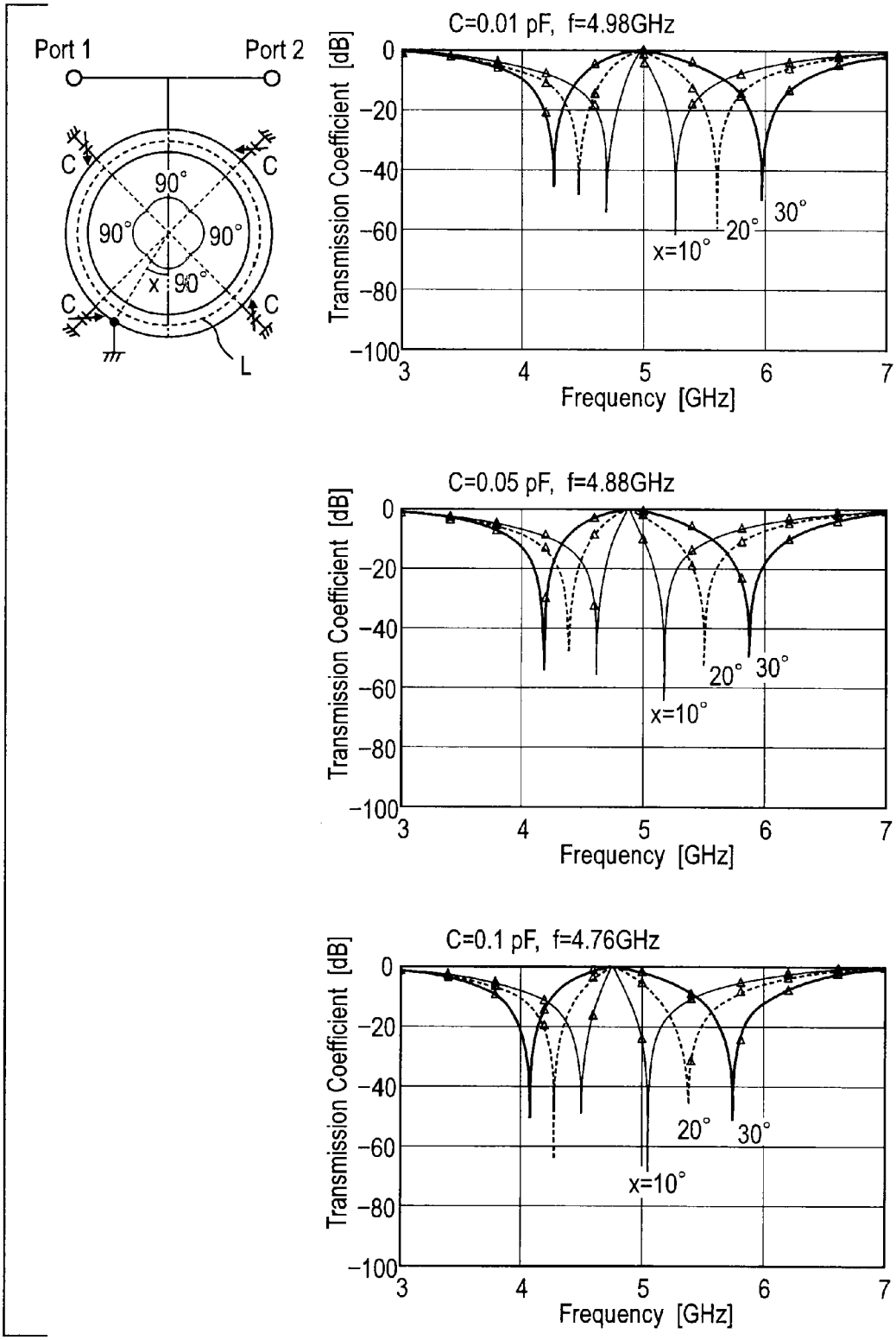
FIG. 5C is a plan view of the variable resonator 100*a* when the number of the variable reactance blocks 102 being variable capacitors is set to 4 and a set of graphs showing the frequency characteristics of the variable resonator 100*a* when every capacitance of the variable capacitors is changed.
Figure 5D:
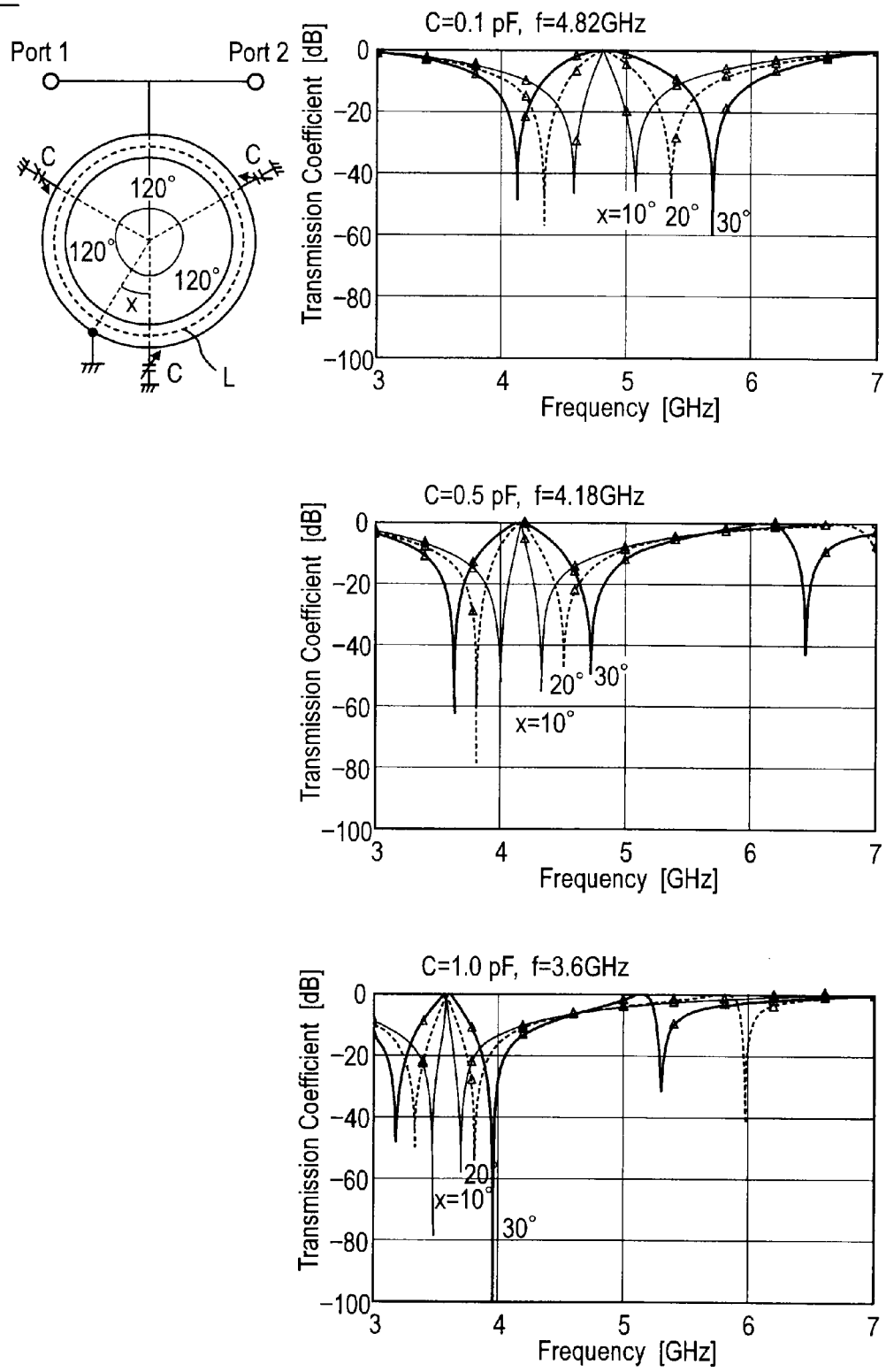
FIG. 5D is a plan view of the variable resonator 100*a* when the number of the variable reactance blocks 102 being variable capacitors is set to 3 and a set of graphs showing the frequency characteristics of the variable resonator 100*a* when every capacitance of the variable capacitors is changed.
Figure 5E:
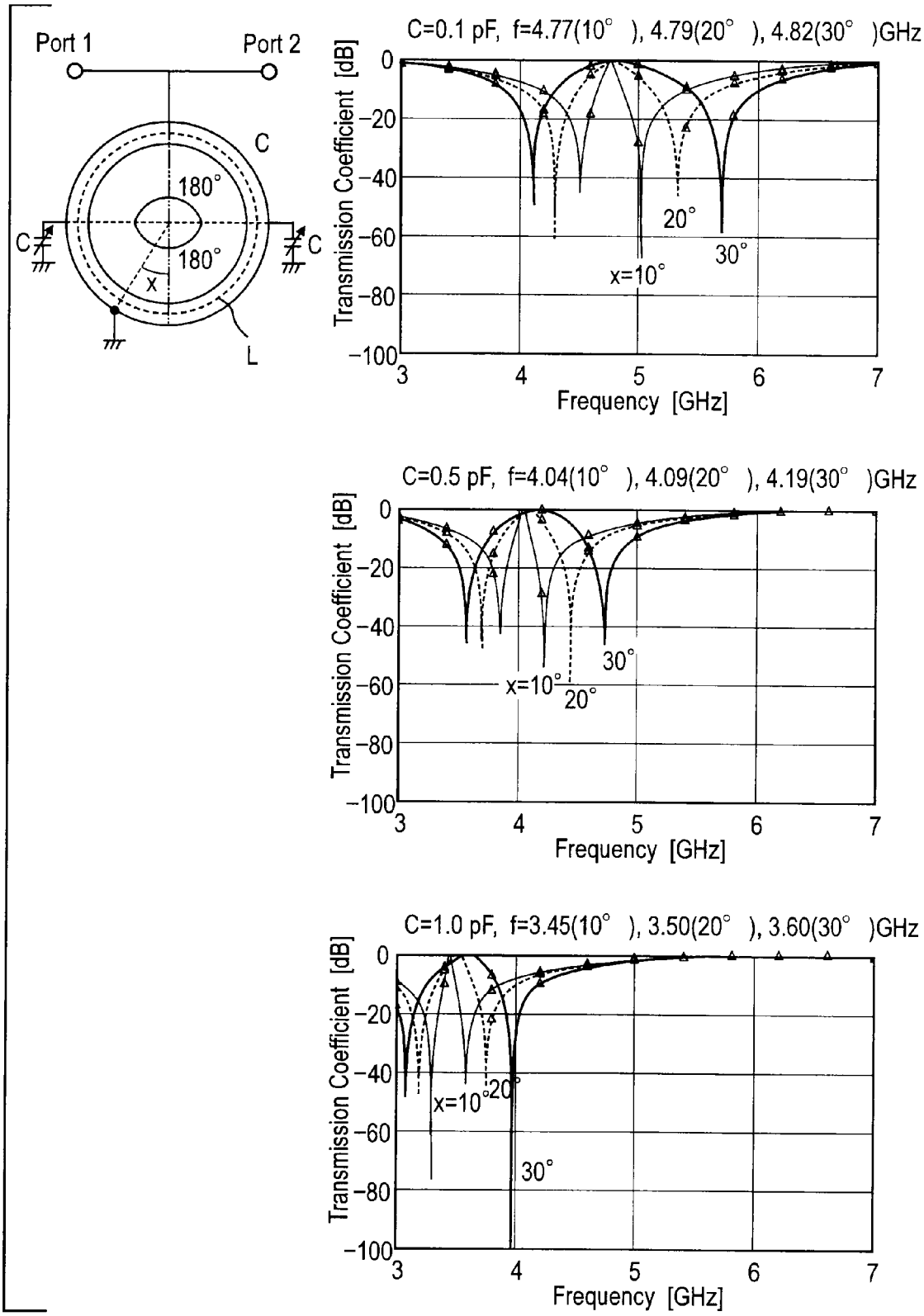
FIG. 5E is a plan view of the variable resonator 100*a* when the number of the variable reactance blocks 102 being variable capacitors is set to 2 and a set of graphs showing the frequency characteristics of the variable resonator 100*a* when every capacitance of the variable capacitors is changed.
Figure 5F:
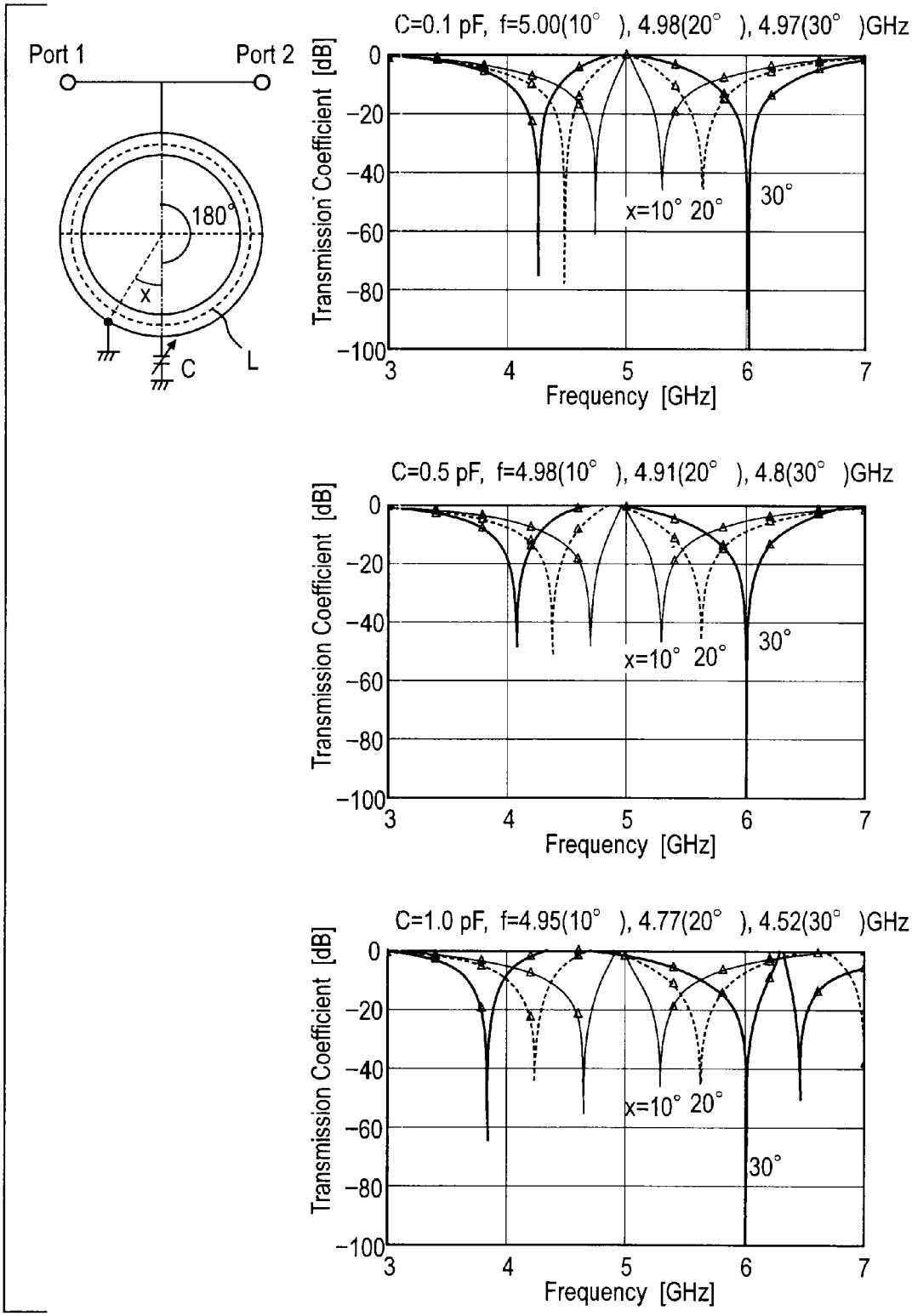
FIG. 5F is a plan view of the variable resonator 100*a* when the number of the variable reactance blocks 102 being variable capacitors is set to 1 and a set of graphs showing the frequency characteristics of the variable resonator 100*a* when every capacitance of the variable capacitors is changed.

FIG. 5A to FIG. 5F show that the resonance frequency was changed to the lower frequency side in all variable resonators 100*a* when the capacitance of the variable capacitors 10 was increased. FIG. 5A to FIG. 5D show that the resonance frequency did not change but transmission zeros (where the transmission coefficients are minimum) around the frequency changed when the position of the via hole 906 (grounding position) was changed while the capacitance of each variable capacitor 10 was fixed to an arbitrary value, in a variable resonator provided with 3 or more variable capacitors 10 being as the variable reactance blocks. In other words, the resonance frequency is not influenced by the position of the switch 903 turned to be the conduction state in these cases. On the other hand, FIG. 5E and FIG. 5F show that the resonance frequency changed in response to the movement of the position of the via hole 906 (grounding position) in the variable resonator 100*a* provided with only one or two variable capacitors 10 being as the variable reactance blocks. In other words, the resonance frequency is influenced by the position of the switch 903 turned to be the conduction state in these cases. The above description indicates that the resonance frequency is influenced by the position of the switch 903 turned to be the conduction state unless the resonator is provided with three or more variable capacitors 10, that is, the variable reactance blocks.

Figure 6A:
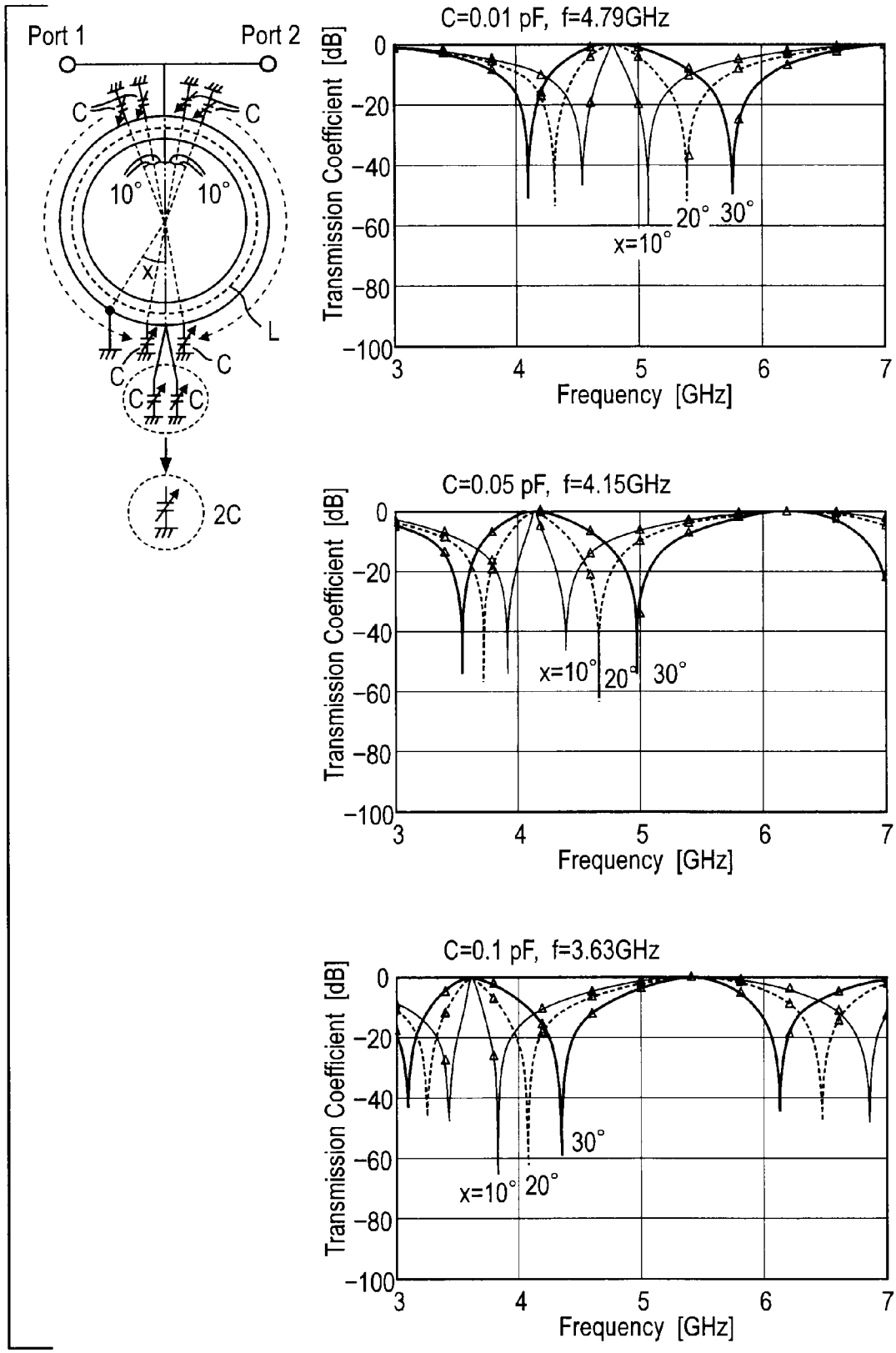
FIG. 6A is a plan view of a variable resonator 100*b* when the number of the variable reactance blocks 102 being variable capacitors is set to 36 and a set of graphs showing the frequency characteristics of the variable resonator 100*b* when every capacitance of the variable capacitors is changed.
Figure 6B:
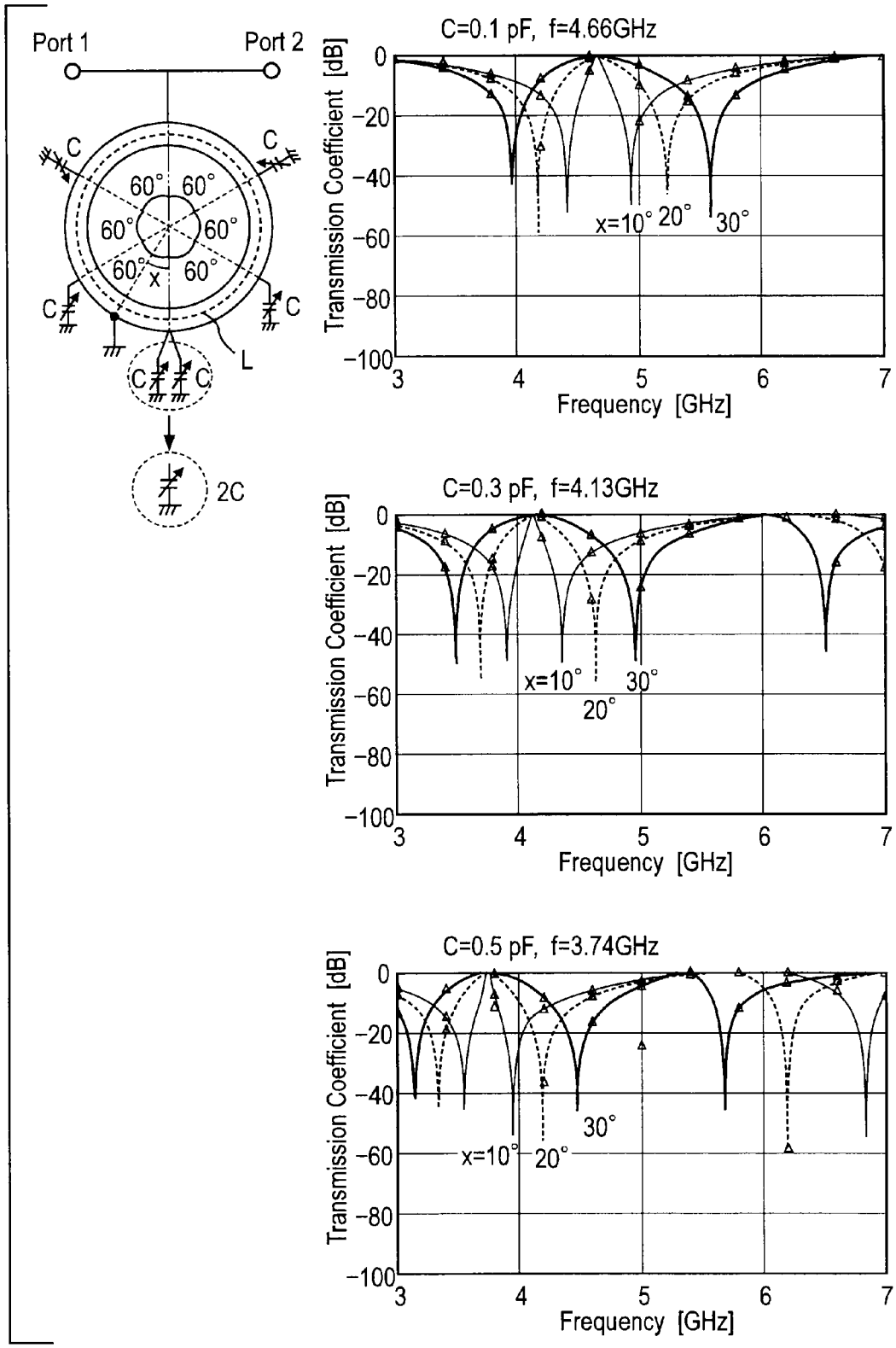
FIG. 6B is a plan view of the variable resonator 100*b* when the number of the variable reactance blocks 102 being variable capacitors is set to 6 and a set of graphs showing the frequency characteristics of the variable resonator 100*b* when every capacitance of the variable capacitors is changed.
Figure 6C:
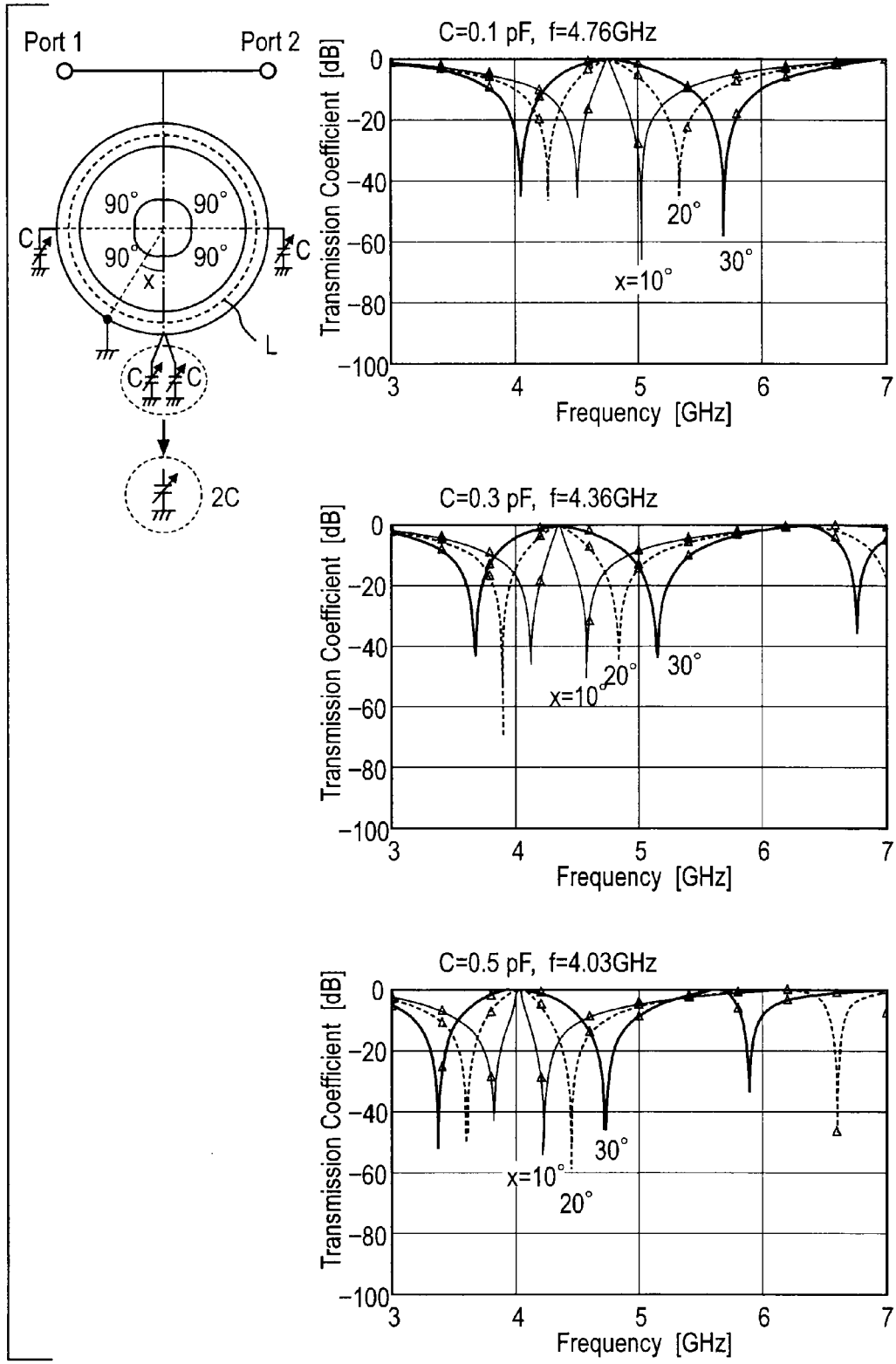
FIG. 6C is a plan view of the variable resonator 100*b* when the number of the variable reactance blocks 102 being variable capacitors is set to 4 and a set of graphs showing the frequency characteristics of the variable resonator 100*b* when every capacitance of the variable capacitors is changed.

FIG. 6A to FIG. 6C show the circuit constitution and the frequency characteristics of the circuit constitutions when 36 pieces (FIG. 6A), 6 pieces (FIG. 6B) and 4 pieces (FIG. 6C) of variable capacitors are used as the variable reactance blocks 102 in the constitution of the variable resonator 100*b*.

Accompanying circuits such as the input/output port and the input/output line are similar to the circuits shown in FIG. 5A to FIG. 5F, and the frequency characteristics is also the transmission coefficient of a signal transmitting from Port 1 to Port 2 similar to the cases of FIG. 5A to FIG. 5F. In each circuit constitution, two variable capacitors 10 surrounded by a dotted line a may be replaced with a single variable capacitor capable of being set to the capacitance twice that of each of the other variable capacitors. In this case, the number of the variable capacitors 10 is 35 pieces, 5 pieces and 3 pieces respectively in FIG. 6A to FIG. 6C.

As it is clear from FIG. 6A to FIG. 6C, in the case of four or more variable capacitors 10 or the case of three or more capacitors and one piece out of them is set to the capacitance twice that of each of the other variable capacitors 10, the resonance frequency is not influenced by the position of the switch 903 turned to be the conduction state. The case where the number of the variable capacitors 10 is 2 or 1 is similar to the cases shown in FIG. 5E and FIG. 5F, and in these cases, the resonance frequency is influenced by the position of the switch 903 turned to be the conduction state as described above.

The above description gives the findings that at least three variable reactance blocks 102 are necessary in order to prevent the resonance frequency from being influenced by selecting the switch 903 turned to be the conduction state in the variable resonator 100*a* and the variable resonator 100*b*. In the above description, the characteristic impedance of the loop line 902 of the variable resonator 100*a* or the variable resonator 100*b* was set to 50Ω same as that of the input/output line and the input/output port, it is not particularly limited to this, but is a design parameter decided corresponding to the performance/characteristics required.

Although the variable capacitor is used on behalf of the variable reactance block 102 in the above description, a similar effect is obtained when a circuit element such as a variable inductor and a transmission line, a circuit where a plurality of the same type items out of them are combined, a circuit where a plurality of different type items out of them are combined or the like is used instead of the variable capacitor.

Figure 7:
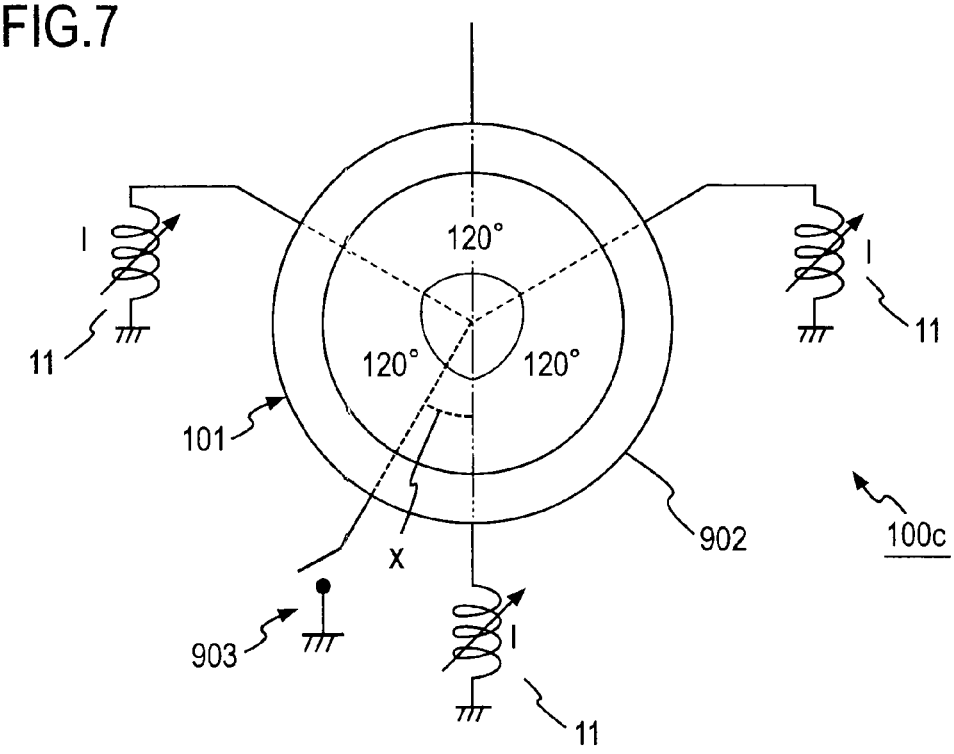
FIG. 7 is a plan view of a variable resonator 100*c* when the variable reactance blocks 102 are variable inductors 11.
Figure 8:
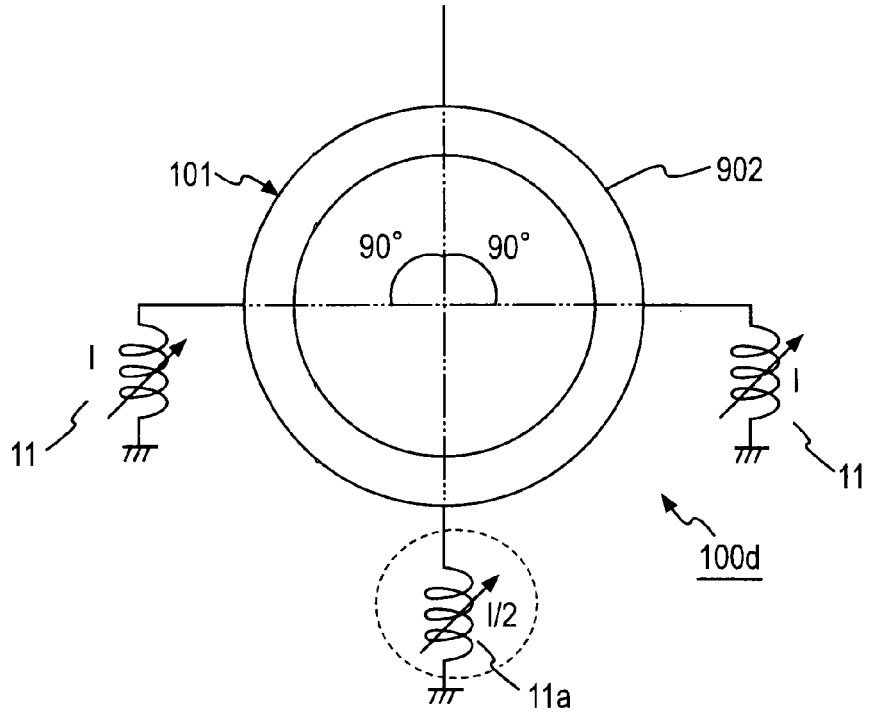
FIG. 8 is a plan view of a variable resonator 100*d* when the variable reactance blocks 102 are variable inductors 11 (switches 903 are not shown)
Figure 9:
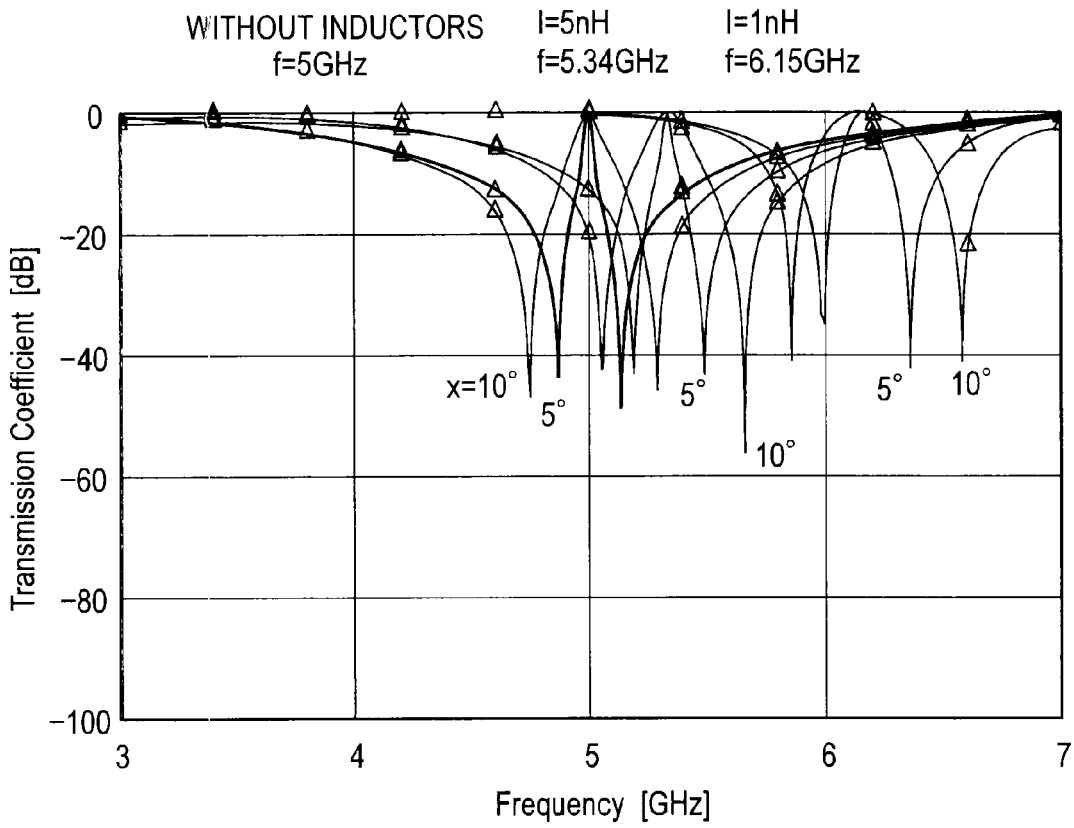
FIG. 9 is a graph showing the frequency characteristics of the variable resonator 100*c* shown in FIG. 7.

FIG. 7 shows a variable resonator 100*c* in the case of having a structure of the same type as the variable resonator 100*a* and using variable inductors 11 as the variable reactance blocks 102. FIG. 8 shows a variable resonator 100*d* in the case of having a structure of the same type as the variable resonator 100*b* and using the variable inductors 11 as the variable reactance blocks 102. In each drawing, the switches 903 or the like are not shown for simple illustration. A variable inductor 11*a* surrounded by a dotted line in FIG. 8 is a variable inductor that two variable inductors 11 are replaced with similar to the dotted line β shown in FIG. 2, and its inductance is set to half the value of each of the other variable inductors 11. Comparing to the case of using the variable capacitors 10, the resonance frequency shifts to a higher frequency side when the variable inductors are used. For example, FIG. 9 shows the frequency characteristics of the variable resonator 100*c* shown in FIG. 7, where the resonance frequency moves to the higher frequency side by 0.34 GHz by setting the inductances of the variable inductors to 5 nH, and the resonance frequency moves to the higher frequency side by 1.15 GHz by setting the inductances of the variable inductors to 1 nH.

Figure 10A:
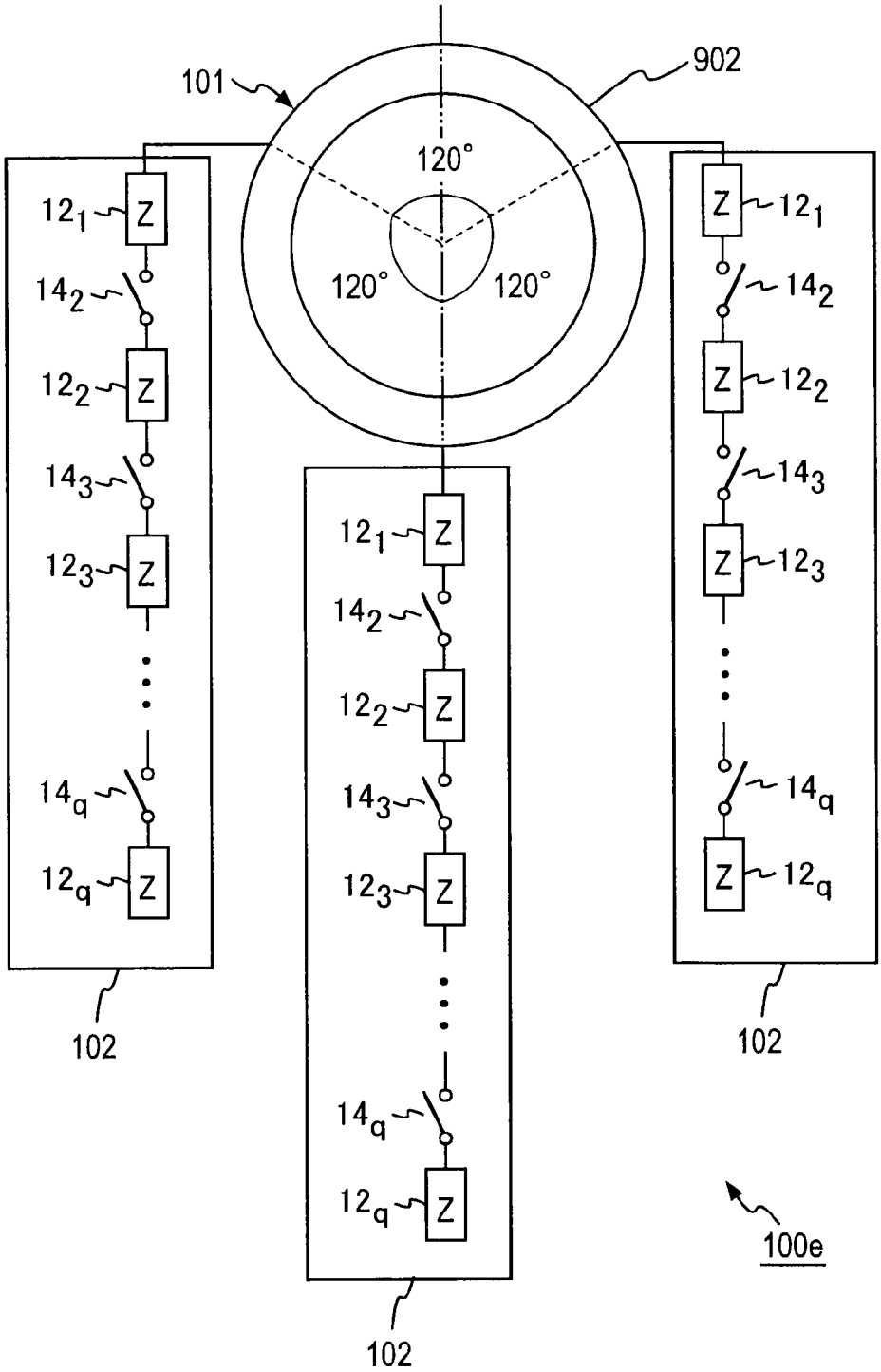
FIG. 10A is a plan view of a variable resonator 100*e* when each variable reactance block 102 has the constitution that transmission lines 12 are arranged in series (switches 903 are not shown)

FIG. 10A shows a variable resonator 100*e* in the case of having a structure of the same type as the variable resonator 100*a* and using q transmission lines (q is an integer of 2 or larger) as the variable reactance block 102. In the drawing, the switches 903 or the like are not shown for simple illustration.

In the variable resonator 100*e*, each variable reactance block 102 has the constitution that q transmission lines 12 having a characteristic impedance Z can be connected in series. In the implemented constitution, q transmission lines $\mathbf{12}_1$ to $\mathbf{12}_q$ and q−1 switches $\mathbf{14}_2$-$\mathbf{14}_q$ are alternately arranged in series. In short, one end of the transmission line $\mathbf{12}_1$ is connected to the line 902 and the other end of the transmission line $\mathbf{12}_1$ is connected to one end of the switch $\mathbf{14}_2$. One end of the transmission line $\mathbf{12}_q$ is connected to the switch $\mathbf{14}_q$, and the other end of the transmission line $\mathbf{12}_q$ should be open-circuited. However, leaving the other end of the transmission line $\mathbf{12}_q$ open-circuited is not an essential technical matter, but may be grounded, for example. One end of the transmission line $\mathbf{12}_X$ is connected to the switch $\mathbf{14}_x$, and the other end of the transmission line $\mathbf{12}_X$ is connected to the switch $\mathbf{14}_{x+1}$. Note that x=2, 3, . . . , q−1. In the implemented constitution, the variable reactance blocks may be designed such that the switches $\mathbf{14}_2$ to $\mathbf{14}_y$ are turned to the ON state and the switch $\mathbf{14}_{y+1}$ is turned to the OFF state in the case of a y-th bandwidth. Note that the switch $\mathbf{14}_2$ is turned to the OFF state in the case of y=1. Thus, q reactance values can be set because the transmission line length changes by switching the conduction state of the switches $\mathbf{14}_2$-$\mathbf{14}_q$, and *q* resonance frequencies can be realized as a result.

Figure 10B:
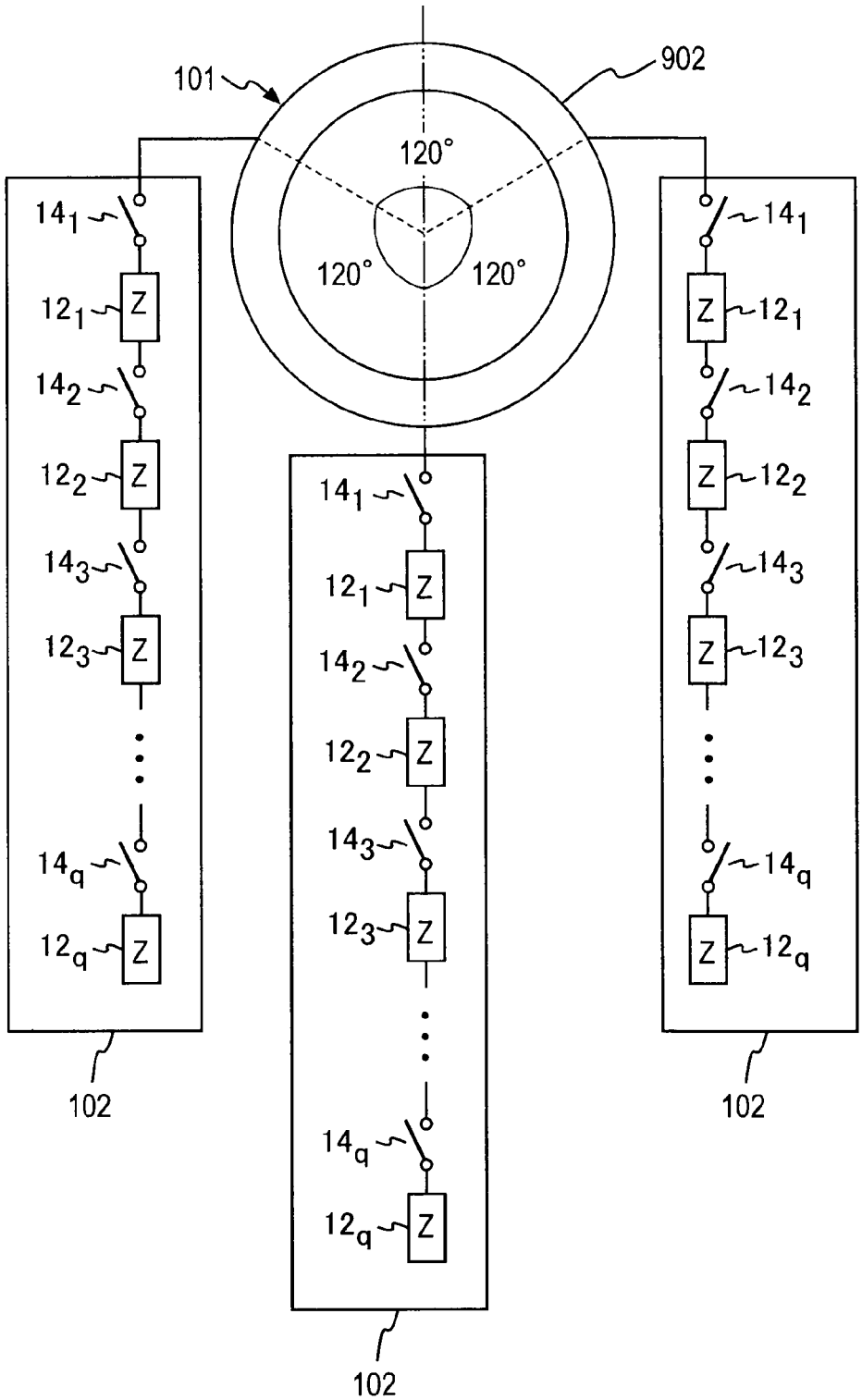
FIG. 10B is a plan view of the modified example of the variable resonator 100*e* shown in FIG. 10A (switches 903 are not shown)

Since the present invention includes the case where the susceptance values of the variable reactance blocks 102 becomes 0 or minimum, each variable reactance block may have the constitution that the line 902 and the transmission line $\mathbf{12}_1$ are connected by the switch $\mathbf{14}_1$ to enable the selection of conduction/non-conduction between both lines as shown in FIG. 10B. In this case, the constitution is acceptable that the number of transmission lines which constitute the variable reactance block 102 is 1, that is, q=1. In short, it is the variable reactance block 102 having alternatives of the susceptance value being zero or non-zero. When the impedance Z is expressed in Z=jX (j is an imaginary unit), a susceptance B is expressed in B=1/X by using a reactance X.

Figure 11A:
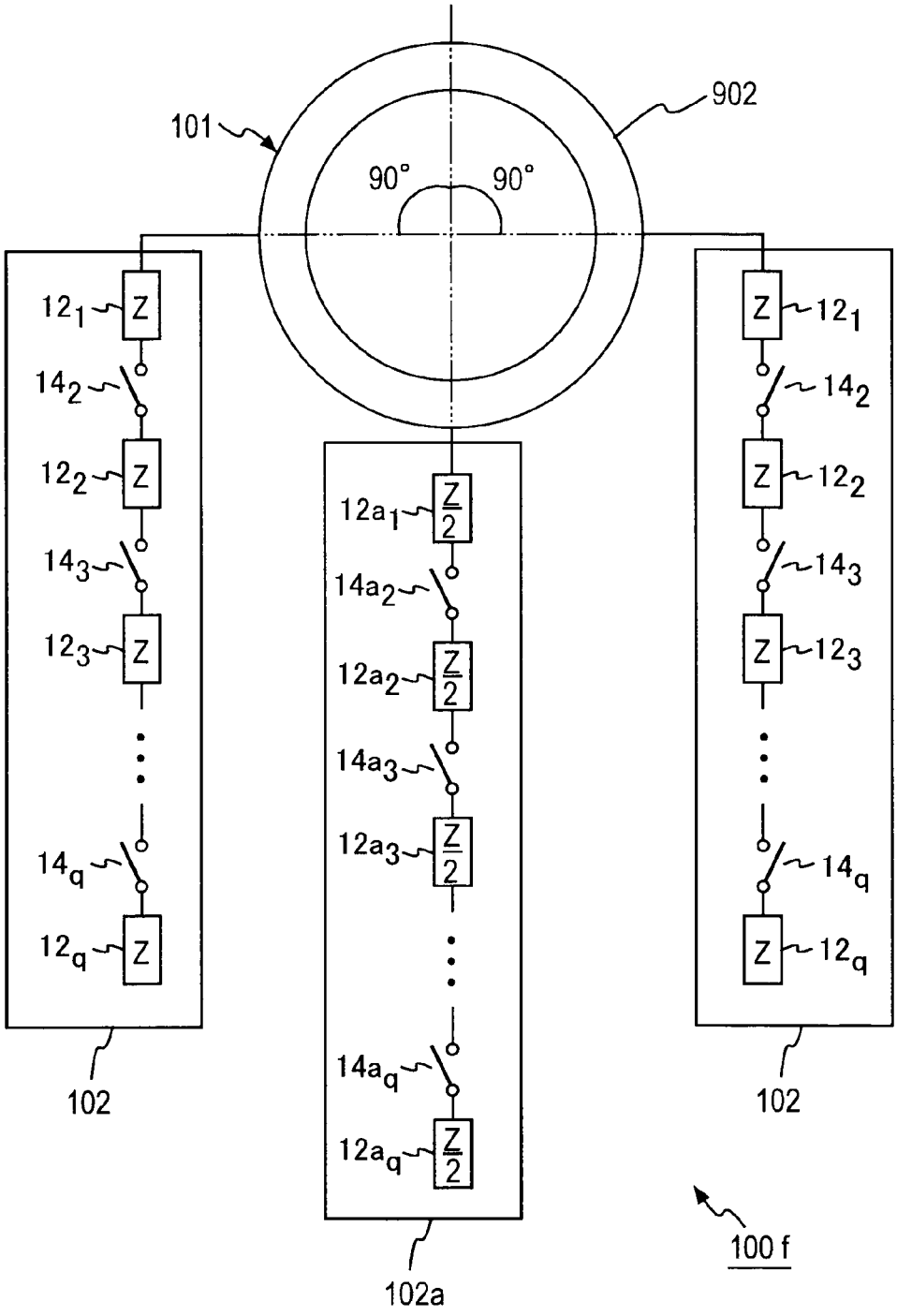
FIG. 11A is a plan view of a variable resonator 100*f* when each variable reactance block 102 has the constitution that the transmission lines 12 are arranged in series (switches 903 are not shown)

FIG. 11A shows a variable resonator 100*f* in the case of having a structure of the same type as the variable resonator 100*b* and using q transmission lines (q is an integer of 2 or larger) are used as the variable reactance block 102.

Since the constitution of the variable reactance block 102 is the same as that of the variable reactance block 102 in the variable resonator 100*e* shown in FIG. 10A, its description will be omitted. However, the constitution of the variable reactance block 102*a* in FIG. 11A is the same as the constitution of the variable reactance block 102, but the characteristic impedance of individual transmission line in the variable reactance block 102*a* is set to Z/2. Of course, two variable reactance blocks 102 may be connected to a position at which the variable reactance block 102*a* is connected to the line 902.

Figure 11B:
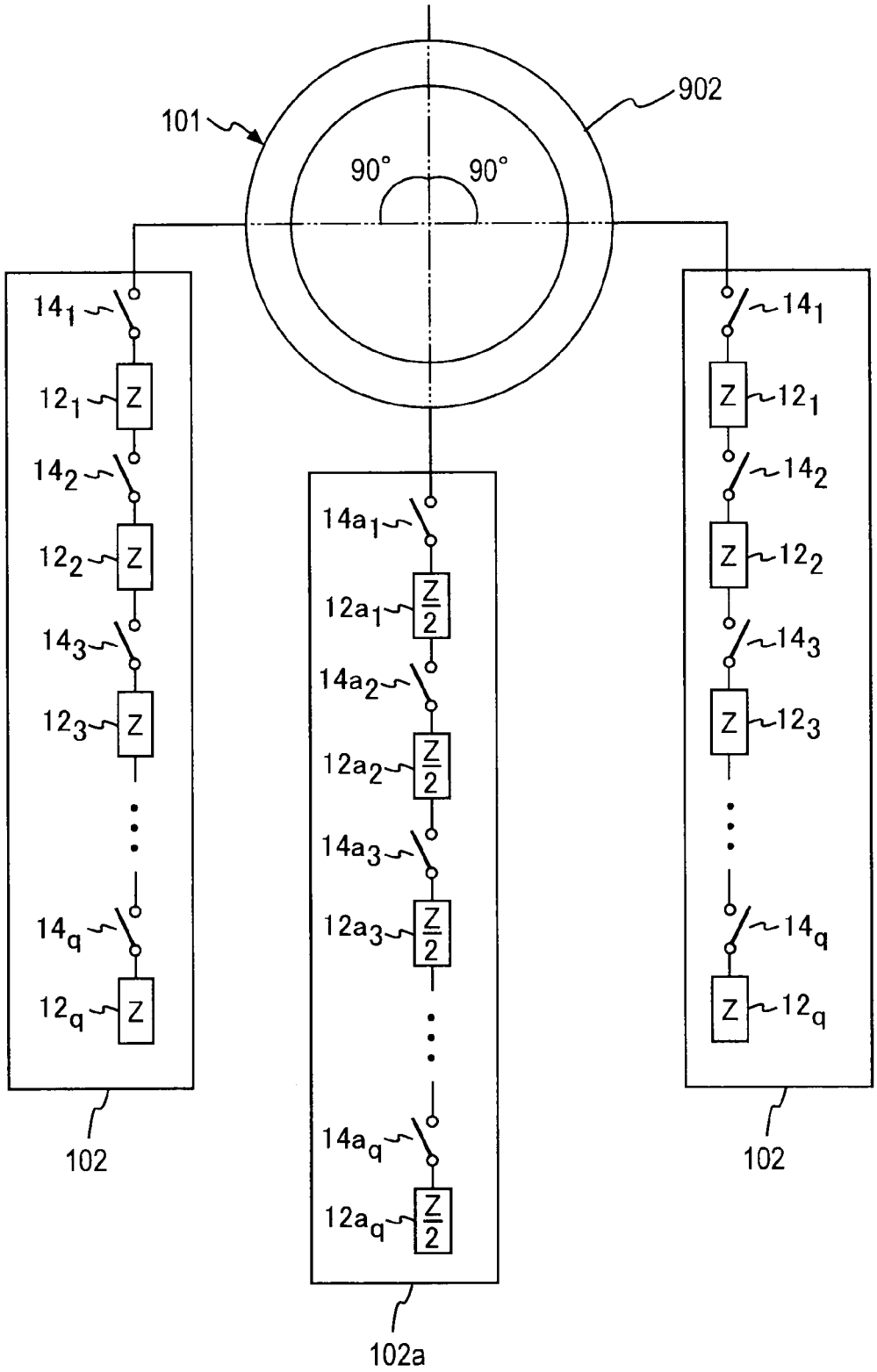
FIG. 11B is a plan view of the modified example of the variable resonator 100*f* (switches 903 are not shown)

As described above, since the present invention includes the case where the susceptance values of the variable reactance blocks 102 becomes 0 or minimum, the variable reactance block may have the constitution that the line 902 and the transmission line $\mathbf{12}_1$ are connected by the switch $\mathbf{14}_1$ to enable the selection of conduction/non-conduction between both lines as shown in FIG. 11B. This case is also similar to the variable resonator shown in FIG. 10B, the constitution is acceptable that the number of transmission lines which constitute the variable reactance block 102 is 1, that is, q=1. In short, it is the variable reactance block 102 having alternatives of the susceptance value being zero or non-zero.

Figure 12:
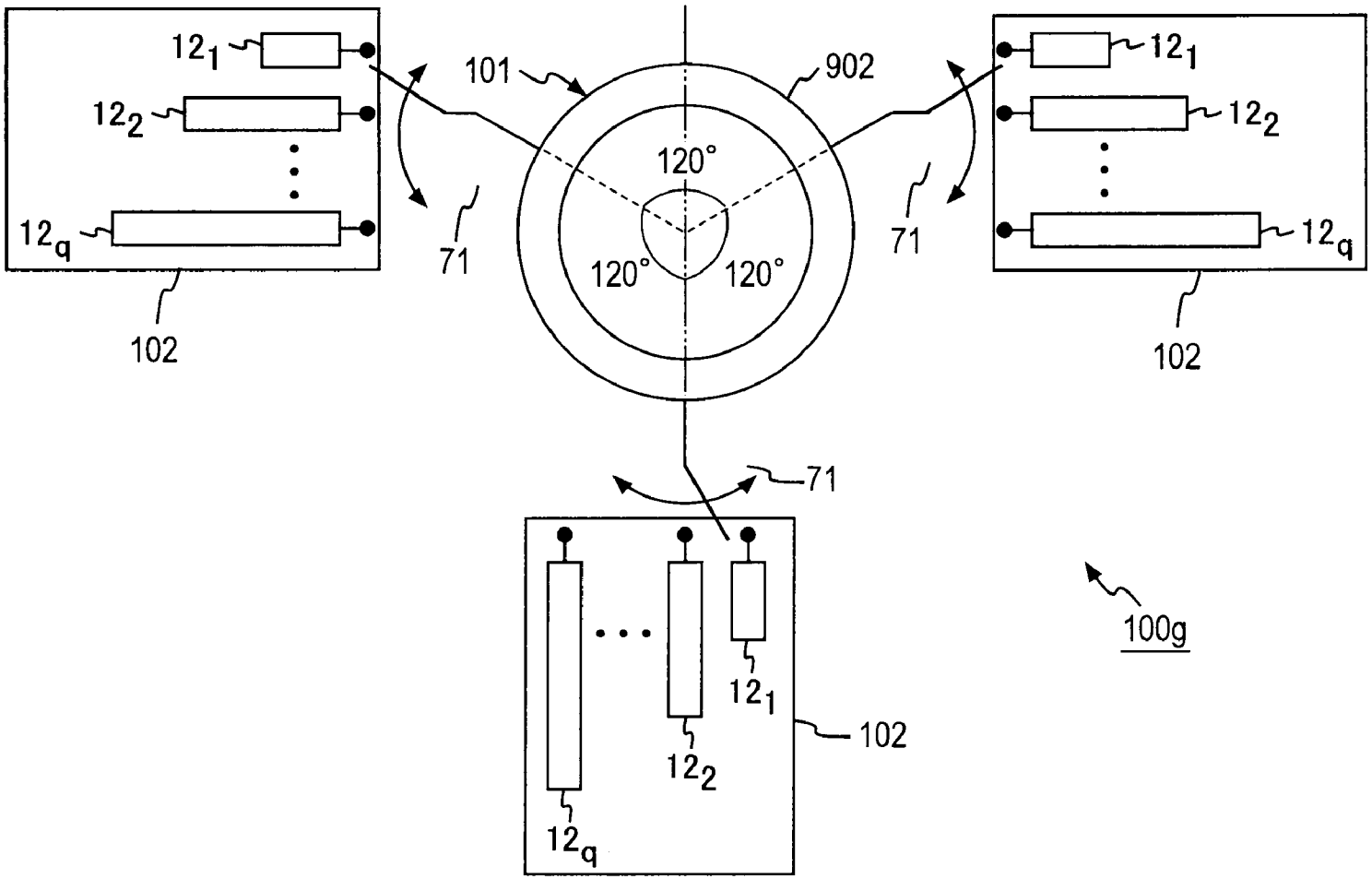
FIG. 12 is a plan view of a variable resonator 100*g* when each variable reactance block 102 has the constitution that the transmission lines 12 are arranged in parallel (switches 903 are not shown)

FIG. 12 shows a variable resonator 100*g* in the case of having a structure of the same type as the variable resonator 100*a* and using q transmission lines (q is an integer of 2 or larger) as the variable reactance block 102.

In the variable resonator 100*g*, each variable reactance block 102 has the constitution that q transmission lines 12 having the characteristic impedance Z are selectable. In the implemented constitution, q transmission lines $\mathbf{12}_1$ to $\mathbf{12}_q$ each having a different length are arranged laterally, one end on the single-pole side of a single-pole q-throw switch 71 being a changeover switch is connected to the line 902, and one transmission line out of q transmission lines $\mathbf{12}_1$ to $\mathbf{12}_q$ is selected by switching the other end on the q-throw side of the single-pole q-throw switch 71. An end portion on the opposite side of the end portion of the q transmission lines $\mathbf{12}_1$ to $\mathbf{12}_q$ which is connected to the single-pole q-throw switch 71 should be open-circuited. It is to be noted that leaving the other ends open-circuited is not an essential technical matter, but may be grounded, for example. Thus, q reactance values are obtained by switching a connecting destination of the other end on the q-throw side of the single-pole q-throw switch 71, and q resonance frequency can be realized as a result.

Herein, the variable resonator 100*g* is shown on the premise of the variable resonator 100*a*, and a similar constitution may be taken on the premise of the variable resonator 100*b*.

Figure 13:
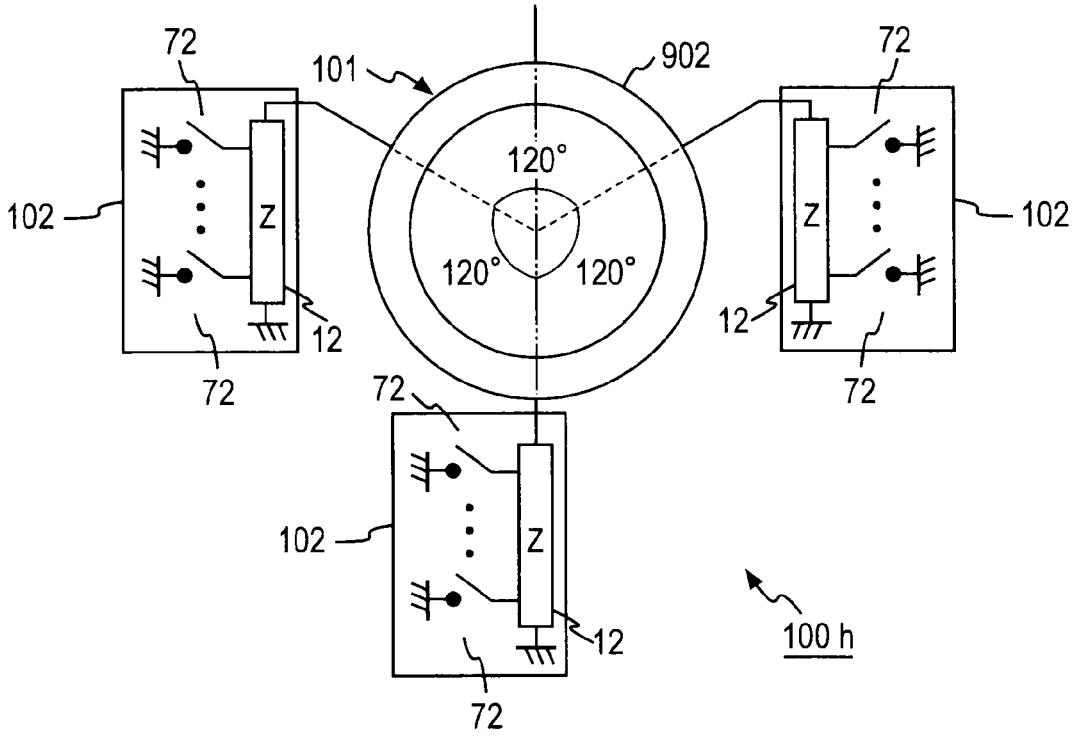
FIG. 13 is a plan view of a variable resonator 100*h* when each variable reactance block 102 has the constitution that the grounding position of the transmission line 12 is made variable (switches 903 are not shown)

FIG. 13 shows a variable resonator 100*h* in the case of having a structure of the same type as the variable resonator 100*a* and using one transmission line is used as the variable reactance block 102.

In the variable resonator 100*h*, each variable reactance block 102 is constituted of one transmission line 12 having the characteristic impedance Z and q−1 switches 72. In the implemented constitution, one end of the transmission line 12 is electrically connected to the line 902 and the other end of the line is grounded. The q−1 switches 72 are connected to the transmission line 12 except for the both end portions thereof along the transmission line 12 and end portions of the switches 72 on the opposite side of the end portion which is connected to the transmission line 12 are grounded. The electrical length of the transmission line 12 can be practically changed by turning any one switch 72 out of q−1 switches 72 to the ON state, and thus q−1 reactance values can be set. Furthermore, since one reactance value can be set by turning all of q−1 switches 72 to the OFF state, q reactance values can be set in total, and q resonance frequencies can be realized as a result.

Herein, the variable resonator 100*h* is shown on the premise of the variable resonator 100*a*, and a similar constitution may be taken on the premise of the variable resonator 100*b*.

Figure 14:
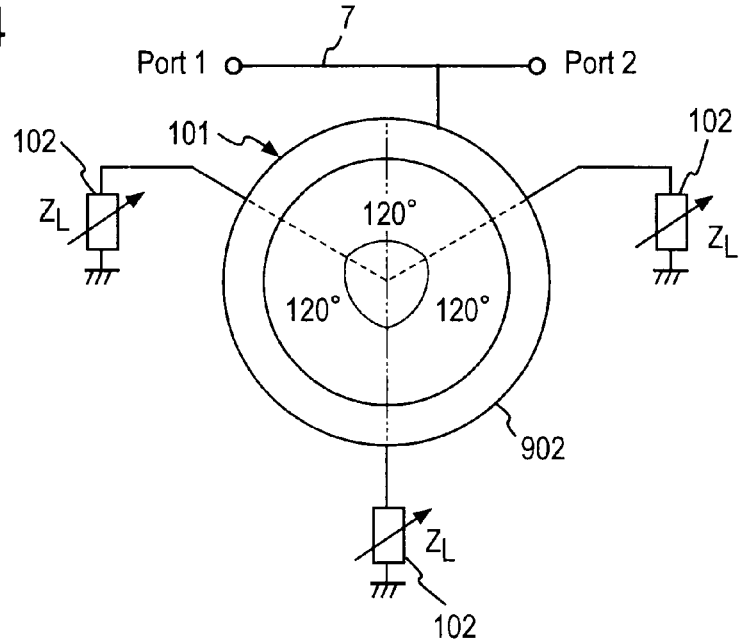
FIG. 14 is a plan view of a variable resonator in the constitution that the signal input position of the variable resonator 100*a* is different from that of the former examples (switches 903 are not shown)
Figure 15:
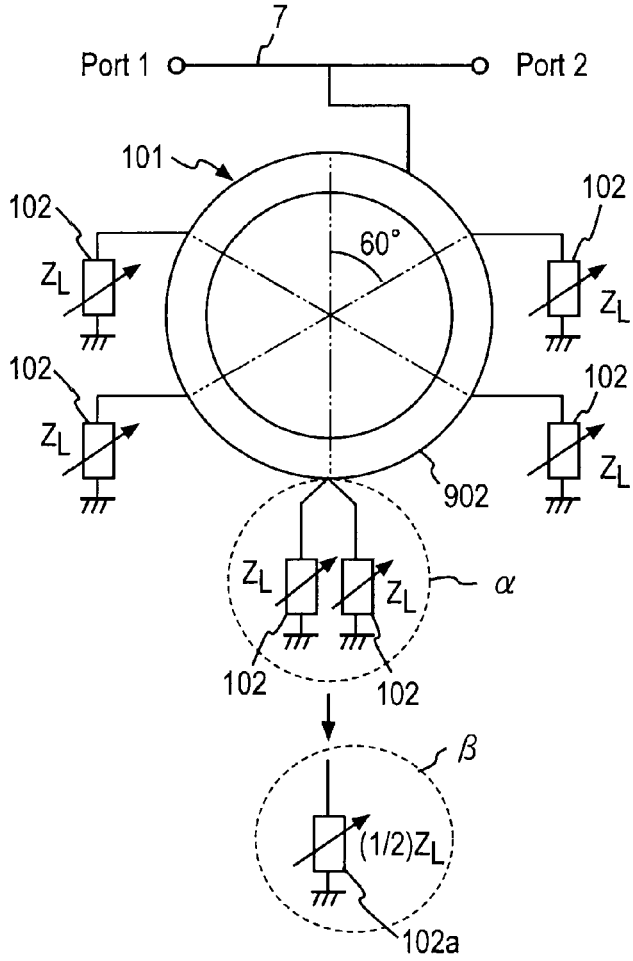
FIG. 15 is a plan view of a variable resonator in the constitution that the signal input position of the variable resonator 100*b* is different from that of the former examples (switches 903 are not shown)

In the above-described the variable resonator 100*a* and the same type structure thereof, a connected portion between the input/output line 7 and the variable resonator 100*a*, that is, a supply point of a signal is at the center of the two variable reactance blocks 102 sandwiching the supply point, but a position off from the center may be set as a supply point of a signal as shown in FIG. 14. For that matter, an arbitrary position on the loop line 902 may be set to the supply point. However, the positions of the switches 903 need to be set such that a desired bandwidth variation can be obtained as a design matter. Further, the same applies to the supply point of a signal regarding the above-described variable resonator 100*b* and the same type structure thereof, a position off from the center may be set as the supply point of a signal as shown in FIG. 15, and an arbitrary position on the loop line 902 may be set to the supply point. The same applies to the positions of the switches 903 where the positions need to be set such that a desired bandwidth variation can be obtained as a design matter.

Figure 16:
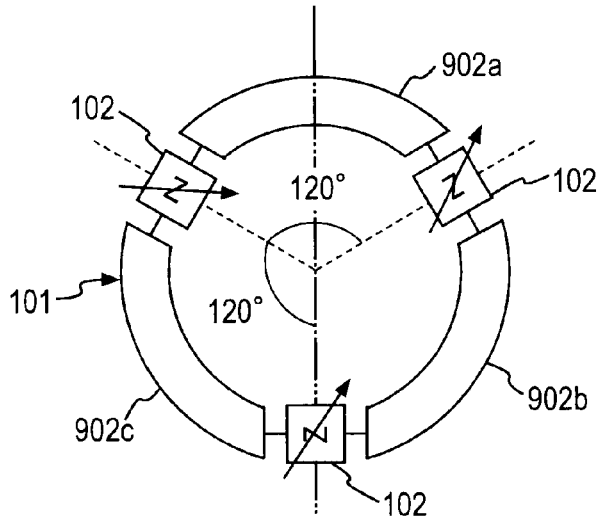
FIG. 16 is a plan view of a variable resonator to which the variable reactance blocks 102 are series-connected (switches 903 are not shown)

In the above-described the variable resonator 100*a* and the same type structure thereof, each variable reactance block 102 is electrically connected to the loop line 902 as a branching circuit, but as shown in FIG. 16, the constitution is acceptable that the loop line 902 is cut at positions where the variable reactance blocks 102 are connected to the loop line 902 and divided into a plurality of fragment lines (which correspond to lines 902*a*, 902*b*, 902*c* in the drawing), and the variable reactance blocks 102 are electrically connected in series between adjacent fragment lines at each cut portion.

Figure 17:
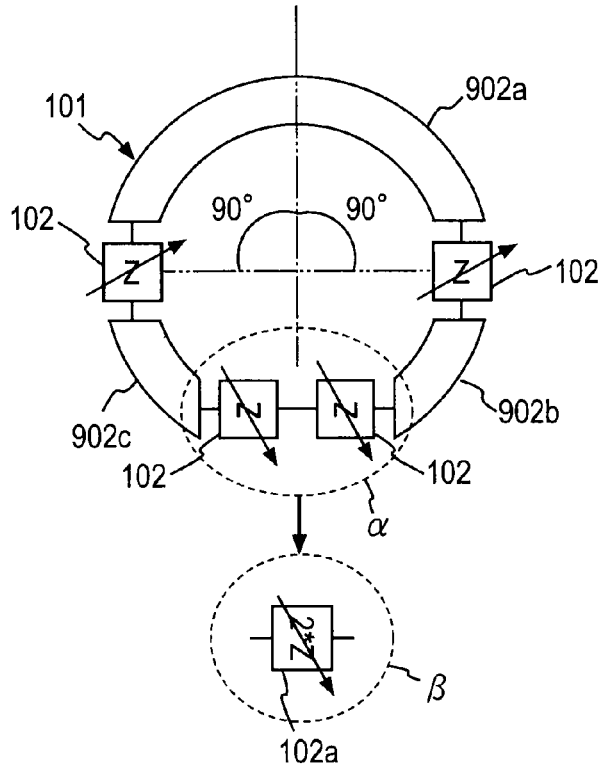
FIG. 17 is a plan view of a variable resonator to which the variable reactance blocks 102 are series-connected (switches 903 are not shown)

Similarly, in the above-described the variable resonator 100*b* and the same type structure thereof, each variable reactance block 102 is electrically connected to the loop line 902 as a branching circuit, but as shown in FIG. 17, the constitution is acceptable where that the loop line 902 is cut at positions where the variable reactance blocks 102 are connected to the loop line 902 and divided into a plurality of fragment lines (which correspond to lines 902*a*, 902*b*, 902*c* in the drawing), and the variable reactance blocks 102 are electrically connected in series between adjacent fragment lines at each cut portion.

In each drawing, the circumference of the loop line before cutting is the same as the sum of the lengths of the fragment lines after cutting in both cases. In the example shown in FIG. 16, the line lengths of the lines (902*a*, 902*b*, 902*c*) are the same, and the sum of the lengths is equal to the circumference L of the loop line 902. In the example shown in FIG. 17, the line lengths of the lines (902*b*, 902*c*) are the same, the sum of the line lengths of the lines (902*b*, 902*c*) is the same as the line length of the line 902*a*, and the sum of the line lengths of the lines (902*a*, 902*b*, 902*c*) is equal to the circumference L of the loop line 902. Note that FIG. 16 and FIG. 17 exemplify the case of the variable resonator 100*a* or the variable resonator 100*b*.

Connection points of the switches 903 to the line 902 are set such that a desired bandwidth is obtained, and the connection points susutain without change even in each fragment line after cutting. Therefore, one or more fragment lines to which no switch 903 is connected may exist.

From a different perspective, the variable resonator shown in FIG. 16 is that the fragment lines and the variable reactance blocks 102 constitute an annularly-shaped variable resonator. In short, although each line (902*a*, 902*b*, 902*c*) is set as a line that is obtained by cutting the loop line 902 at positions where the variable reactance blocks 102 are connected to the loop line 902, N lines (N is an integer satisfying $N \geqq 3$) may be generally used, and arranging them annularly and electrically connecting with one variable reactance block 102 in series between the lines make an annularly-shaped variable resonator. Note that the line lengths of the fragment lines should be equal in the electrical length at a resonance frequency whose one wavelength or integral multiple thereof corresponds to the sum of the line lengths of the fragment lines. In the case where the relative permittivity of the dielectric substrate 905 is uniform, the resonator may be constituted based on the physical length instead of the electrical length.

Similarly, from a different perspective, the variable resonator shown in FIG. 17 is that the fragment lines and the variable reactance blocks 102 constitute an annularly-shaped variable resonator. Describing the constitution in a generalized manner, by using M−1 lines and M variable reactance blocks 102 where M is an even number of 4 or larger, one variable reactance block is connected in series between an i-th line and an (i+1)-th line where i is an integer satisfying $1 \leqq i < M/2$, two variable reactance blocks in series connection are connected in series between the (M/2)-th line and the (M/2+1)-th line, one variable reactance block is connected in series between the i-th line and the (i+1)-th line where i is an integer satisfying $M/2+1 \leqq i < M-1$, one variable reactance block is connected in series between the (M−1)-th line and the first line (i=1), and thus forming an annularly-shaped variable resonator. Regarding the line length of each line, at a resonance frequency whose one wavelength or integral multiple thereof corresponds to the sum of the line lengths of the lines, the electrical length from the certain position K arbitrarily set on the first line to the end portion thereof which is closer to the second line (i=2), and the electrical length of the i-th line (i is an integer of $1 \leqq i \leqq M/2$) should be equal; and the electrical length from the position K on the first line to the end portion thereof which is closer to the (M−1)-th line, and the electrical length of the i-th line (i is an integer of $M/2+1 \leqq i \leqq M-1$) should be equal. In the case where the relative permittivity of the dielectric substrate 905 is uniform, the resonator may be constituted based on the physical length instead of the electrical length.

Particularly in the variable resonator 100*b* which employed the constitution of series connection shown in FIG. 17 and the same type structure thereof where two variable reactance blocks 102 are connected in series in the dotted-line framed portion α, it needs to be the variable reactance block 102*a* set to a reactance value twice that of each of the variable reactance blocks 102 as shown in the dotted-line framed portion β in the drawing when they are replaced with a single variable reactance block 102*a*. For example, the capacitance of the variable capacitor as the variable reactance block 102*a* needs to be set to C/2 when the variable reactance block 102 is a variable capacitor set to a capacitance C, and the inductance of the variable inductor of the variable reactance block 102*a* needs to be set to 2I when the variable reactance block 102 is a variable inductor set to an inductance I.

Hereinafter, when either the variable resonator 100*a* or the same type structure thereof or the variable resonator 100*b* or the same type structure thereof is acceptable, reference numeral 100 allocated and the resonator will be called a variable resonator 100.

Figure 18:
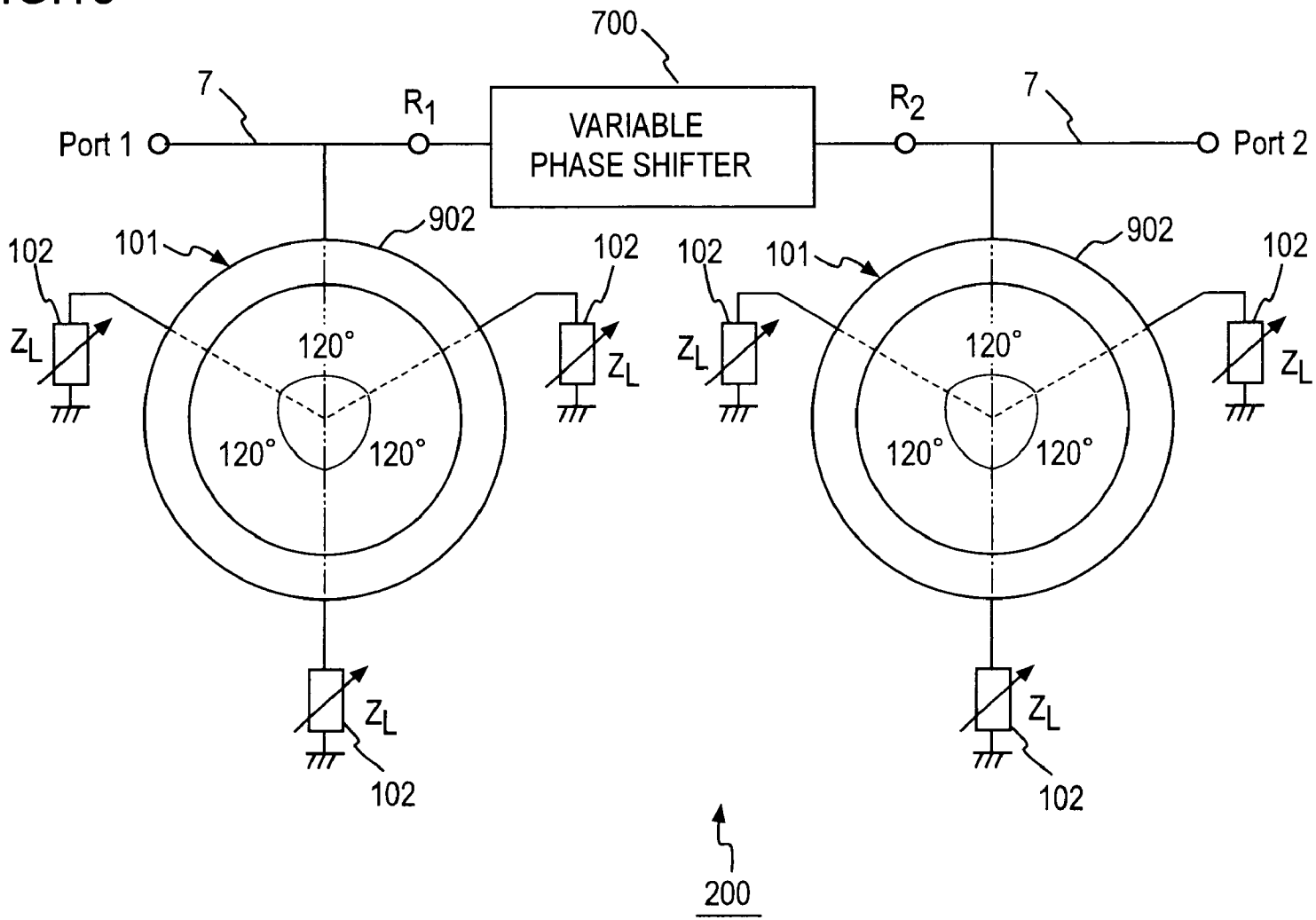
FIG. 18 is a plan view of a tunable filter 200 having the constitution that two variable resonators 100 are connected by a variable phase shifter 700 (switches 903 are not shown)

FIG. 18 shows a tunable filter (tunable bandpass filter) 200 where two of the above-described variable resonator 100 are used (the variable resonator 100*a* is exemplified in FIG. 18) and a variable phase shifter 700 being a phase variable circuit inserted into an area sandwiched by positions where the variable resonator 100 are connected to the input/output line 7 as branching circuits. Generally, when two or more resonators are used and adjacent resonators are connected by a line whose phase changes by 90 degrees at the resonance frequency of the resonator (the line having quarter wavelength at the resonance frequency), a bandpass filter is obtained. Although it is desirable to connect the variable resonators 100 by the line having quarter wavelength at the resonance frequency of the variable resonator 100, the line is not limited to this. However, in the case where the resonators are connected by a line having a length other than the quarter wavelength or other than a wavelength having the odd multiple thereof, a passband appears in a band off from the resonance frequency of the variable resonator unless the characteristics of the variable resonators 100 are equal. This is because the resonance frequency (center frequency) of the entire circuit becomes the resonance frequency of each variable resonator when the resonators are connected by a line having the quarter wavelength or the odd multiple thereof, whereas a signal transmits at a series resonance frequency of the entire circuit made up of the variable resonators and the input/output line in other cases. Based on the reason, the tunable bandpass filter 200 is realized by using the variable resonators 100*a* and the variable phase shifter 700. Further, in the case where the appearance of passband in a band off from the resonance frequency of the variable resonator may be allowed, characteristics in the passband can be changed by changing phase between resonators, so that the variable phase shifter may be also used for this object. The tunable bandpass filter 200 is constituted of using two variable resonators 100 in the example shown in FIG. 18, but the tunable bandpass filter may be constituted of using two or more variable resonators 100. In this case, the variable phase shifter 700 should be inserted between areas where the adjacent variable resonators 100 are connected to the input/output line 7.

FIG. 19 to FIG. 25 show examples of a phase variable circuit that may be used in the tunable bandpass filter 200.

Figure 19:
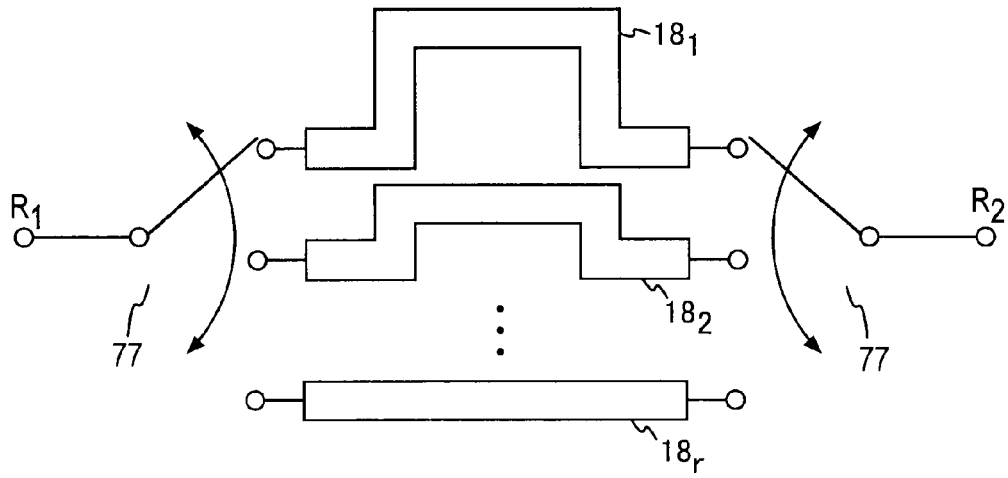
FIG. 19 is a constitution example of a phase variable circuit.
Figure 20:
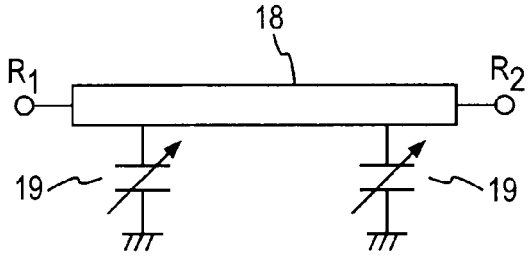
FIG. 20 is a constitution example of the phase variable circuit.
Figure 21:
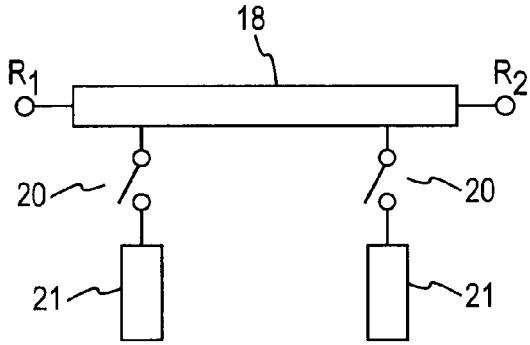
FIG. 21 is a constitution example of the phase variable circuit.

[1] Two single-pole r-throw switches 77 are provided where r is an integer of 2 or larger, both r-throw side terminals select the same one transmission line out of r transmission lines $\mathbf{18}_1$ to $\mathbf{18}_r$ whose lengths are different and thus a signal phase between ports ($R_1$, $R_2$) is made variable (refer to FIG. 19).

[2] Two or more variable capacitors 19 are connected along the transmission line 18, and the end portions of the variable capacitors 19 on the opposite side of the end portions which are connected to the transmission line 18 are grounded. By appropriately changing the capacitance of each variable capacitor 19 as a design matter, a signal phase between the ports ($R_1$, $R_2$) is made variable (refer to FIG. 20).

[3] Two or more switches 20 are connected along the transmission line 18, and the end portions of the switches 20 on the opposite side of the end portions which are connected to the transmission line 18 are connected to a transmission line 21. By appropriately changing the conduction state of each switch 20 as a design matter, a signal phase between the ports ($R_1$, $R_2$) is made variable (refer to FIG. 21).

Figure 22:
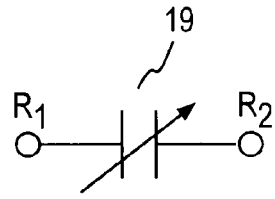
FIG. 22 is a constitution example of the phase variable circuit.
Figure 23:
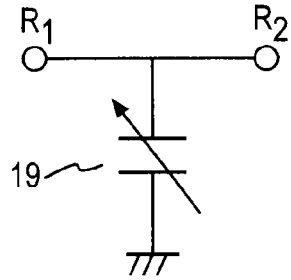
FIG. 23 is a constitution example of the phase variable circuit.

[4] By appropriately changing the capacitance of the variable capacitor 19 between the ports ($R_1$, $R_2$) as a design matter, a signal phase between the ports ($R_1$, $R_2$) is made variable (refer to FIG. 22).

[5] The variable capacitor 19 is connected to the input/output line 7 between the ports ($R_1$, $R_2$) as a branching circuit. An end portion of the variable capacitor 19 on the opposite side of the end portion which is connected to the input/output line 7 is grounded. By appropriately changing the capacitance of the variable capacitor 19 as a design matter, a signal phase between the ports ($R_1$, $R_2$) is made variable (refer to FIG. 23).

Figure 24:
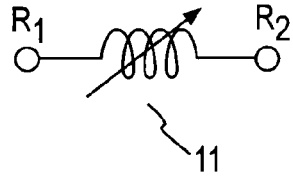
FIG. 24 is a constitution example of the phase variable circuit.
Figure 25:
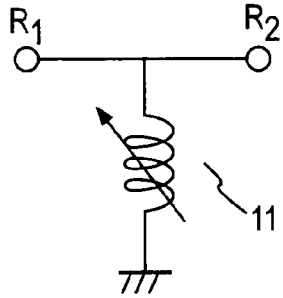
FIG. 25 is a constitution example of the phase variable circuit.

[6] By appropriately changing the inductance of the variable inductor 11 between ports ($R_1$, $R_2$) as a design matter, a signal phase between ports ($R_1$, $R_2$) is made variable (refer to FIG. 24).

[7] The variable inductor 11 is connected to the input/output line 7 between the ports ($R_1$, $R_2$). An end portion of the variable inductor 11 on the opposite side of the end portion which is connected to the input/output line 7 is grounded. By appropriately changing the inductance of the variable inductor 11 as a design matter, a signal phase between the ports ($R_1$, $R_2$) is made variable (refer to FIG. 25).

Figure 26:
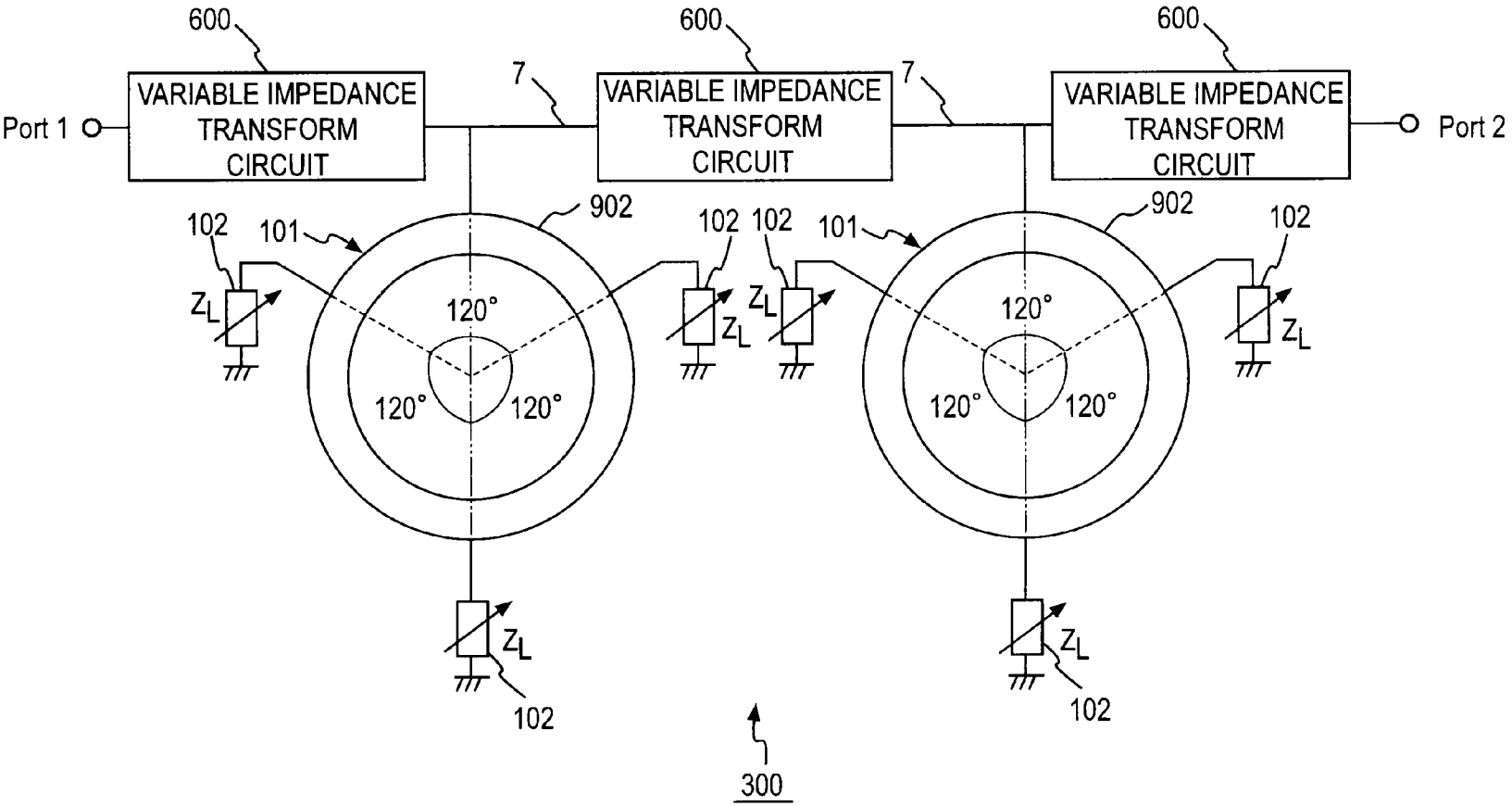
FIG. 26 is a plan view of a tunable filter 300 having the constitution that two variable resonators 100 are connected by variable impedance transform circuits 600 (switches 903 are not shown)

FIG. 26 shows a tunable filter 300 where two of the above-described variable resonator 100 are used (the variable resonator 100*a* is exemplified in FIG. 26), and variable impedance transform circuits 600 are severally inserted into an area sandwiched by positions where the variable resonators 100 are connected to the input/output line 7 as branching circuits, an area between the input port and a position where one variable resonator 100 is connected to the input/output line 7 as a branching circuit, and an area between the output port and a position where the other variable resonator 100 is connected to the input/output line 7 as a branching circuit. Generally, by using one or more resonators, it is possible to constitute a filter by connecting between the resonator and the input port/output port, and furthermore between resonators when there is a plurality of resonators, by using a variable impedance transform circuit such as a J-inverter and a K-inverter. Based on the principle, the tunable filter 300 is realized by using the variable resonators 100*a* and the variable impedance transform circuits 600. The tunable filter 300 is constituted of using two variable resonators 100 in the example shown in FIG. 26, but it is possible to constitute the tunable filter 300 by using two or more variable resonators 100. In this case, each variable impedance transform circuit 600 should be inserted into areas sandwiched by the positions where adjacent variable resonators 100 are connected to the input/output line 7.

Although the above-described each tunable filter uses two or more variable resonators 100, it is possible to constitute the tunable filter by using single variable resonator 100. In constituting the tunable filter by using one variable resonator 100, the filter becomes as exemplified in FIG. 5A to FIG. 5F and FIG. 6A to FIG. 6C, for example. In short, the variable resonator 100 should be electrically connected as a branching circuit to the input/output line 7 being a transmission line. With this constitution, a signal can be propagated at a bandwidth straddling the resonance frequency, it operates as a tunable filter. Since the tunable filter also uses the variable resonator 100, bandwidth can be variable by changing the position of the switch 903 to be turned to the conduction state while a certain particular frequency is sustained as a center frequency, and furthermore, the center frequency can be also made variable by changing the reactance values of the variable reactance blocks 102.

Figure 27:
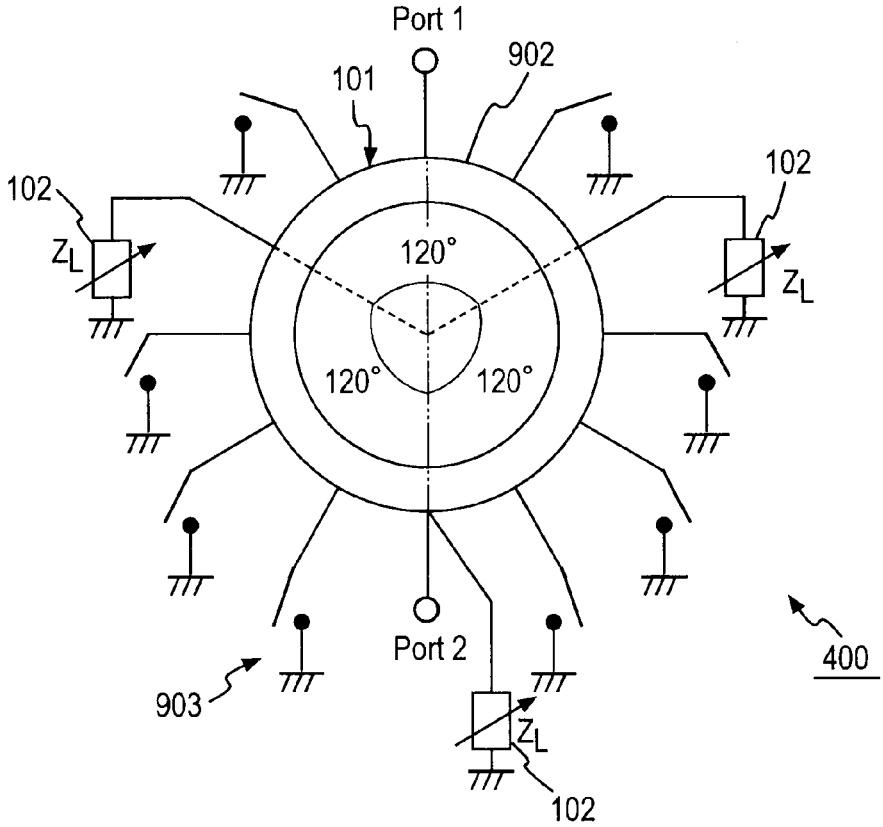
FIG. 27 is one embodiment of a tunable filter on the premise of the constitution of the variable resonator 100*a;*
Figure 30:
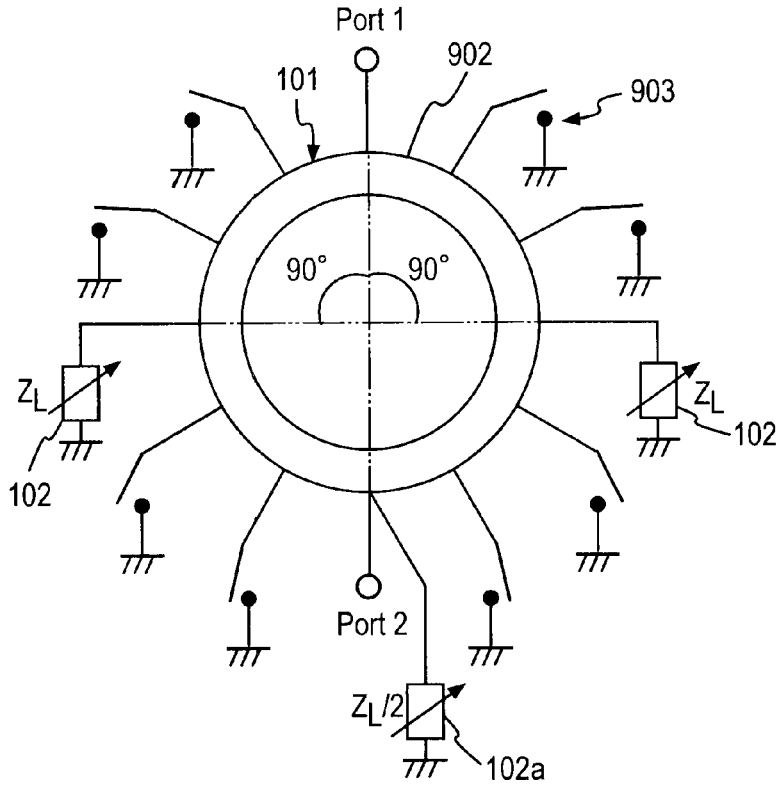
FIG. 30 is one embodiment of a tunable filter on the premise of the constitution of the variable resonator 100*b;*

The above-described tunable filter has the constitution that a single signal supply point at which the variable resonator 100 is connected to the input/output line 7 exists, and the variable resonator 100 is connected to the input/output line 7 as a branching circuit. However, as shown in FIG. 27, the constitution of the tunable filter 400 that the variable resonator 100 is connected to the input/output line 7 in series is also possible. Although FIG. 27 shows the example where the variable resonator 100*a* is used as the variable resonator 100 and is connected to the input/output line 7 in series, the variable resonator 100*b* may be used as the variable resonator 100 (refer to FIG. 30).

Figure 28:
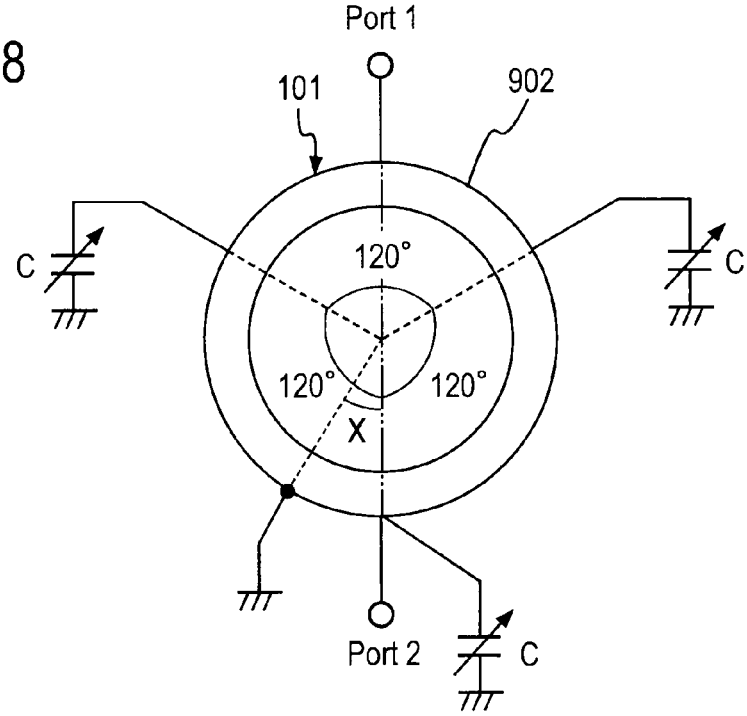
FIG. 28 is a plan view of the tunable filter shown in FIG. 27 in the case where each variable reactance block 102 is a variable capacitor (switches 903 are not shown)
Figure 29:
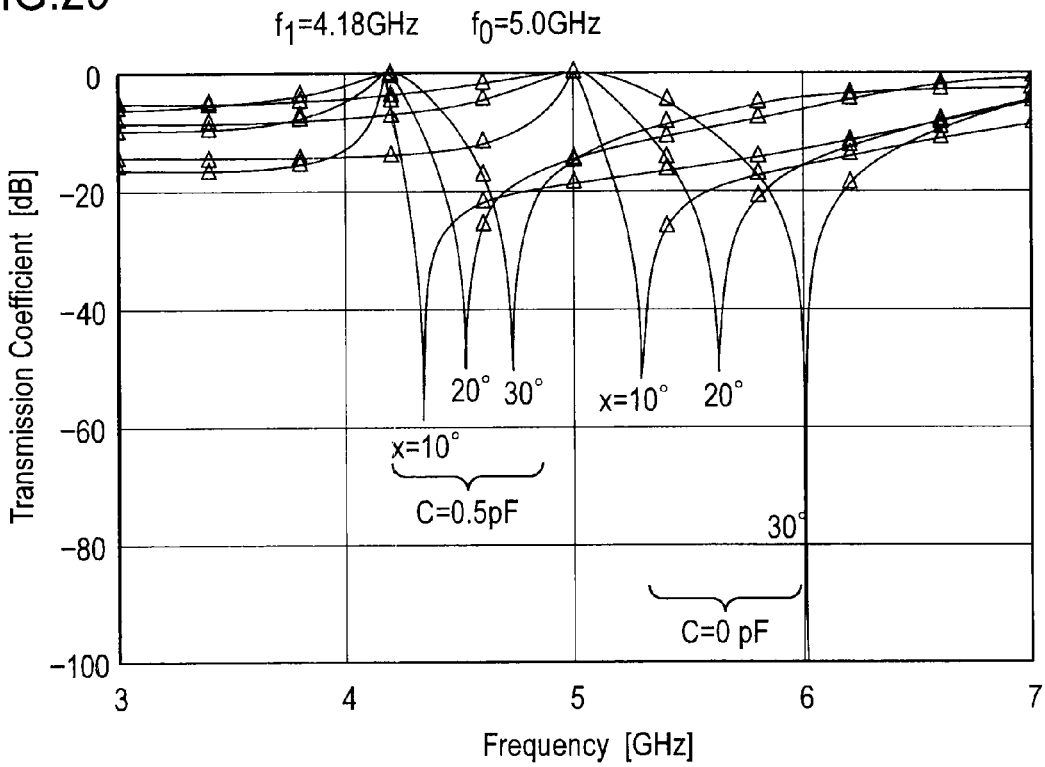
FIG. 29 is a graph showing the frequency characteristics of the tunable filter shown in FIG. 28.

The frequency characteristics of the tunable filter 400 employing the constitution is shown in FIG. 28 and FIG. 29. The tunable filter shown in FIG. 28 is the filter that the variable reactance blocks 102 of the tunable filter 400 shown in FIG. 27 in the case of using the variable resonator 100*a* are variable capacitors. FIG. 29 shows the frequency characteristics of the tunable filter shown in FIG. 28. The length of the loop line 902 was set to one wavelength at 5 GHz and the impedance of the input/output line 7, the loop line 902 and the input/output port was set to 50Ω. FIG. 29 makes it clear that the center frequency of the tunable filter is moved to the lower frequency side by changing the capacitances of the variable capacitors from 0 pF to 0.5 pF. Further, the graph also shows that bandwidth can be changed without changing the center frequency even if the position of the switch 903 to be turned to the conduction state (FIG. 29 shows the example of 10, 20 and 30 degrees) is changed at each capacitance. In short, it is understood that the center frequency is not influenced by the change of the position of the switch 903 in the conduction state. Although the characteristic impedance of the loop line of the variable resonator used in this description is 50Ω which is the same as that of the input/output line and the input/output port, it is not limited particularly to this value, but is a design parameter to be determined corresponding to performance/characteristics required. Even in the tunable filter shown in FIG. 30, the center frequency is not influenced by the change of the position of the switch 903 in the conduction state.

As described above, at least three variable reactance blocks 102 of the variable resonator 100 are necessary. From the viewpoint of miniaturization, it seems to be preferable that the number of the variable reactance blocks 102 is as small as possible. However, a constitution provided with a large number of the variable reactance blocks 102 has an advantage, and it will be described by employing the case of using variable capacitors as an example.

Referring to FIG. 5A and FIG. 5B, in the case where variable capacitors having the capacitance of 0.1 pF are loaded, the graphs show that the larger the number of variable capacitors loaded, the more significantly the resonance frequency changes under the same condition. This means that the capacitance per 1 piece may be smaller as the number of variable capacitors to be loaded becomes larger when an attempt of changing the resonance frequency to the same value. For this reason, if it is difficult to load one variable capacitor having a large capacitance on a substrate in fabricating a variable resonator, there is a possibility of obtaining an equal result by providing a large number of variable capacitors having a small capacitance instead. Particularly, it is easily realized when a technology such as an integrated circuit manufacturing process which is good at manufacturing a large number of the same device is used.

Further, description will be made for an effect produced by the fact that the resonance frequency of the variable resonator 100 changes by the variable reactance blocks 102 such as the variable capacitors, the variable inductors and the transmission lines from a resonance frequency which is determined by the length of the loop line 902.

Not limited to the variable resonator 100, there are cases where the relative permittivity of a substrate for fabricating a resonator is not constant among substrates or even in the same substrate depending on the conditions in manufacturing the resonator despite the same material and the same manufacturing method. For this reason, even if resonators having the same dimensions are formed on the substrate, the phenomenon occurs that the resonance frequencies of the resonators are different. Therefore, there are cases where adjustment work is required in a general filter using a resonator. In a resonator using a transmission line, adjusting the resonance frequency by trimming the length of the transmission line is generally done, but it is impossible for the resonator provided with the loop line. Further, although adjusting the resonance frequency by adding a reactance element such as a capacitor is also generally done, such an adjustment method is not versatile depending on the design environment of resonator. In a resonator capable of significantly changing only the bandwidth at a certain center frequency, adjustment cannot be performed by adding the reactance element without thorough consideration in many cases. Under the existing circumstances, the variable resonator 100 can enjoy advantageous effect. For example, in the case where no variable reactance block 102 is connected, if the variable resonator 100 designed to resonate at a resonance frequency being a design value resonates at a higher frequency than the design resonance frequency due to a lower relative permittivity of the actual substrate than the relative permittivity of a substrate used during designing, the frequency can be easily adjusted to the design resonance frequency by adjusting the reactance values of the variable reactance blocks 102 of the variable resonator 100. Then, the change of the position of the switch 903 to be turned to the conduction state does not influence resonance frequency in the variable resonator 100.

Hereinafter, description will be made for a modified example according to an embodiment of the present invention.

Figure 31:
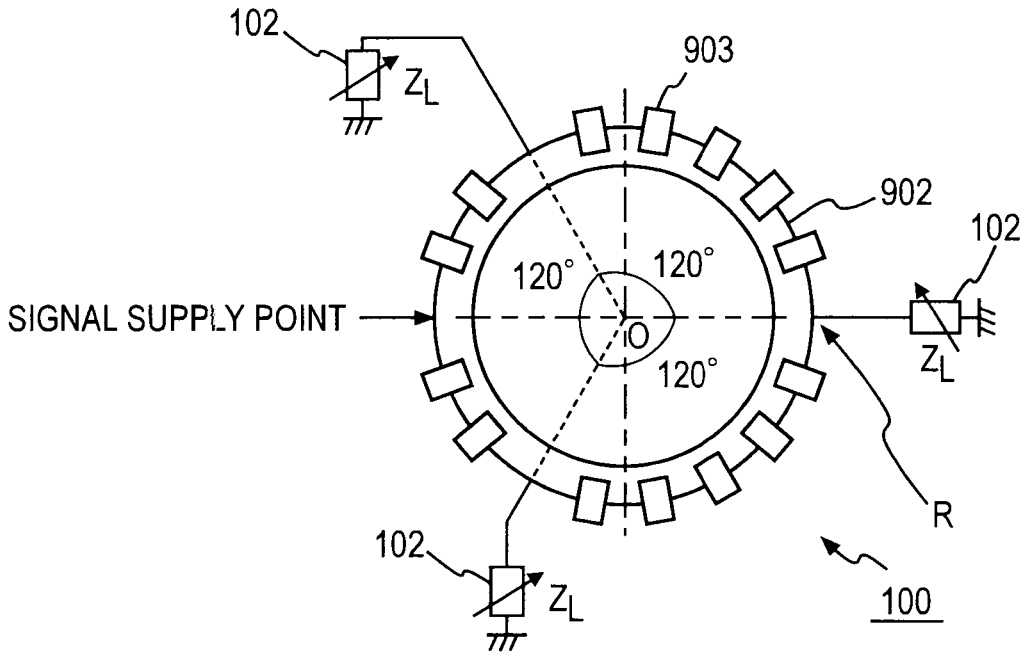
FIG. 31 is a plan view of the variable resonator 100 which is constructed with an aim of passage of a signal.

Regarding the variable resonator 100, by turning the switch 903 to the ON state which is at a position w times (w=0, 1, 2, 3, . . . ) the electrical length 71 at the design resonance frequency from the signal supply point along the line 902, input impedance at the signal supply point can be brought to 0. Therefore, in the case of constituting the tunable filter by using the variable resonator 100, a signal of the design resonance frequency is prevented from passing the filter by turning the switch 903 to the ON state which is at a position w times the electrical length $\pi$ at the design resonance frequency. On the other hand, by turning the switch 903 at the position to the OFF state, the signal of the design resonance frequency is allowed to pass the filter. Then, when the tunable filter is constituted not aiming at signal elimination but passing the signal of a desired frequency, there is no need to provide the switches 903 at the positions of integral multiple of the electrical length it in the design resonance frequency. As shown in FIG. 31 as an example, in the case where the line 902 is a circular shape and its length is one wavelength in the design resonance frequency, a position R symmetrical to the signal supply point with respect to the center O of the line 902 is a position of integral multiple of the electrical length $\pi$, and the constitution that switches are not provided on these two positions is possible.

Figure 32:
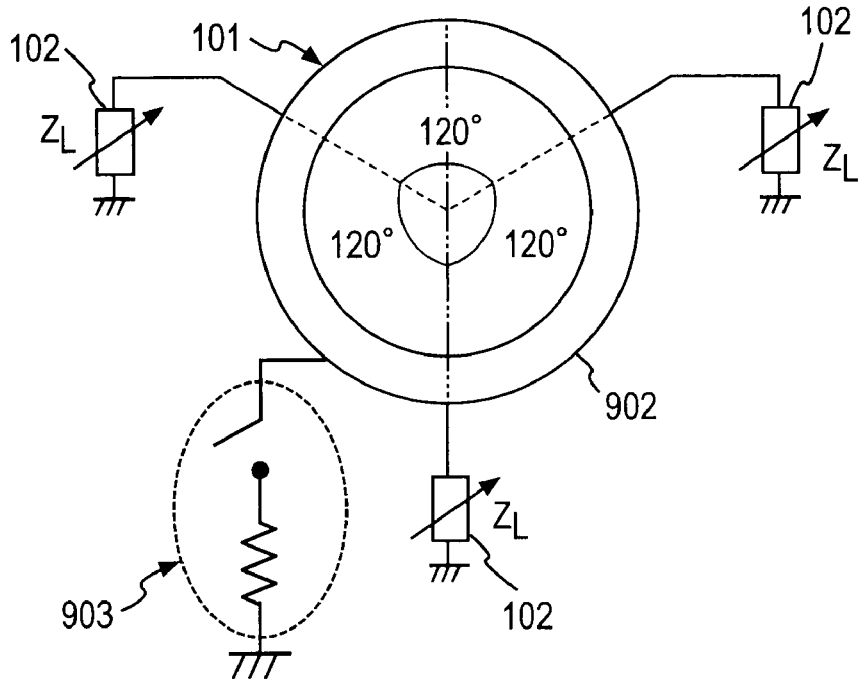
FIG. 32 is a plan view of a variable resonator when a resistor lies between the switch 903 and a ground conductor on the premise of the constitution of the variable resonator 100*a;*

When the switch 903 at the position w times the electrical length $\pi$ from the signal supply point along the line 902 at the design resonance frequency is not turned to the ON state, input impedance in the signal supply point can be brought to infinity in the variable resonator 100. For this reason, characteristics having a low insertion loss is obtained even if the switch 903 of a relatively large resistance is used as shown in FIG. 32 as an example.

Figure 33:
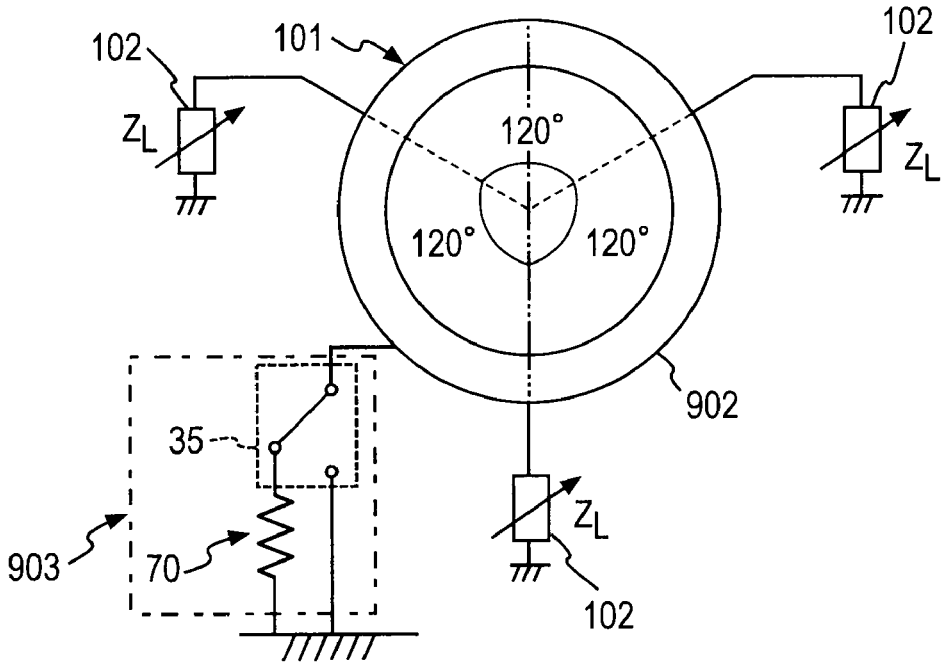
FIG. 33 is a plan view of a variable resonator using a switching device that performs switching of a case of connecting to a ground conductor via a resistor and a case of connecting to a ground conductor without a resistor on the premise of the constitution of the variable resonator 100*a;*

Thus, a constitution positively utilizing resistors may be also employed. For example, the case of positively utilizing resistors such as switching the case where the line 902 is connected to the ground conductor 904 directly by a switch 35 being a switching device having a low resistance and the case where the line 902 is connected to the ground conductor 904 by the switch 35 via a resistor 70 having several ohms to several tens ohms which is higher than the resistance of the switch 35, are possible (refer to FIG. 33). In this case, by laying the resistor 70 having several ohms to several tens ohms, it becomes possible to select the case of suppressing signal propagation in a band influenced by the resistor and the case of allowing a signal near the band influenced by the resistor to propagate by bringing the resistance as low as possible.

Although the case of using resistors has been shown here, not limited to the resistor, a passive element exemplified by a variable resistor, an inductor, a variable inductor, a capacitor and a variable capacitor and the like, for example, may be used.

Figure 34:
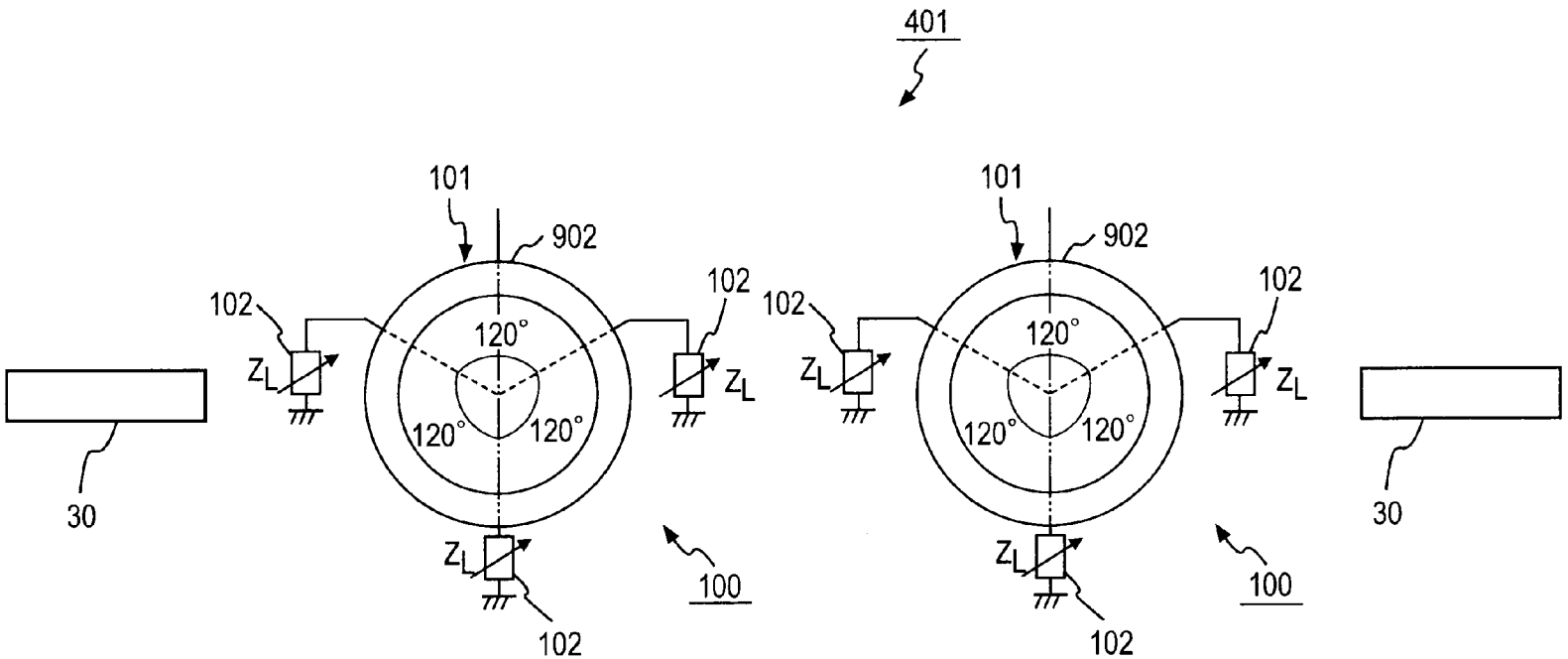
FIG. 34 is one embodiment of a tunable filter 401 in the case of electric field coupling (switches 903 are not shown)
Figure 35:
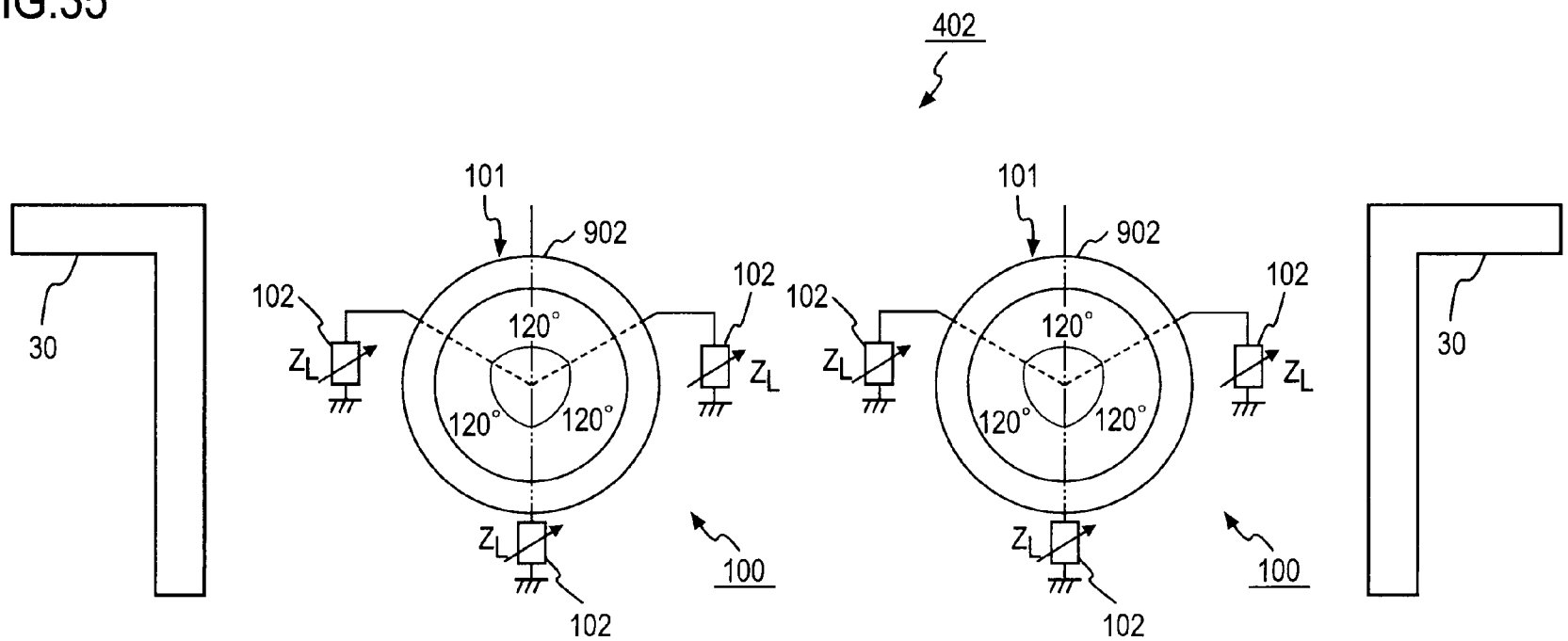
FIG. 35 is one embodiment of a tunable filter 402 in the case of magnetic field coupling (switches 903 are not shown)

It is possible to constitute a tunable filter by executing electrical connection between the variable resonator 100 and the transmission line 30 based on electric field coupling or magnetic field coupling. FIG. 34 exemplifies the case of constituting a tunable filter 401 by electric field coupling, and FIG. 35 exemplifies the case of constituting a tunable filter 402 by magnetic field coupling. Note that the variable resonator 100*a* is exemplified as the variable resonator 100 in FIG. 34 and FIG. 35.

Figure 36A:
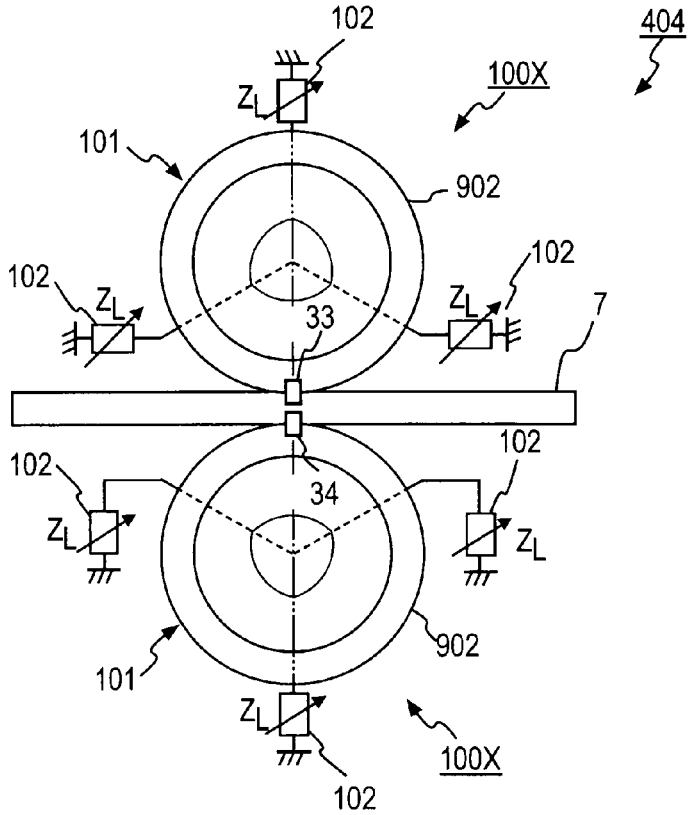
FIG. 36A is one embodiment of a tunable filter 404 that uses variable resonators having the same resonance frequency and the same characteristic impedance (switches 903 are not shown)
Figure 36B:
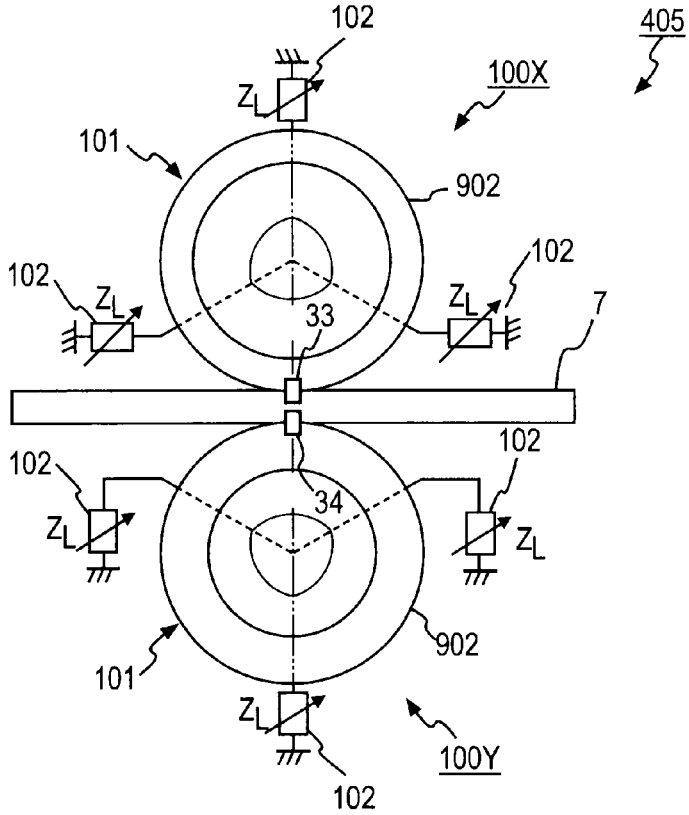
FIG. 36B is one embodiment of a tunable filter 405 that uses variable resonators having the same resonance frequency and different characteristic impedances (switches 903 are not shown)

A tunable filter 404 shown in FIG. 36A is constituted of the two variable resonators 100 having the same resonance frequency, a switch 33 and a switch 34 which are provided between each variable resonator and the input/output line 7 being the transmission line. A tunable filter 405 shown in FIG. 36B also has the similar constitution to the tunable filter 404. However, the tunable filter 404 uses two variable resonators having the same characteristic impedance, whereas the tunable filter 405 uses two variable resonators having different characteristic impedances. Herein, reference numerals attached to the variable resonators should be 100X and 100Y conveniently.

In the case of the tunable filter 404, selecting of the switches (33, 34) realizes a state where only one variable resonator 100X is connected or an other state where both of the variable resonators 100X are connected. The resonance frequencies are the same in both states, whereas frequency characteristics are different in each state. When both of the variable resonators 100X are connected to the input/output line 7, an attenuation amount of a signal at a frequency further from the resonance frequency becomes larger comparing to the case of connecting only one variable resonator 100X to the input/output line 7. This is because the characteristic impedance of the variable resonators 100X becomes half equivalently. In short, the characteristic impedance of each variable resonator to the input/output line 7 is switched by changing the ON or OFF state of the switches (33, 34), and the frequency characteristics of the tunable filter 404 can be changed corresponding to the two states above.

In the case of the tunable filter 405, selecting of the switches (33, 34) realizes three states: a first state where only one variable resonator X is connected, a second state where only one variable resonator Y is connected and a third state where both of the variable resonators (X, Y) are connected.

The resonance frequencies are the same in all states, whereas frequency characteristics are different in each state. In short, in the tunable filter 405, the characteristic impedance of each variable resonator to the input/output line 7 is switched by changing the ON or OFF state of the switches (33, 34) similar to the case of the tunable filter 404, and the frequency characteristics of the tunable filter 404 can be changed corresponding to the three states above.

Figure 37:
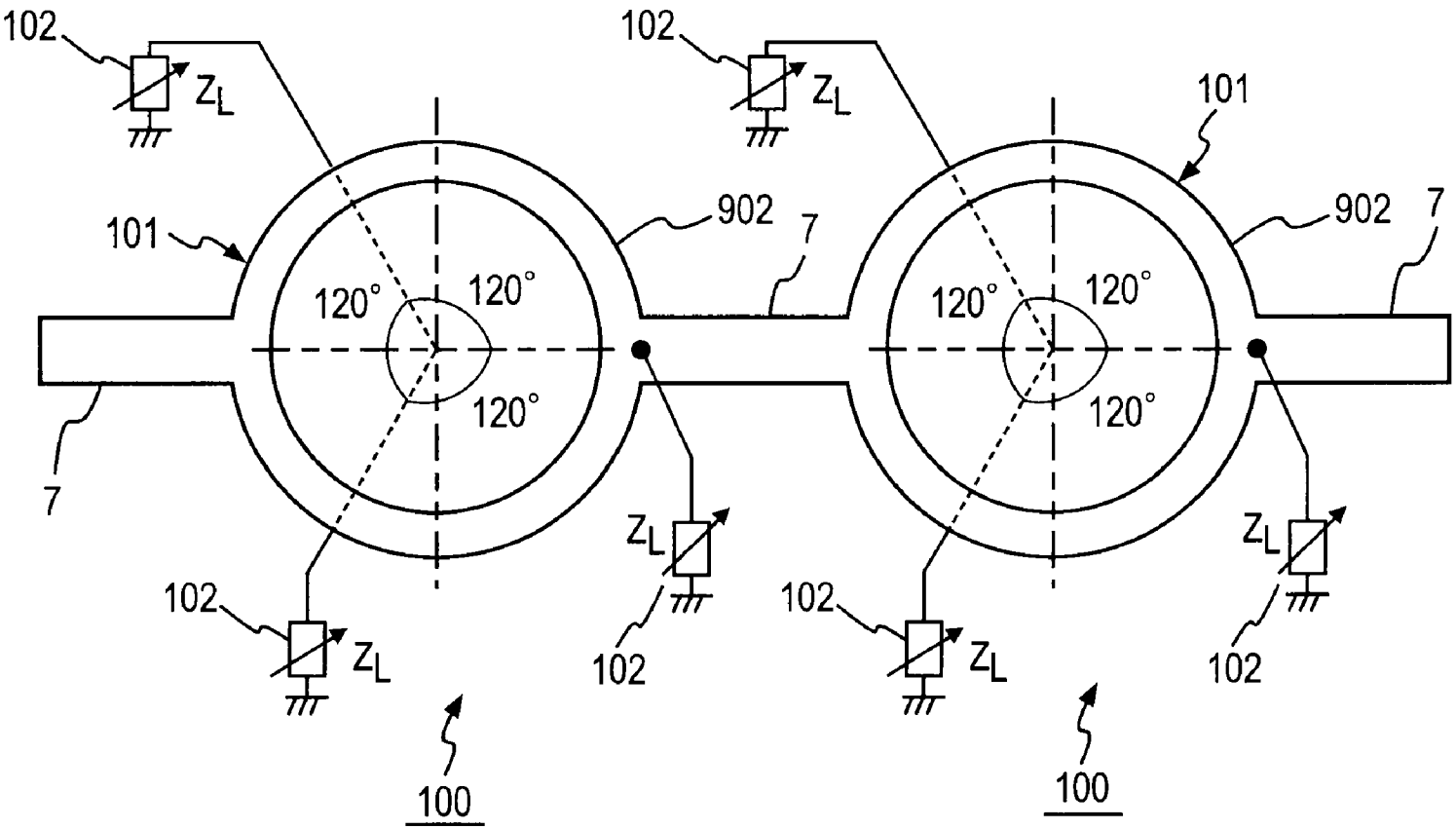
FIG. 37 is one embodiment of a tunable filter which comprises a combination of series circuits only (switches 903 are not shown)
Figure 38:
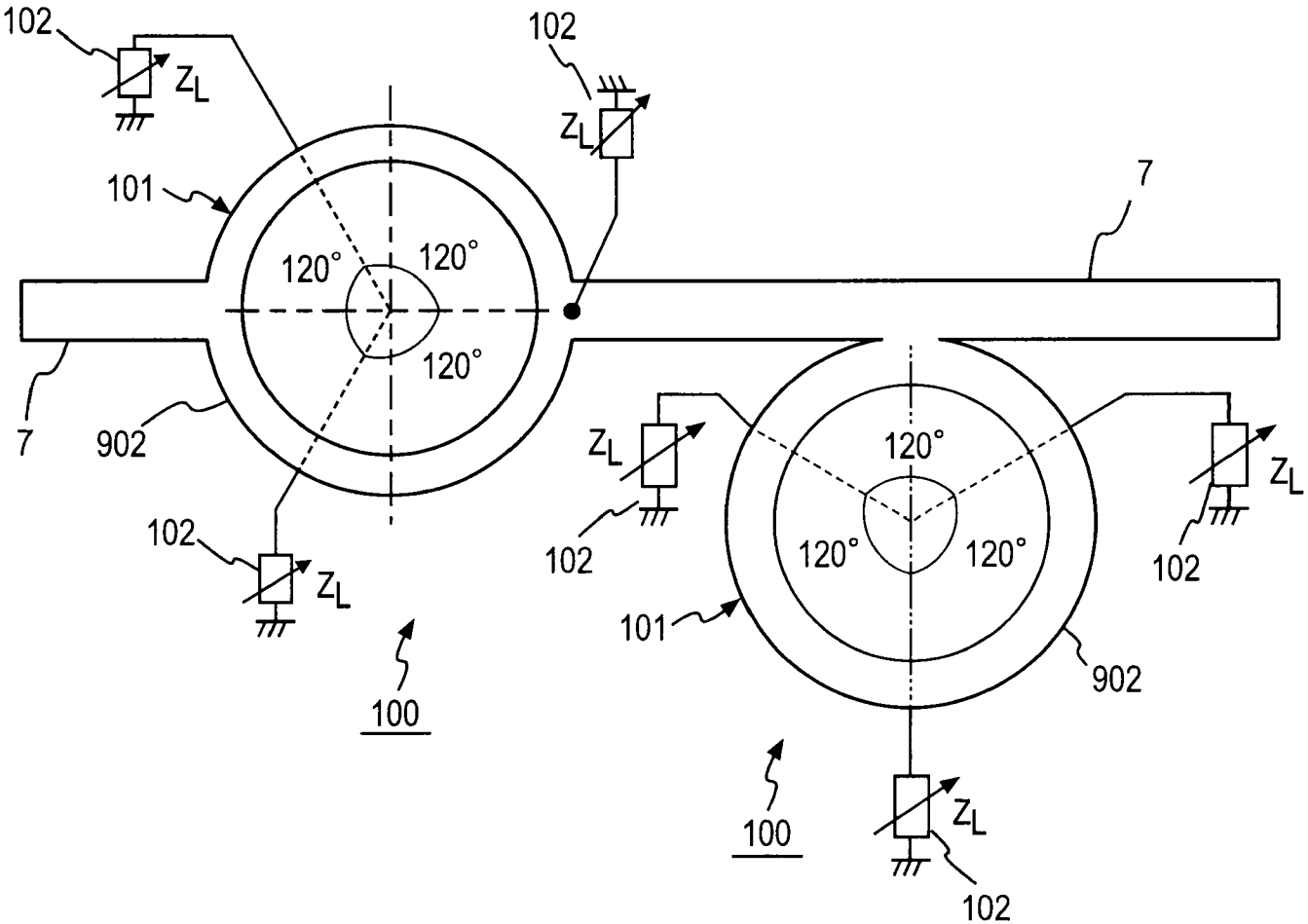
FIG. 38 is one embodiment of the tunable filter which comprises a combination of a series circuit and a branching circuit (switches 903 are not shown)

Although the tunable filter 400 shown in FIG. 27 shows the case of using one variable resonator 100, it may have the constitution that a plurality of the variable resonators 100 are connected in series as shown in FIG. 37 or the constitution that a part of a plurality of the variable resonators 100 is connected to the input/output line 7 as a branching circuit and the remaining variable resonators 100 are connected to the input/output line 7 in series as shown in FIG. 38, where each drawing exemplifies the case of using two variable resonators.

Figure 39:
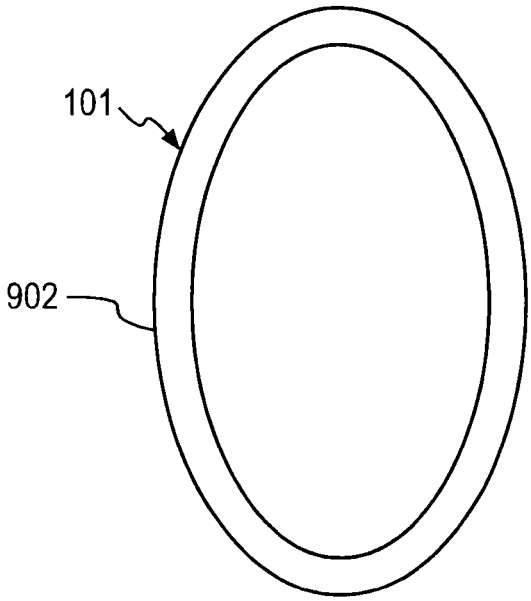
FIG. 39 is one embodiment of the variable resonator which comprises a loop line having an elliptic shape (switches 903 are not shown)
Figure 40:
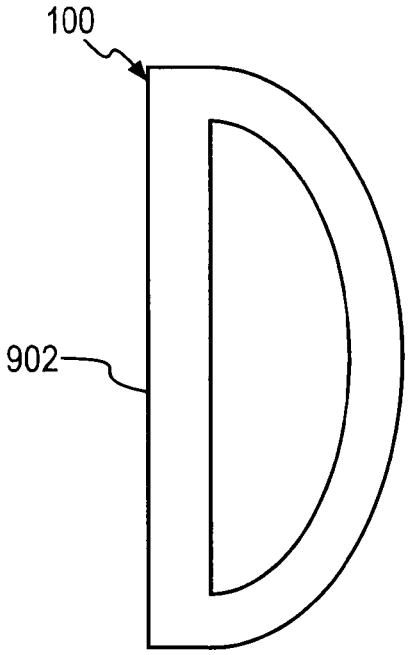
FIG. 40 is one embodiment of the variable resonator which comprises a loop line having a bow shape (switches 903 are not shown)

All of the variable resonators 100 shown above are in the circular shape, but the present invention is not intended particularly to the circular shape. The essence of the present invention is in [1] constituting the variable resonator in a loop shape (refer to FIG. 1, FIG. 2, FIG. 16 and FIG. 17) and [2] the arrangement of the variable reactance blocks 102 electrically connected to the variable resonator, but not in the shape of the line 902. Therefore, when the line 902 is constituted of a transmission line having the same characteristic impedance, for example, the line may be an elliptic shape as shown in FIG. 39 or may be a bow shape as shown in FIG. 40. Note that the illustration of the switches 903 and the variable reactance blocks 102 is omitted in each drawing of FIG. 39 to FIG. 46.

Figure 41A:
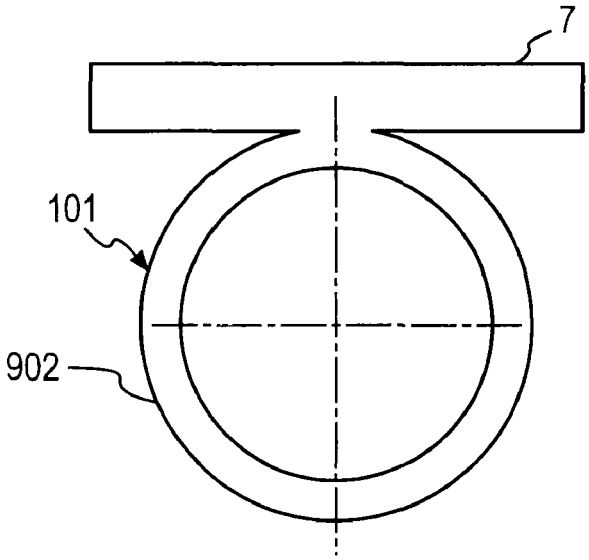
FIG. 41A is a plan view of an electric circuit device having a coupling construction of a transmission line and a variable resonator having a loop line of a circular shape (switches 903 are not shown)
Figure 41B:
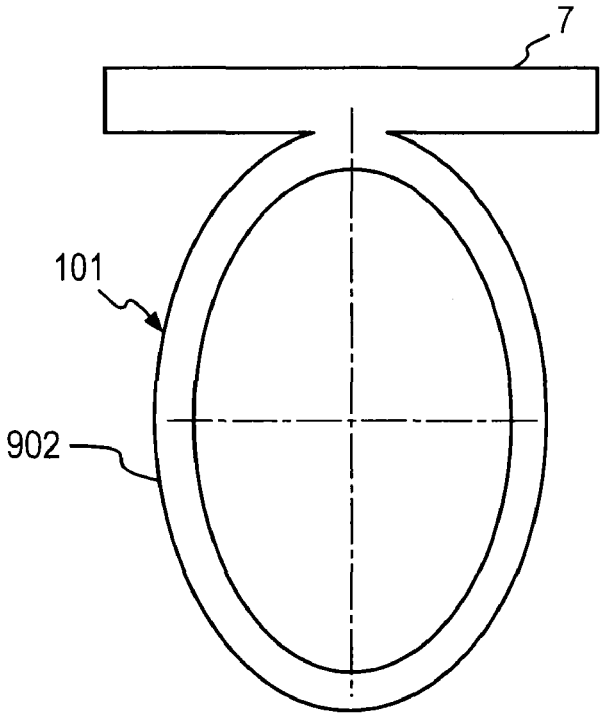
FIG. 41B is a plan view of an electric circuit device having a coupling construction of the transmission line and the variable resonator having a loop line of an elliptic shape (switches 903 are not shown)

FIG. 41A shows the case where the variable resonator having the loop line 902 of the circular shape is connected to the transmission line 7. FIG. 41B shows the case where the variable resonator having the loop line 902 of the elliptic shape is connected to the transmission line 7.

Generally, low insertion loss can be obtained by the constitution shown in FIG. 41B than the constitution shown in FIG. 41A. In the case where magnetic field coupling occurs between the transmission line and the loop line, reflection of an input signal due to the reduction of impedance in the connection area could be a cause of the loss. The reason why the low insertion loss is obtained in the constitution shown in FIG. 41B is because magnetic field coupling between the transmission line 7 and the loop line 902 is reduced by connecting the variable resonator to the transmission line such that the long diameter of the ellipse being the shape of the loop line is made orthogonal to the transmission line 7.

Figure 42A:
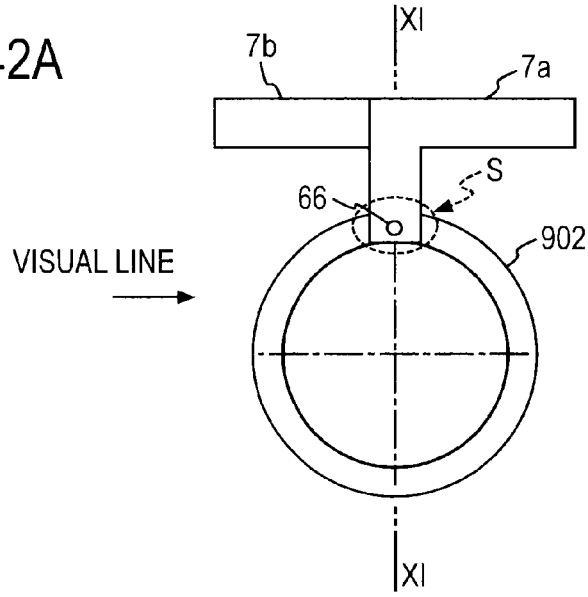
FIG. 42A is a plan view of an electric circuit device with a multilayer structure having a coupling construction of the transmission line and the variable resonator (switches 903 are not shown)
Figure 42B:
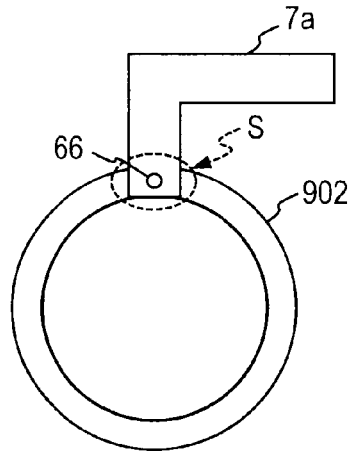
FIG. 42B is a view for explaining the relationship between a first layer and a second layer in the electric circuit device shown in FIG. 42A (switches 903 are not shown)
Figure 42C:
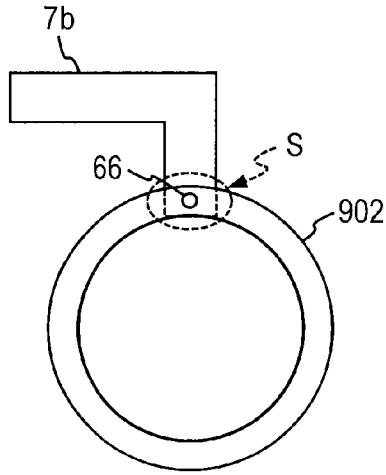
FIG. 42C is a view for explaining the relationship between the second layer and a third layer in the electric circuit device shown in FIG. 42A (switches 903 are not shown)

Further, if a multilayer structure is allowed, the constitution shown in FIG. 42A, for example, may be employed. Assuming that the front be an upper layer followed by lower layers backward sequentially when the page surface of FIG. 42 is seen from the front, a L-type transmission line 7*a* is disposed on the upper layer as shown in FIG. 42B, the variable resonator is disposed on the lower layer thereof, and the transmission line 7*a* and the line 902 of the variable resonator overlap on a part (reference symbol S). Further, as shown in FIG. 42C, an L-type transmission line 7*b* is further disposed on the lower layer, and the transmission line 7*b* and the line 902 of the variable resonator overlap on the part (reference symbol S). A via hole is provided on the portion shown by the reference symbol S, and the transmission line 7*a*, the line 902 and the transmission line 7*b* are electrically connected mutually.

Description will be added to several modes of the multilayer structure by referring to the cross-sectional views along the line XI-XI in the visual line direction shown in FIG. 42A. Note that it is assumed that the plan view of the multilayer structure is as shown in FIG. 42A. Further, it is assumed that the upper side of the drawing paper is the upper layer and the lower side of the drawing paper is the lower layer in each cross-sectional view shown in FIG. 43A to FIG. 43F. To show the sectional constitution simply, the switches 903 or the like are not shown.

Figure 43A:
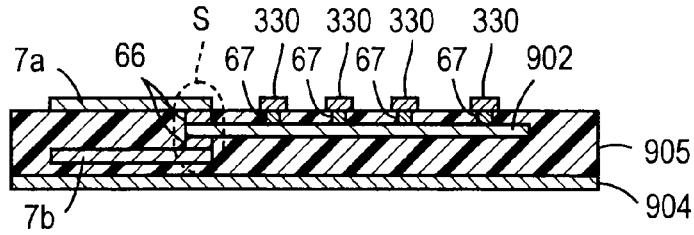
FIG. 43A is a first example of the sectional constitution of the electric circuit device shown in FIG. 42A.

A first example of the multilayer structure should have the constitution that the ground conductor 904 being the lowest layer and the dielectric substrate 905 being the upper layer thereof are arranged in a contacted manner, and furthermore, the dielectric substrate 905 and the transmission line 7*a* being the upper layer thereof are arranged in a contacted manner as shown in FIG. 43A. The loop line 902 and the transmission line 7*b* of the variable resonator are fixed in the dielectric substrate 905 in an embedded manner. The loop line 902 is arranged on an upper layer than the transmission line 7*b*. Then, a via hole 66 is provided on the portion shown by the reference symbol S to electrically connect the transmission line 7*a*, the line 902 and the transmission line 7*b*. Each via hole 67 is for securing electrical connection between the switch 903 of the loop line 902 fixed in the dielectric substrate 905 in an embedded manner and the outside of the dielectric substrate for operating the switch 903 from outside, for example, and the via hole 67 is electrically connected to conductors 330 on the uppermost layer which are arranged in a contacted manner with the dielectric substrate 905. Note that FIG. 43A does not show a via hole 906, a conductor 933 and the like shown in FIG. 47, and it must be noted that the via hole 67 does not have the same object/function as the via hole 906.

Figure 43B:
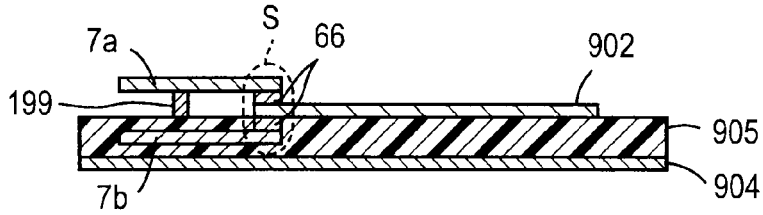
FIG. 43B is a second example of the sectional constitution of the electric circuit device shown in FIG. 42A.

A second example of the multilayer structure should have the constitution that the ground conductor 904 being the lowest layer and the dielectric substrate 905 being the upper layer thereof are arranged in a contacted manner, and furthermore, the dielectric substrate 905 and the loop line 902 on the upper layer thereof are arranged in a contacted manner as shown in FIG. 43B. The transmission line 7*b* is fixed in the dielectric substrate 905 in an embedded manner. The transmission line 7*a* is arranged on an upper layer than the loop line 902, and is supported by a support body 199. In FIG. 43B, the support body 199 lies between the transmission line 7*a* and the dielectric substrate 905, but the embodiment is not limited to such a constitution, and other constitutions are acceptable as long as an object of supporting the transmission line 7*a* is achieved. The material of the support body 199 may be appropriately employed depending on the arrangement constitution of the support body 199, and it may be either metal or dielectric material in the example of FIG. 43B. Then, the via hole 66 is provided on the portion shown by the reference symbol S to electrically connect the transmission line 7*a*, the line 902 and the transmission line 7*b* mutually.

Figure 43C:
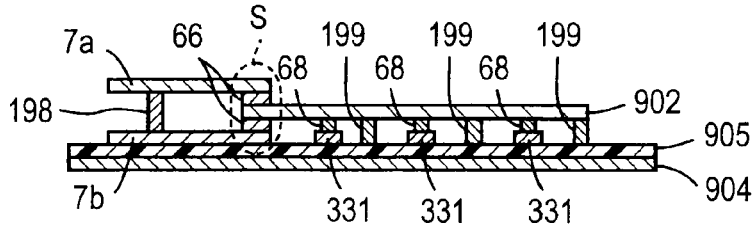
FIG. 43C is a third example of the sectional constitution of the electric circuit device shown in FIG. 42A.

A third example of the multilayer structure should have the constitution that the ground conductor 904 being the lowest layer and the dielectric substrate 905 being the upper layer thereof are arranged in a contacted manner, and furthermore, the dielectric substrate 905 and the transmission line 7*b* and conductors 331 which are on the upper layer of the substrate are arranged in a contacted manner as shown in FIG. 43C. The loop line 902 is supported by the support bodies 199 on an upper layer than the transmission line 7*b* and the conductors 331. Further, the transmission line 7*a* is supported on an upper layer than the loop line 902 by a support body 198 which lies between the transmission line 7*a* and the transmission line 7*b*. In the constitution shown in FIG. 43C, the material of the support body 198 should be a dielectric material to prevent electrical connection between the transmission line 7*a* and the transmission line 7*b*. The conductors 331 and conductor posts 68 are provided between the loop line 902 and the dielectric substrate 905 corresponding to the position of the switches 903. Then, the via hole 66 is provided on the portion shown by the reference symbol S to electrically connect the transmission line 7*a*, the line 902 and the transmission line 7*b* mutually.

Figure 43D:
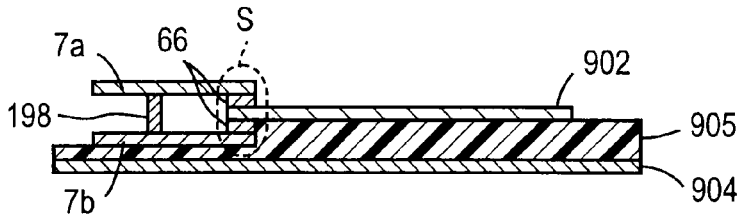
FIG. 43D is a fourth example of the sectional constitution of the electric circuit device shown in FIG. 42A.

A fourth example of the multilayer structure should have the constitution that the ground conductor 904 being the lowest layer and the dielectric substrate 905 being the upper layer thereof are arranged in a contacted manner, and furthermore, the dielectric substrate 905 and the transmission line 7*b* on the upper layer thereof are arranged in a contacted manner as shown in FIG. 43D. The loop line 902 on the upper layer is arranged in a contacted manner on the dielectric substrate 905, and the dielectric substrate 905 has a step structure as shown in FIG. 43D. For this reason, a constitution is formed that the loop line 902 is positioned on the upper layer than the transmission line 7*b* despite that both the transmission line 7*b* and the loop line 902 are arranged on the dielectric substrate 905 in a contacted manner. The transmission line 7*a* is supported on the upper layer than the loop line 902 by the support body 198 which lies between the transmission line 7*a* and the transmission line 7*b*. Then, the via hole 66 is provided on the portion shown by the reference symbol S to electrically connect the transmission line 7*a*, the line 902 and the transmission line 7*b* mutually.

Figure 43E:
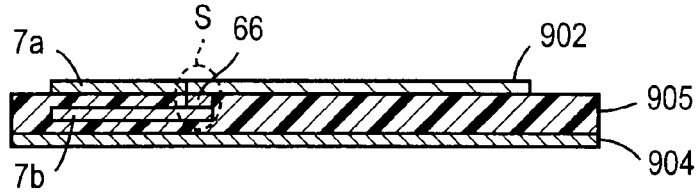
FIG. 43E is a fifth example of the sectional constitution of the electric circuit device shown in FIG. 42A.

A fifth example of the multilayer structure should have the constitution that the ground conductor 904 being the lowest layer and the dielectric substrate 905 being the upper layer thereof are arranged in a contacted manner, and furthermore, the dielectric substrate 905 and the transmission line 7*a* and the loop line 902 which are on an upper layer of the dielectric substrate 905 are arranged in a contacted manner as shown in FIG. 43E. The transmission line 7*b* is fixed in the dielectric substrate 905 in an embedded manner. The transmission line 7*a* and the loop line 902 may be either formed integrally into a single piece or electrically joined as separate members as seen in the constitutions shown in FIG. 41A, FIG. 41B or the like, for example. Then, the via hole 66 is provided on the portion shown by the reference symbol S to electrically connect the transmission line 7*a*, the line 902 and the transmission line 7*b* mutually.

Figure 43F:
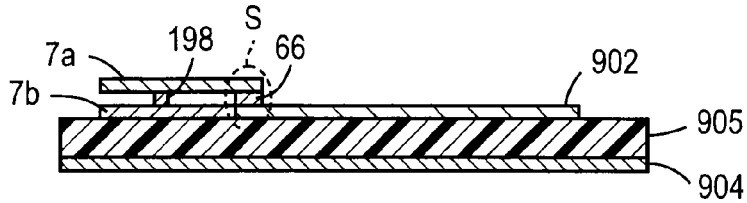
FIG. 43F is a sixth example of the sectional constitution of the electric circuit device shown in FIG. 42A.

A sixth of the multilayer structure example should have the constitution that the ground conductor 904 being the lowest layer and the dielectric substrate 905 being the upper layer thereof are arranged in a contacted manner, and furthermore, the dielectric substrate 905 and the transmission line 7*a* and the loop line 902 which are on an upper layer of the dielectric substrate 905 are arranged in a contacted manner as shown in FIG. 43F. The transmission line 7*a* and the loop line 902 may be either formed integrally into a single piece or electrically joined as separate members as described above. The transmission line 7*a* is supported on an upper layer than the loop line 902 and the transmission line 7*b* and by the above-described support body 198 which lies between the transmission line 7*a* and the transmission line 7*b*. Then, the via hole 66 is provided on the portion shown by the reference symbol S to electrically connect the transmission line 7*a*, the line 902 and the transmission line 7*b* mutually.

Figure 44A:
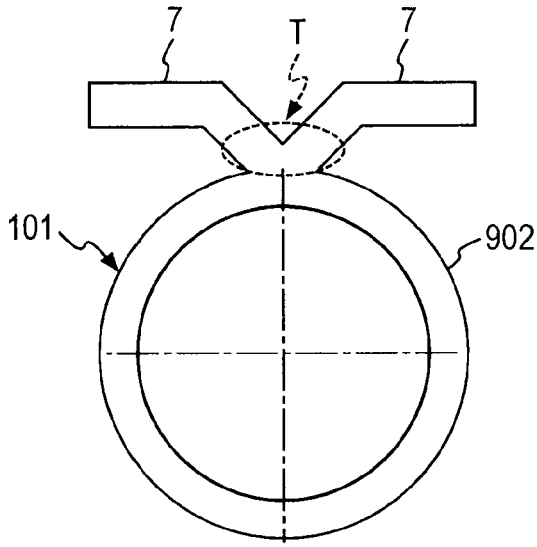
FIG. 44A is a plan view of an electric circuit device having a coupling construction of a variable resonator and a transmission line having a bent portion (switches 903 are not shown)

Further, as shown in FIG. 44A, the constitution that a bent portion (reference symbol T) is provided on a part of the transmission line 7 and the bent portion and the line 902 of the variable resonator are connected is also possible. Thus, an increased distance between the transmission line 7 and the line 902 can reduce the insertion loss.

Figure 44B:
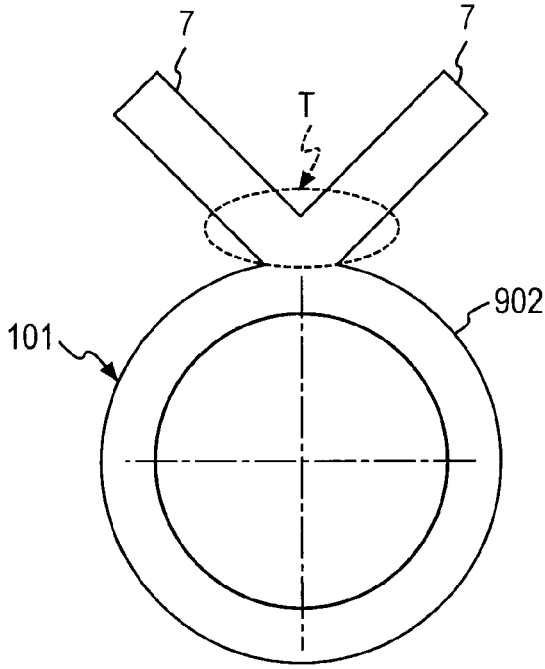
FIG. 44B is a plan view of an electric circuit device having a coupling construction of the variable resonator and the transmission line having a bent portion (switches 903 are not shown)

In view of the convenience or the like of a circuit constitution provided with a plurality of variable resonators, a constitution with a connection between the variable resonator and the transmission line as shown in FIG. 44B is also possible.

FIG. 44A and FIG. 44B exemplify the line 902 and the transmission line 7 as a single piece formed integrally or as separate members electrically joined in the same layer, but it is also possible to constitute them as a multilayer structure as shown in FIG. 42A is also possible.

Figure 45:
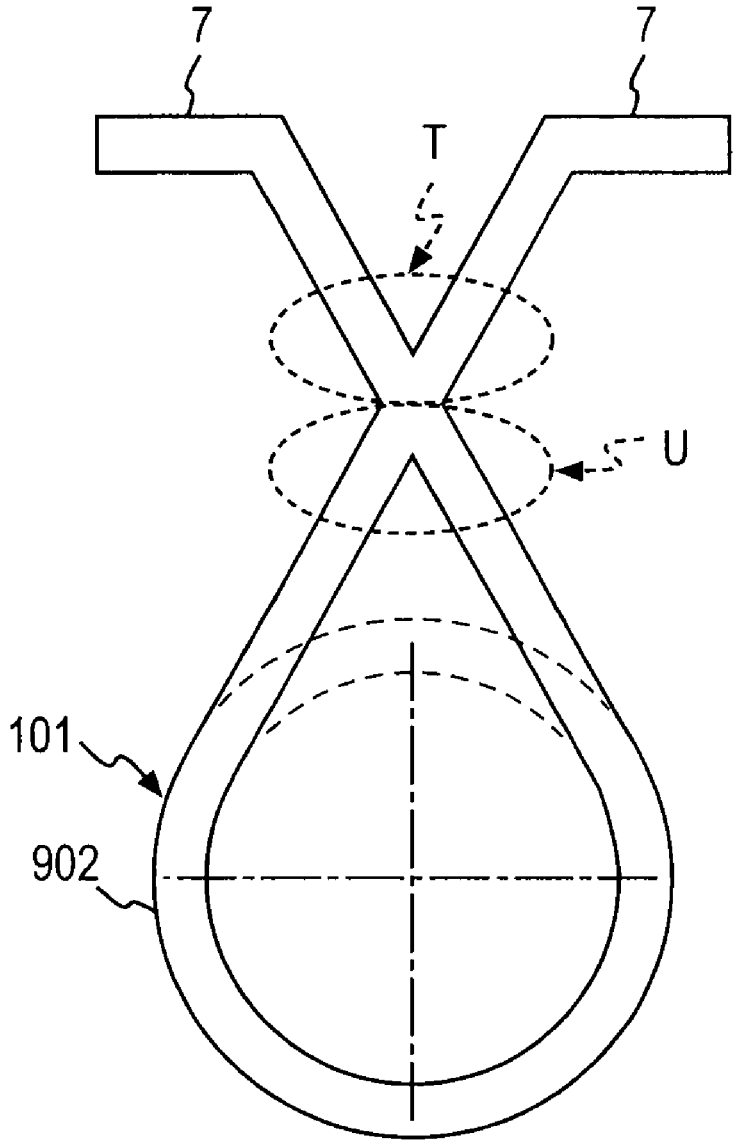
FIG. 45 is a plan view of an electric circuit device having a coupling construction of a variable resonator and the transmission line having a bent portion (switches 903 are not shown)

Further, as a modified example of the constitution of the connection shown in FIG. 44, the constitution is also acceptable that the bent portion (reference symbol T) of the transmission line 7 is connected to a bent portion (reference symbol U) of the line 902 of the variable resonator which is in a teardrop shape as shown in FIG. 45.

A low insertion loss can be obtained by the constitution shown in FIG. 45 comparing to the constitution shown in FIG. 44. This is because, in addition to the fact that a positional relation between the transmission line 7 and the line 902 of the variable resonator is remote, the line 902 has an exceedingly short line portion approximately parallel with the transmission line 7 in the vicinity of a connection area between the transmission line 7 and the line 902 in the case of the constitution shown in FIG. 45, so that magnetic field coupling is even difficult to occur. Therefore, the line 902 takes the teardrop shape in FIG. 45, but it is not limited to such a shape, and it should have a constitution of a connection between the transmission line 7 and the line 902 which prevents the occurrence of magnetic field coupling.

Further, the foregoing embodiments are shown by using the microstrip line structure, but the present invention is not intended to limit it to such a line structure, and other line structures such as a coplanar waveguide may be used.

Figure 46:
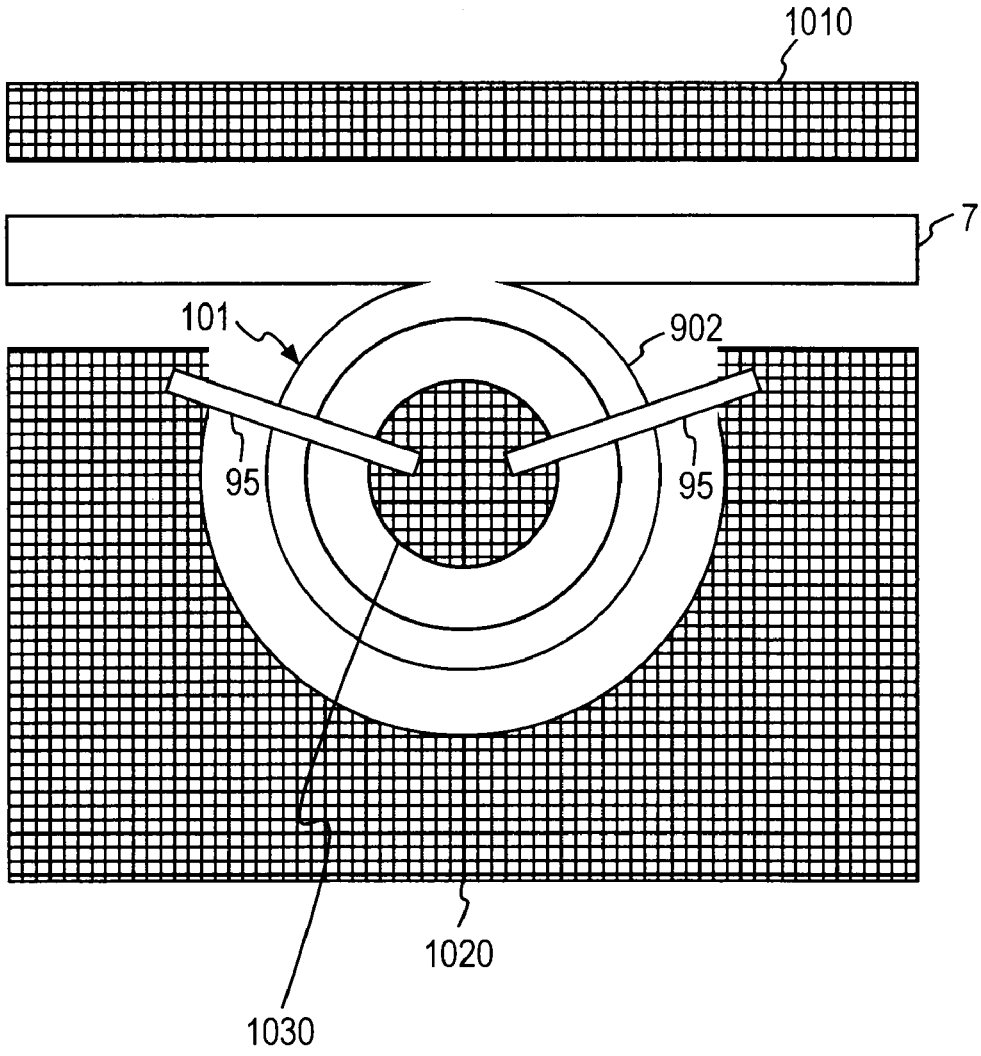
FIG. 46 is a plan view of an electric circuit device with a coplanar waveguide structure which has a coupling construction of the variable resonator and the transmission line (switches 903 are not shown)

FIG. 46 exemplifies the case by the coplanar waveguide. A ground conductor 1010 and a ground conductor 1020 are arranged on the same surface of the dielectric substrate, and the transmission line 7 to which the variable resonator is connected is arranged in an interval between the ground conductors. Further, a ground conductor 1030 is arranged inside the line 902 of the variable resonator in a non-contact manner with the line 902. Air bridges 95 are bridged between the ground conductor 1020 and the ground conductor 1030 to align electric potentials and the ground conductors are electrically connected. The air bridges 95 are not an essential constituent element in the case of the coplanar waveguide, but a constitution may be also acceptable that a rear ground conductor (not shown) is arranged on a surface on the opposite side of the surface of the dielectric substrate on which the ground conductor 1010, the transmission line 7 and the like are arranged, the ground conductor 1030 and the rear ground conductor are electrically connected via a via hole, the ground conductor 1020 and the rear ground conductor are electrically connected via a via hole, and electric potentials of the ground conductor 1020 and the ground conductor 1030 are aligned, for example.

What is claimed is:

1. A variable resonator, comprising:

a single loop conductor line provided on one surface of a dielectric substrate;

a ground conductor provided on either said one surface or an other surface opposite to said one surface of said dielectric substrate;

at least two switches; and

M variable reactance blocks each being configured to permit a change of a reactance value, where M is an even number of 4 or larger, wherein each of said at least two switches has one end electrically connected to said single loop conductor line and an other end electrically connected to said ground conductor, and each of said at least two switches is configured to select interchangeably electrical connection or electrical non-connection between said ground conductor and said single loop conductor line;

connection positions on said single loop conductor line where said at least two switches are connected are different from each other;

said single loop conductor line has a resonance frequency whose one wavelength or an integral multiple thereof corresponds to a circumference length of the single loop conductor line;

the reactance values set to said M variable reactance blocks are equal to each other;

M/2−1 variable reactance blocks of said M variable reactance blocks, which are referred to as first variable reactance blocks, are connected to said single loop conductor line at connection points along a clockwise part of said single loop conductor line between a position K1 arbitrarily set on said single loop conductor line and a position K2 apart from the position K1 by half an electrical length of one circumference of said single loop conductor line except said position K1 and said position K2 so as to divide said clockwise part at an equal electrical length interval based on said resonance frequency;

M/2−1 variable reactance blocks of said M variable reactance blocks except said first variable reactance blocks are connected to said single loop conductor line at connection points along a counter-clockwise part of said single loop conductor line between said position K1 and said position K2 except said position K1 and said position K2 so as to divide said counter-clockwise part at said equal electrical length interval based on said resonance frequency;

two remaining variable reactance blocks of said M variable reactance blocks are connected to said single loop conductor line at said position K2;

a working resonance frequency at which said variable resonator resonates changes in response to the change of said reactance value of each of said M variable reactance blocks;

only one of said at least two switches is selected to be rendered in a conducting state; and a bandwidth at the working resonance frequency changes in response to a change of said selection of said only one of said at least two switches with the working resonance frequency being constant.

2. The variable resonator according to claim 1, wherein each of said M variable reactance blocks is any one of circuit elements that include a capacitor, an inductor, and a transmission line, any one of combinations of the circuit elements of a same type, or any one of combinations of the circuit elements of different types.

3. A variable resonator, comprising:

at least three lines;

a ground conductor;

at least two switches; and at least three variable reactance blocks each being configured to permit a change of a reactance value, wherein each of said at least two switches has one end electrically connected to a corresponding one of said at least three lines and an other end electrically connected to said ground conductor, and each of said at least two switches is configured to select interchangeably electrical connection or electrical non-connection between said ground conductor and said corresponding one of said at least three lines;

connection positions on said at least three lines where said at least two switches are connected are different from each other;

each of said at least three lines has a predetermined electrical length at a resonance frequency, one wavelength or an integral multiple thereof at the resonance frequency corresponding to a sum of line lengths of said at least three lines;

in each pair of adjacent two lines of said at least three lines, at least one of said at least three variable reactance blocks is electrically connected in series between the adjacent two lines of said at least three lines.

4. The variable resonator according to claim 3, wherein a number of said at least three lines is the same as a number of said at least three variable reactance blocks;

the reactance values set to said at least three variable reactance blocks are equal to each other;

the electrical lengths of said at least three lines are equal to each other; and in each said pair, the adjacent two lines of said at least three lines are connected by a corresponding one of said at least three variable reactance blocks.

5. The variable resonator according to claim 3, wherein a number of said at least three lines is M−1 and a number of said at least three variable reactance blocks is M, where M is an even number of 4 or larger;

the reactance values set to said M variable reactance blocks are equal to each other;

an i-th line and an (i+1)-th line of said M−1 lines are connected by a corresponding one of said M variable reactance blocks, where i is an integer satisfying $1 \leqq i < M/2$;

an (M/2)-th line and an (M/2+1)-th line of said M−1 lines are connected by two of said M variable reactance blocks in series connection;

when $M \geqq 6$, a j-th line and a (j+1)-th line of said M−1 lines are connected by a corresponding one of said M variable reactance blocks, where j is an integer satisfying $M/2+1 \leqq j < M-1$;

an (M−1)-th line and a first line of said M−1 lines are connected by a corresponding one of said M variable reactance blocks;

an electrical length from a position K arbitrarily set on said first line to one end portion of said first line which is closer to a second line of said M−1 lines and each electrical length of a k-th line where k is an integer satisfying $2 \leqq k \leqq M/2$ are equal to each other; and an electrical length from said position K to an other end portion of said first line which is closer to said (M−1)-th line and each electrical length of a m-th line where m is an integer satisfying $M/2+1 \leqq m \leqq M-1$ are equal to each other.

6. The variable resonator according to claim 3, wherein a number of said at least three lines is M−1 and a number of said at least three variable reactance blocks is M−1, where M is an even number of 4 or larger;

the reactance value set to each of M−2 variable reactance blocks out of the M−1 variable reactance blocks, which are referred to as first variable reactance blocks, is twice as much as the reactance value set to a remaining one variable reactance block of the M−1 variable reactance blocks, which is referred to as a second variable reactance block;

an i-th line and an (i+1)-th line of said M−1 lines are connected by a corresponding one of said first variable reactance blocks, where i is an integer satisfying $1 \leqq i < M/2$;

an (M/2)-th line and an (M/2+1)-th line of said M−1 lines are connected by said second variable reactance block;

when $M \geqq 6$, a j-th line and a (j+1)-th line of said M−1 lines are connected by a corresponding one of said first variable reactance blocks, where j is an integer satisfying $M/2+1 \leqq j < M-1$;

an (M−1)-th line and a first line of said M−1 lines are connected by a corresponding one of said first variable reactance blocks;

an electrical length from a position K arbitrarily set on said first line to one end portion of said first line which is closer to a second line of said M−1 lines and each electrical length of a k-th line where k is an integer satisfying $2 \leqq k \leqq M/2$ are equal to each other; and an electrical length from said position K to an other end portion of said first line which is closer to said (M−1)-th line and each electrical length of a m-th line where m is an integer satisfying $M/2+ \leqq m \leqq M-1$ are equal to each other.

7. The variable resonator according to any one of claims 3 to 6, wherein only one of said at least two switches is selected to be rendered in a conducting state.

8. A tunable filter, comprising:

said variable resonator according to any one of claims 1 and 3; and a transmission line, wherein said variable resonator is connected electrically to said transmission line.

9. The tunable filter according to claim 8, further comprising:

a second variable resonator having a resonance frequency and a characteristic impedance that are both the same as those of said variable resonator; and two second switches, wherein each of said variable resonator and said second variable resonator is connected to said transmission line at a same connecting position as a branching circuit via a corresponding one of said two second switches; and said transmission line is connected electrically to both or either one of the variable resonator and said second variable resonator according to both or either one of said two second switches being rendered in a conducting state.

10. The tunable filter according to claim 8, further comprising:

a second variable resonator having a resonance frequency which is the same as that of said variable resonator and a characteristic impedance different than that of said variable resonator; and two second switches, wherein each of said variable resonator and the second variable resonator is connected to said transmission line at a same connecting position as a branching circuit via a corresponding one of said two second switches;

said transmission line is connected electrically to both or either one of the variable resonator and the second variable resonator according to both or either one of said two second switches being rendered in a conducting state.

11. An electric circuit device, comprising:

said variable resonator according to any one of claims 1 and 3; and a transmission line having a bent portion, wherein said variable resonator is connected electrically as a branch circuit to said bent portion of said transmission line.

12. The electric circuit device according to claim 11, wherein a part of said variable resonator on an area where the bent portion of said transmission line and said variable resonator are electrically connected and in the vicinity of said area is not parallel with said transmission line.

13. The variable resonator according to claim 3, wherein each of said at least three variable reactance blocks is any one of circuit elements that include a capacitor, an inductor, and a transmission line, any one of combinations of the circuit elements of a same type, or any one of combinations of the circuit elements of different types.

* * * * *

UNITED STATES PATENT AND TRADEMARK OFFICE

CERTIFICATE OF CORRECTION

PATENT NO. : 8,330,562 B2
APPLICATION NO. : 13/343464
DATED : December 11, 2012
INVENTOR(S) : Kunihiro Kawai et al.

It is certified that error appears in the above-identified patent and that said Letters Patent is hereby corrected as shown below:

In the Claims:

Claim 6, Column 31, line 22, change "M/2+≦m≦M-1" to read -- M/2+1≦m≦M-1 --.

Signed and Sealed this
Twenty-third Day of April, 2013

Teresa Stanek Rea
*Acting Director of the United States Patent and Trademark Office*